US008644747B2

(12) United States Patent
Nakamura et al.

(10) Patent No.: US 8,644,747 B2
(45) Date of Patent: Feb. 4, 2014

(54) HEATING DEVICE, IMAGE FORMING APPARATUS, HEATING MEMBER AND MOUNTING METHOD

(75) Inventors: Tahei Nakamura, Yokohama (JP); Yuki Kubota, Yokohama (JP); Yasutaka Gotoh, Yokohama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 267 days.

(21) Appl. No.: 13/111,070

(22) Filed: May 19, 2011

(65) Prior Publication Data

US 2012/0155932 A1 Jun. 21, 2012

(30) Foreign Application Priority Data

Dec. 20, 2010 (JP) ..... 2010-283749

(51) Int. Cl.
*G03G 15/20* (2006.01)
*H05B 3/00* (2006.01)

(52) U.S. Cl.
USPC ..... 399/329; 399/122; 399/167; 399/330; 219/216

(58) Field of Classification Search
USPC ..... 399/67, 167, 320, 329, 333; 219/201, 219/216; 29/428
See application file for complete search history.

(56) References Cited

U.S. PATENT DOCUMENTS

| | | | | |
|---|---|---|---|---|
| 4,124,289 | A | 11/1978 | Miyata et al. | |
| 4,934,686 | A | 6/1990 | Ono et al. | |
| 5,459,553 | A * | 10/1995 | Kim | 399/20 |
| 5,749,038 | A | 5/1998 | Fromm et al. | |
| 5,999,788 | A | 12/1999 | Kanesawa et al. | |
| 6,876,832 | B2 | 4/2005 | Pirwitz et al. | |
| 7,130,571 | B2 | 10/2006 | Berg et al. | |
| 7,606,508 | B2 * | 10/2009 | Tsukamura et al. | 399/67 |
| 2005/0180789 | A1 | 8/2005 | Nakamura et al. | |
| 2005/0191092 | A1 * | 9/2005 | Toso et al. | 399/167 |
| 2008/0003006 | A1 * | 1/2008 | Tsukamura et al. | 399/67 |
| 2008/0292375 | A1 * | 11/2008 | Tsai et al. | 399/329 |
| 2009/0028616 | A1 | 1/2009 | Nakamura et al. | |
| 2009/0052925 | A1 * | 2/2009 | Fujimoto | 399/67 |
| 2009/0232569 | A1 | 9/2009 | Ishino et al. | |
| 2011/0255900 | A1 * | 10/2011 | Zhou et al. | 399/111 |

FOREIGN PATENT DOCUMENTS

| | | | |
|---|---|---|---|
| DE | 27 29 591 | A1 | 1/1978 |
| EP | 0 320 246 | A2 | 6/1989 |
| JP | 06-310259 | A | 11/1994 |
| JP | 06310259 | A * | 11/1994 |
| JP | 11-133776 | A | 5/1999 |

(Continued)

OTHER PUBLICATIONS

German Search Report dated Jan. 20, 2012 issued in German Patent Application No. 102011051896.7.

(Continued)

*Primary Examiner* — David Gray
*Assistant Examiner* — Francis Gray
(74) *Attorney, Agent, or Firm* — Sughrue Mion, PLLC

(57) ABSTRACT

A heating device including a heating member that heats a recording medium; a pressure unit that applies pressure to the heating member; and a rotation member that is mounted to the heating member. The rotation member is rotated upon receiving an external force and the heating member is rotated along with a rotation of the rotation member by a frictional force between the heating member and the rotation member.

12 Claims, 28 Drawing Sheets

(56) References Cited

FOREIGN PATENT DOCUMENTS

| | | | |
|---|---|---|---|
| JP | 2001235953 | A | 8/2001 |
| JP | 2002-148971 | A | 5/2002 |
| JP | 2002-148972 | A | 5/2002 |
| JP | 2003278741 | A | 10/2003 |
| JP | 2008176285 | A | 7/2008 |
| JP | 2010-002773 | A | 1/2010 |

OTHER PUBLICATIONS

Australian Examiner's Report dated Mar. 14, 2012, issued in Australian Patent Application No. 2011202544.

Japanese Office Action dated Mar. 19, 2013 issued in corresponding Japanese Patent Application No. 2010-283749, English-language translation.

* cited by examiner

DEFORMATION DIAGRAM ONLY SHOWING HEAT ROLL ELEMENT TUBE (CONTOUR SHOWS DISPLACEMENT)

DEFORMATION DIAGRAM ONLY SHOWING HEAT ROLL ELEMENT TUBE (CONTOUR SHOWS DISPLACEMENT)

DEFORMATION DIAGRAM ONLY SHOWING HEAT ROLL ELEMENT TUBE (CONTOUR SHOWS DISPLACEMENT)

DOUBLED ONLY IN +Y DIRECTION FOR EMPHASIS

DEFORMATION DIAGRAM ONLY SHOWING HEAT ROLL ELEMENT TUBE (CONTOUR SHOWS DISPLACEMENT)

DOUBLED ONLY IN +Y DIRECTION FOR EMPHASIS

CROSS-SECTION OF PRESSURE ROLL AND ELEMENT TUBE

THICKNESS OF ELEMENT TUBE : 0.10mm

THICKNESS OF ELEMENT TUBE : 0.16mm

CROSS-SECTION OF PRESSURE ROLL AND ELEMENT TUBE

CROSS-SECTION OF PRESSURE ROLL AND ELEMENT TUBE

HEATING DEVICE, IMAGE FORMING APPARATUS, HEATING MEMBER AND MOUNTING METHOD

CROSS REFERENCE TO RELATED APPLICATIONS

This application is based on and claims priority under 35 USC §119 from Japanese Patent Application No. 2010-283749 filed Dec. 20, 2010.

BACKGROUND

1. Technical Field

The present invention relates to a heating device, an image forming apparatus, a heating member and a mounting method.

2. Related Art

In recent years, as a device for heating a recording medium, a device has been suggested in which a recording medium is passed between a heating member that heats the recording medium and a pressure member that applies pressure to the heating member.

SUMMARY

According to an aspect of the present invention, there is provided a heating device including: a heating member that heats a recording medium; a pressure unit that applies pressure to the heating member; and a rotation unit that is mounted to the heating member and is rotated upon receiving an external force, wherein the heating member is rotated along with a rotation of the rotation unit by a frictional force between the heating member and the rotation unit generated due to deformation of at least one of the rotation unit and the heating member.

BRIEF DESCRIPTION OF THE DRAWINGS

Exemplary embodiments of the present invention will be described in detail based on the following figures, wherein.

DETAILED DESCRIPTION

Hereinafter, exemplary embodiments of the present invention are described in detail with reference to the accompanying drawings.

Figure 1:
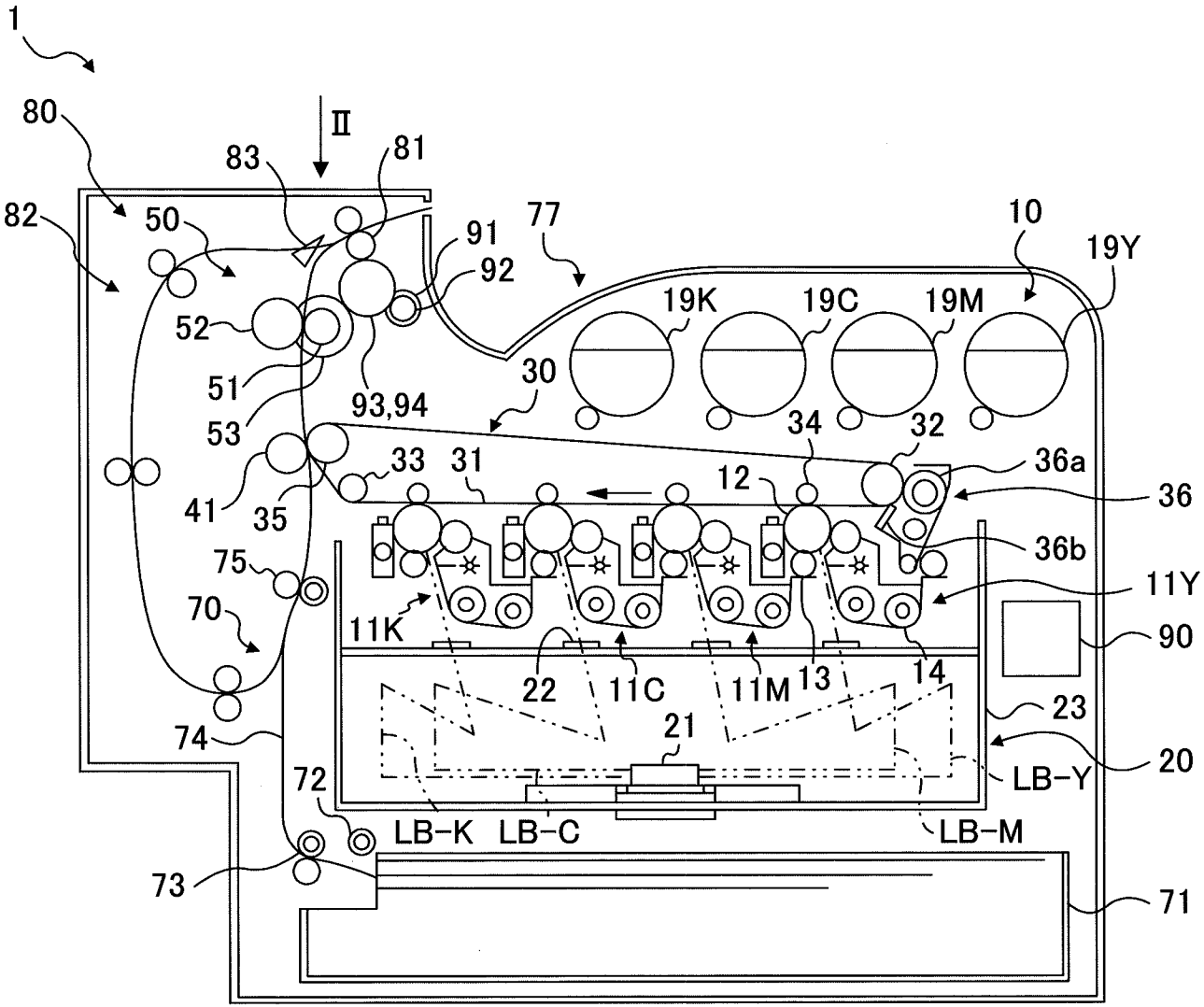
FIG. 1 is a diagram showing a schematic configuration of an image forming apparatus to which exemplary embodiments of the present invention is applied.

FIG. 1 is a diagram showing a schematic configuration of an image forming apparatus 1 to which the exemplary embodiments of the present invention is applied.

The image forming apparatus 1 includes: an image forming unit 10 that forms an image on a recording medium (hereinafter, representatively, referred to as a "sheet" in some cases); a sheet supplying unit 70 that supplies a sheet to the image forming unit 10; and a sheet stacking unit 77 on which the sheets each including an image formed by the image forming unit 10 are stacked. The image forming apparatus 1 also includes: a sheet transport portion 80 that transports the sheet on which an image is formed in the image forming unit 10; and a controller 90 that controls an operation of each component described above.

The image forming unit 10 includes four image formation units 11Y, 11M, 11C and 11K of yellow (Y), magenta (M), cyan (C) and black (K) that are arranged in parallel at substantially constant intervals. Each of the image formation units 11 includes: a photoconductive drum 12; a charging device 13 that uniformly charges the surface of the photoconductive drum 12; and a developing device 14 that develops an electrostatic latent image with predetermined color component toners and thus visualizes the image, the electrostatic latent image being formed by a later-described optical system unit 20 using laser irradiation. In addition, the image forming unit 10 is provided with toner cartridges 19Y, 19M, 19C and 19K that supply the color toners to the developing devices 14 of the image formation units 11Y, 11M, 11C and 11K, respectively. Then, the optical system unit 20 that emits a laser beam to the photoconductive drums 12 of the image formation units 11Y, 11M, 11C and 11K is arranged below the image formation units 11Y, 11M, 11C and 11K.

In addition, the image forming unit 10 includes: an intermediate transfer unit 30 that transfers the color toner images formed on the photoconductive drums 12 of the respective image formation units 11Y, 11M, 11C and 11K, onto an intermediate transfer belt 31 in a multi-layered manner; a secondary transfer roll 41 that transfers, onto a sheet, the toner images formed while being superimposed on the intermediate transfer unit 30; and a fixing device 50 that fixes the formed toner images onto the sheet by applying heat and pressure thereto.

The optical system unit 20 includes a polygon mirror 21, glass-made windows 22, and a rectangular parallelepiped frame 23 in addition to not-shown semiconductor lasers and a modulator. The polygon mirror 21 deflects and scans laser beams (LB-Y, LB-M, LB-C and LB-K) emitted from the semiconductor lasers. The windows 22 allow the laser beams to pass therethrough. The frame 23 seals the component members.

The intermediate transfer unit 30 includes: the intermediate transfer belt 31 that is an intermediate transfer body; a drive roll 32 that drives the intermediate transfer belt 31; and a tension roll 33 that provides a constant tension to the intermediate transfer belt 31. Moreover, the intermediate transfer unit 30 includes: multiple primary transfer rolls 34 (four rolls in the exemplary embodiments) that face the respective photoconductive drums 12 with the intermediate transfer belt 31 interposed therebetween and transfer the toner images formed on the photoconductive drums 12 onto the intermediate transfer belt 31; and a backup roll 35 that is provided facing a later-described secondary transfer roll 41 with the intermediate transfer belt 31 interposed therebetween.

The intermediate transfer belt 31 is wound around the multiple roll members including the drive roll 32, the tension roll 33, the multiple primary transfer rolls 34 and the backup roll 35 with the constant tension applied thereto so that its length in a direction in which the multiple primary transfer rolls 34 are arranged may be longer than its length in the direction orthogonal to a plane including the rotation axes of the multiple primary transfer rolls 34. The intermediate transfer belt 31 is circularly driven by the drive roll 32 at a predetermined velocity in the direction indicated by an arrow, the drive roll 32 rotationally driven by a drive motor (not shown). As the intermediate transfer belt 31, one that is formed by rubber or resin is used, for example.

Moreover, the intermediate transfer unit 30 includes a cleaning device 36 that removes a residual toner and the like existing on the intermediate transfer belt 31. The cleaning device 36 includes a cleaning brush 36*a* and a cleaning blade 36*b*, and removes the residual toner, paper debris and the like from the surface of the intermediate transfer belt 31 after a transfer process of toner images is ended.

As described above, the intermediate transfer unit 30 has a thin and long shape in which the intermediate transfer belt 31 is wound around the drive roll 32, the tension roll 33 and the like so as to have a thin and long shape in the arrangement direction of the multiple primary transfer rolls 34. In addition, in the intermediate transfer unit 30, the backup roll 35 is arranged at one end in the longitudinal direction of the intermediate transfer belt 31 which is wound around the rolls to have the thin and long shape, and the cleaning device 36 is arranged at the other end thereof in the longitudinal direction.

The secondary transfer roll 41 forms a secondary transfer region between the secondary transfer roll 41 and the intermediate transfer belt 31 by pressing the backup roll 35 with the intermediate transfer belt 31 interposed therebetween and secondary-transfers toner images onto a sheet in the secondary transfer region. In order to transfer the toner images formed on the intermediate transfer belt 31 onto a sheet, the secondary transfer roll 41 provides the sheet with an electric charge having a polarity opposite to the toner charge polarity and thereby transfers the toner images on the intermediate transfer belt 31 onto the sheet with an electrostatic force. For this reason, a predetermined transfer electric field is to be generated between the secondary transfer roll 41 and the backup roll 35.

The fixing device 50 fixes the images (toner images) secondary-transferred on the sheet by the intermediate transfer unit 30 and the secondary transfer roll 41 to the sheet by a heat roll 51 and an endless belt 52 using heat and pressure. The fixing device 50 will be described in detail later.

The sheet supplying unit 70 includes: a sheet housing unit 71 that houses sheets on which images are to be recorded; a supply roll 72 that takes sheets from the sheet housing unit 71 and then supplies the sheets to a transport path 74; and a feed roll 73 that separates, one by one, the sheets supplied from the supply roll 72 and then transports the sheets. In addition, the sheet supplying unit 70 includes: the transport path 74 that transports, towards the secondary transfer region, the sheets separated one by one by the feed roll 73; and registration rolls 75 that transport the sheet transported via the transport path 74 toward the secondary transfer region according to the secondary transfer timing.

The sheet transport unit 80 includes: reverse rolls 81 that transport the sheet sent from the fixing device 50 toward a stacking unit 77 while nipping the sheet, and reverse the sheet with a switchback system as necessary; and a reverse transport unit 82 that transports the sheet reversed by the reverse rolls 82 toward the secondary transfer region again. The sheet transport unit 80 also includes a switching gate 83 that is arranged between the fixing device 50 and the reverse rolls 81 and switches a proceeding direction of the sheet.

The image forming apparatus 1 includes: a drive motor 91 whose rotational driving is controlled by the controller 90; and transmission gears 92, 93 and 94 that transmit a rotational driving force from the drive motor 91 (also refer to FIG. 2), and thereby the rotational driving force of the drive motor 91 is transmitted by the transmission gears 92, 93 and 94 to the reverse rolls 81. The reverse transport unit 82 includes plural transport rolls to transport the sheet reversed by the reverse rolls 81 toward the secondary transfer region again. The switching gate 83 switches the proceeding direction of the sheet by determining the proceeding direction of the sheet sent from the fixing device 50 to be guided to the reverse rolls 81, or by determining the proceeding direction of the sheet reversed by the reverse rolls 81 to be guided to the reverse transport unit 82.

The image forming apparatus 1 configured in the above-described manner operates as follows.

An image of an original that is read out by a not-shown image reader, or image data received from a not-shown personal computer or the like is subjected to predetermined image processing, and the image data subjected to the image processing is then converted into coloring material gradation data of four colors of yellow (Y), magenta (M), cyan (C) and black (K) and then outputted to the optical system unit 20.

The optical system unit 20 outputs the laser beams emitted from the semiconductor lasers (not-shown) to the polygon mirror 21 via an f-• lens (not shown) in accordance with the inputted coloring material gradation data. In the polygon mirror 21, the incident laser beams are modulated in accordance with the gradation data of the respective colors, and then deflected and scanned. The polygon mirror 21 then directs the laser beams to the photoconductive drums 12 of the image formation units 11Y, 11M, 11C and 11K via a not-shown imaging lens and not-shown multiple mirrors.

In the photoconductive drums 12 of the image formation units 11Y, 11M, 11C and 11K, their surfaces charged by the charging devices 13 are scanned and exposed, and thereby, electrostatic latent images are formed. The formed electrostatic latent images are developed as toner images of the respective colors of yellow (Y), magenta (M), cyan (C) and black (K) in the image formation units 11Y, 11M, 11C and 11K, respectively. The toner images formed on the photoconductive drums 12 of the image formation units 11Y, 11M, 11C and 11K are transferred in a multi-layered manner onto the intermediate transfer belt 31 that is an intermediate transfer body.

Meanwhile, in the sheet supplying unit 70, the supply roll 72 rotates according to the timing of image formation to take the sheets housed in the sheet housing unit 71. Then, after the sheets are separated one by one by the feed roll 73, the sheet is transported to the registration rolls 75 via the transport path 74, and is once stopped there. Thereafter, the registration rolls 75 rotate according to the moving timing of the intermediate transfer belt 31 on which the toner images are formed, and the sheet is transported to the secondary transfer region formed by the backup roll 35 and the secondary transfer roll 41. The toner images obtained by forming the toner images of the four colors in a multi-layered manner are sequentially transferred onto the sheet in the slow scan direction by use of a pressure bonding force and a predetermined electric field, the sheet being transported upwardly in the secondary transfer region. Then, the sheet on which the color toner images are transferred is subjected to the fixing process performed by the fixing device 50 using heat and pressure, and thereafter, the sheet is stacked in the sheet stacking unit 70, or reversed and forwarded to the secondary transfer region again.

First Exemplary Embodiment

Next, the fixing device 50 according to the first exemplary embodiment will be described in detail.

Figure 2:
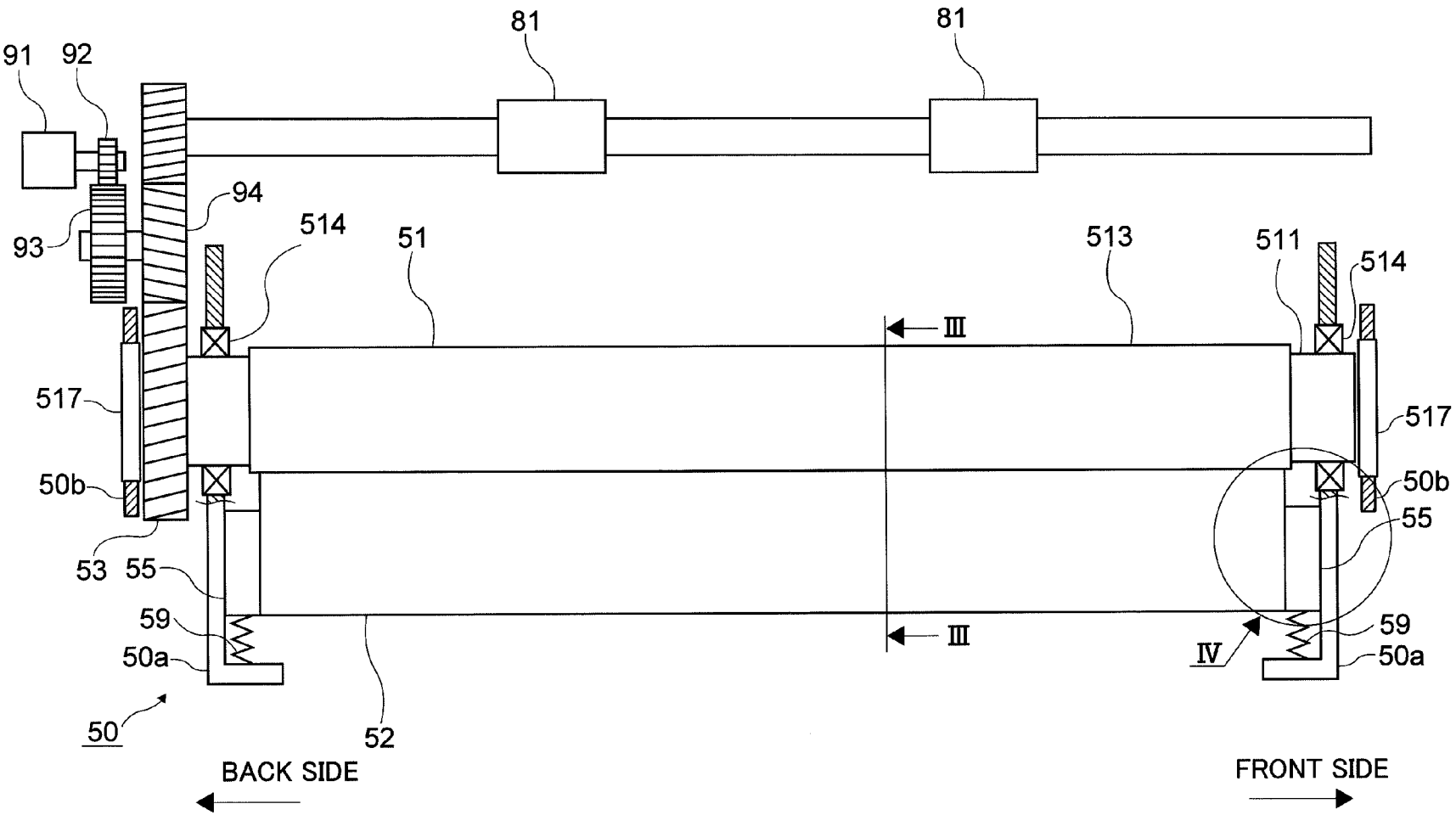
FIG. 2 is a schematic front view showing a configuration of a fixing device according to a first exemplary embodiment as viewed in the direction II in FIG. 1 from a downstream side of a sheet transport direction.
Figure 3:
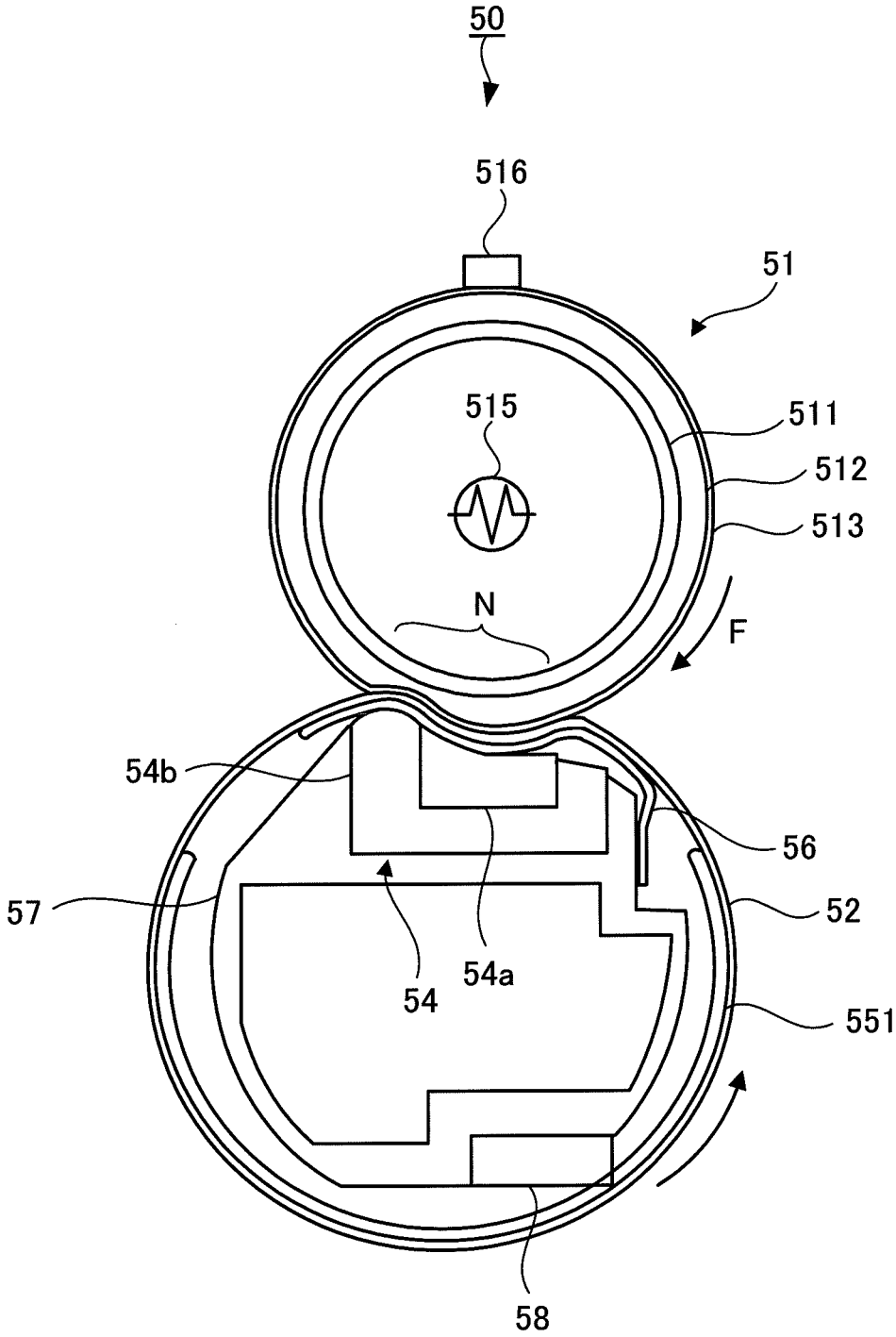
FIG. 3 is a cross-sectional view taken along the III-III part in FIG. 2.
Figure 4:
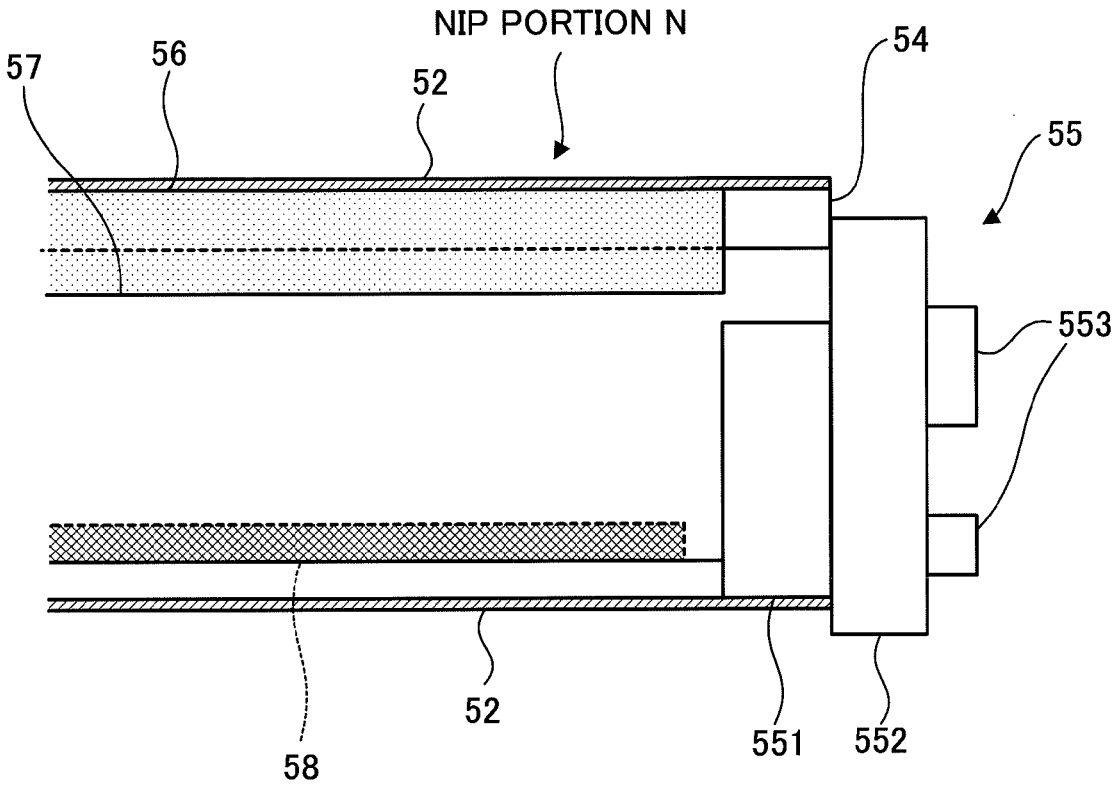
FIG. 4 illustrates a state where an endless belt is supported, which is an enlarged view of the IV part in FIG. 2.

FIG. 2 is a schematic front view showing a configuration of the fixing device 50 according to the first exemplary embodiment as viewed in a direction of arrow II in FIG. 1 from a downstream side of the sheet transport direction. FIG. 3 is a cross-sectional view taken along the III-III part in FIG. 2. FIG. 4 illustrates a state where the endless belt 52 is supported, which is an enlarged view of the IV part in FIG. 2.

The fixing device 50 includes: the heat roll 51 as an example of a heating member that heats the sheet; the endless belt 52 as an example of a pressure unit that applies pressure to the heat roll 51, the endless belt 52 also constituting a part of the pressure unit; and a gear unit 53 as an example of a rotation unit that is mounted to the heat roll 51 and rotates by an external force. As another example of the pressure unit, a pressure roll that has a shaft and an elastic body layer (for example, a rubber layer) formed on the outer periphery of the shaft may be provided. The fixing device 50 functions as an embodiment of a heating device that heats the sheet. It should be noted that, in the following description, as an example of the pressure unit and a constituent of a part of the pressure unit, and also an example of a facing member that faces the heat roll 51, explanation will be made by taking the endless belt 52 as an example; however, the pressure roll may be used instead of the endless belt 52.

First, the heat roll 51 will be described.

The heat roll 51 is a member rotating around a rotation axis which extends in the lateral direction in FIG. 2 and in a direction intersecting the page (a direction from one of the front side and the back side to the other) in FIG. 1, and the heat roll 51 includes: a base 511 which is a thin cylinder; a heat-resistant elastic body layer 512 formed around the base 511 (refer to FIG. 3); and a release layer 513 formed on the surface of the heat-resistant elastic body layer 512. The heat roll 51 is attached to a main frame 50*a*, which is a frame for the fixing device fastened to or detached from a main body frame (not shown) of the image forming apparatus 1, and rotatably supported with respect to the main frame 50*a* via bearing members 514 such as ball bearings arranged on both end sides in the rotation axis direction. It should be noted that the rotation axis may be an axis with a form having a physical substance, or may be a hypothetical axis with a form having no physical substance.

The base 511 is a thin cylindrical member. Further, the base 511 is made of a material which is elastically deformed due to the contact between the heat roll 51 and the endless belt 52 and is restored by rigidity of its own in a state where the heat roll 51 is not in contact with the endless belt 52, and the material has high thermal conductivity. The material indicating such a property may be exemplified by iron, nickel, nickel steel, stainless used steel (SUS), nickel-cobalt alloy, copper, gold, nickel-iron alloy or the like. By providing such a property to the base 511, the heat roll 51 is elastically deformed due to the contact between the heat roll 51 and the endless belt 52 to extend the area of a nip portion N (refer to FIG. 3), which is a contact region along the sheet transport direction, applies pressure to a sheet on the nip portion N by an elastic force of its own, and is restored to a cylindrical shape by the rigidity of its own in the state where the heat roll 51 is not in contact with the endless belt 52. On an inner surface side of the base 511 (inner side of the thin cylindrical shape) corresponding to the nip portion N, no member is arranged to support the base 511 from inside. However, since the base 511 is made of a material capable of elastically deforming due to the contact between the heat roll 51 and the endless belt 52 and restoring by the rigidity of its own in the state where the heat roll 51 is not in contact with the endless belt 52, the base 511 is elastically deformed when the heat roll 51 comes into contact with the endless belt 52 and is restored to the cylindrical shape by the rigidity of its own in the state where the heat roll 51 is not in contact with the endless belt 52 though any member for support is not provided on the inner surface side of the base 511 corresponding to the nip portion N. However, any member for support may be provided as necessary. It should be noted that the nip portion N is an example of a heat and pressure applying portion in which the heat roll 51 is pressurized by a pressure pad 54 via the endless belt 52 and applies heat and pressure to a sheet between the heat roll 51 and the endless belt 52.

The base 511 according to the exemplary embodiment employs nickel as the material, and is formed with an outer diameter of 25 mm and a thickness of 0.1 mm. The outer diameter is exemplified as 25 mm, but not limited thereto; the outer diameter may be in a range of 20 mm to 30 mm. The thickness is exemplified as 0.1 mm, but not limited thereto; the thickness may be in a range of 0.05 mm to 0.2 mm. The base 511 in the cylindrical shape made of nickel and having a thickness of 0.1 mm may be formed by any given method, which may be electroforming or deep drawing, by way of example.

The heat-resistant elastic body layer 512 is made of an elastic body having high heat-resistance. It is possible to use any material as long as the material has high heat-resistance, and in particular, an elastic body such as rubber and elastomer having rubber hardness (JIS-A) of the order of 5° to 20° may be used. Specifically, silicone rubber, fluororubber or the like may be provided, by way of example.

The release layer 513 is made of heat-resistant resin. It is possible to use any resin as long as the resin has heat resistance, for example, silicone resin, fluororesin or the like; in terms of releasing property or abrasion resistance of the release layer 513 against toner, fluororesin may be used. As fluororesin, PFA, PTFE (polytetrafloroethylene), FEP (fluorinated ethylene-propylene copolymer) or the like may be used. The thickness of the release layer 513 may be 5 μm to 30 μm.

The fixing device 50 includes a halogen heater 515 that is provided inside the heat roll 51 and functions as a heating source and a temperature sensor 516 that detects a temperature of the surface of the heat roll 51. The above-described controller 90 controls heating of the halogen heater 515 based on the detected temperature value by the temperature sensor 516 to adjust the surface temperature of the heat roll 51 so that a predetermined fixing temperature (for example, 170° C.) may be maintained.

Next, the endless belt 52 will be described.

The endless belt 52 is an endless belt, an original of which is formed in a cylindrical shape having a diameter of 30 mm, and is constituted by a base layer and a release layer (not shown) coated on a surface of the base layer to face the heat roll 51 or on both surfaces of the base layer. The base layer is made of polymer such as polyimide, polyamide and polyimideamide, or metal such as SUS, nickel and copper, and the thickness of the base layer may be 30 μm to 200 μm. The release layer coated on the surface of the base layer is made of fluororesin, such as PFA, PTFE and FEP, and the thickness of the release layer may be 5 μm to 100 μm.

With respect to an inner circumferential surface of the endless belt 52, a surface roughness Ra (arithmetic average roughness) is set to 0.4 μm or less to reduce sliding resistance between the endless belt 52 and the pressure pad 54 which will be described later. Further, with respect to an outer circumferential surface of the endless belt 52, the surface roughness Ra is set to 1.2 μm to 2.0 μm to facilitate receiving a driving force from the heat roll 51.

Next, a configuration for supporting the endless belt 52 will be described.

The fixing device 50 includes: the pressure pad 54 (refer to FIG. 3) and edge guides 55 (refer to FIG. 4) that rotatably support the endless belt 52, a low friction sheet 56 (refer to FIG. 3) that reduces the sliding resistance between the inner circumferential surface of the endless belt 52 and the pressure pad 54 and a holder 57 (refer to FIG. 3) made of metal that holds the pressure pad 54 and the low friction sheet 56.

The pressure pad 54 is arranged inside the endless belt 52 in a state of being pressed by the heat roll 51 via the endless belt 52, and functions to form the nip portion N between the heat roll 51 and the endless belt 52. The pressure pad 54 includes a pre-nip member **54*a* to keep the nip portion N which is long in the length of the sheet transport direction (the length in the moving direction of the endless belt 52 and the heat roll 51) and a peeling nip member 54*b* that causes deformation in the heat roll 51. The pre-nip member 54*a* is arranged on an inlet side of the nip portion N and the peeling nip member 54*b*** is arranged on an outlet side of the nip portion N.

The pre-nip member **54*a* is constituted by an elastic body such as silicone rubber and fluororubber, a plate spring or the like, and a surface of the pre-nip member 54*a* facing the heat roll 51 is formed to have a concave shape that roughly follows the outer circumferential surface of the heat roll 51**.

The peeling nip member **54*b* is made of a heat-resistant resin such as PPS (polyphenylene sulfide), polyimide, polyester and polyamide, or metal such as iron, aluminum, SUS and the like. The outer surface of the peeling nip member 54*b*** in the nip portion N is formed to have a curved convex shape having a substantially constant radius of curvature.

The edge guides 55 are, as shown in FIG. 4, arranged at respective end portions in the direction of rotation axis of the holder 57. Each of the edge guides 55 includes a belt running guide portion 551 having a cylindrical shape with a cutout being formed at a portion corresponding to the nip portion N and neighborhood thereof, namely, having a C-shaped cross-section and a flange portion 552 that is provided outside the belt running guide portion 551 in the direction of rotation axis thereof and has an outer diameter larger than an inner diameter of the endless belt 52. Further, the edge guide 55 includes a holding portion 553 that is provided outside the flange portion 552 in the direction of rotation axis, and positions and secures the edge guide 55 to the main frame **50*a* of the fixing device 50**.

Both end portions of the holder 57 in the rotation axis direction are fastened to the inner side surfaces of the flange portions 552 of the edge guides 55 and supported. Moreover, the belt running guide portion 551 of each of the edge guide 55 is arranged to overlap in the rotation axis direction with a partial region in the end portion of the holder 57 in the direction of rotation axis of the holder 57.

In the endless belt 52, except for the nip portion N and the proximity thereto, the inner circumferential surfaces of both side portions in the rotation axis direction are supported by the outer circumferential surfaces of the belt running guide portions 551 and the endless belt 52 rotates along the outer circumferential surfaces of the belt running guide portions 551. Accordingly, the belt running guide portions 551 are made of a material having a small coefficient of static friction so that the endless belt 52 may rotate smoothly, and moreover, the belt running guide portions 551 are made of a material having low thermal conductivity so that heat is hardly taken from the endless belt 52. The flange portions 552 are arranged such that the distance between the inner side surfaces of the flange portions 552 at both end portions of the holder 57 in the rotation axis direction thereof substantially coincide with the width of the endless belt 52, thus regulating movement of the endless belt 52 in the rotation axis direction (belt walk). In this manner, the endless belt 52 is set in which movements in the rotation direction and the rotation axis direction are regulated by the edge guides 55.

Further, each of the edge guides 55 is, as shown in FIG. 2, supported with biasing toward the heat roll 51 by an extension spring 59. In the exemplary embodiment, the heat roll 51 is pressed by the pressure pad 54 with a total load of 50 N to 250 N (5.1 kgf to 25.5 kgf) via the endless belt 52. With this configuration, the endless belt 52 rotates to follow the rotation of the heat roll 51.

The low friction sheet 56 is provided on the surfaces of the pre-nip member 54*a* and the peeling nip member 54*b*, which are in contact with the endless belt 52. To reduce the sliding resistance (frictional resistance) between the inner circumferential surface of the endless belt 52 and the pressure pad 54, the low friction sheet 56 is made of a material having a small coefficient of friction and excellent abrasion resistance and heat resistance. Further, on the surface of the low friction sheet 56 facing the endless belt 52, minute asperities are formed so that a lubricant applied on the inner circumferential surface of the endless belt 52 may enter the sliding portion of the low friction sheet which slides over the endless belt 52. The roughness Ra (arithmetic average roughness) of the asperities is 5 μm to 30 μm. This is based on the fact that, if the roughness of the asperities is less than Ra=5 μm, it is difficult to cause sufficient lubricant to enter the sliding portion that slides over the endless belt 52, and on the other hand, if the roughness is more than Ra=30 μm, traces of the asperities are conspicuous as gloss variation when fixing is performed on an OHP sheet or coated paper. Moreover, the low friction sheet 56 is formed to have no wetting property (impermeability) against the lubricant so that the lubricant does not permeate and get out from the backside of the low friction sheet 56. Specifically, the low friction sheet 56 may be formed with: a porous resin fiber cloth made of fluororesin as a base layer applied with a PET resin sheet on the surface facing the pressure pad 54; a PTFE resin sheet formed by sintering; a glass fiber sheet impregnated with Teflon (trademark) or the like, by way of example. It should be noted that the low friction sheet 56 may be configured separately from the pre-nip member 54*a* or the peeling nip member 54*b*, or may be configured integrally with the pre-nip member 54*a* or the peeling nip member 54*b*.

The holder 57 holds the pressure pad 54 and the low friction sheet 56, and also holds a lubricant applying member 58 that extends in the rotation axis direction of the heat roll 51 to apply the lubricant to the inner circumferential surface of the endless belt 52. The lubricant applying member 58 is constituted by heat-resistant felt and is impregnated with a lubricant, for example, amino modifier silicone oil having a viscosity of 300 cs, of the order of 3 g. The lubricant applying member 58 is arranged in contact with the inner circumferential surface of the endless belt 52 and supplies the lubricant of a proper amount to the inner circumferential surface of the endless belt 52 due to osmotic pressure from the heat-resistant felt. It should be noted that the lubricant applying member 58 is configured such that an edge portion of the heat-resistant felt comes into contact with the inner circumferential surface of the endless belt 52 not to supply excessive lubricant from the heat-resistant felt. Accordingly, the lubricant is supplied to the sliding portion between the endless belt 52 and the low friction sheet 56 to further reduce the sliding resistance between the endless belt 52 and the pressure pad 54 via the low friction sheet 56, thus encouraging smooth rotation of the endless belt 52.

Next, the gear unit 53 will be described.

Figure 5:
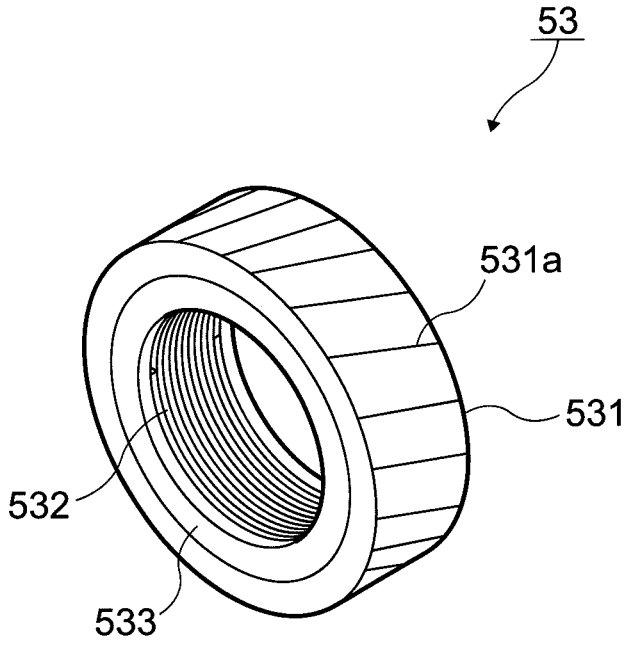
FIG. 5 is a perspective view of a gear unit.
Figure 6:
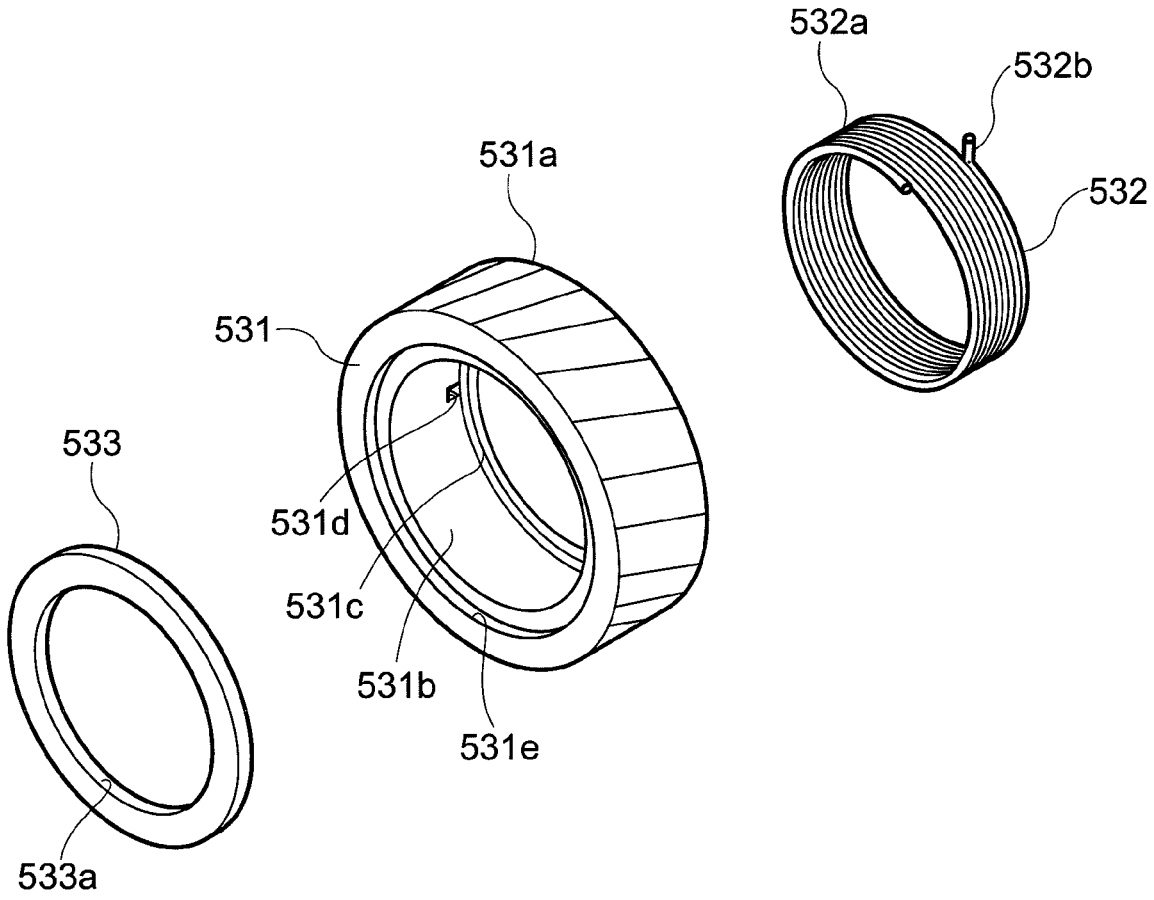
FIG. 6 illustrates components constituting the gear unit.
Figure 7:
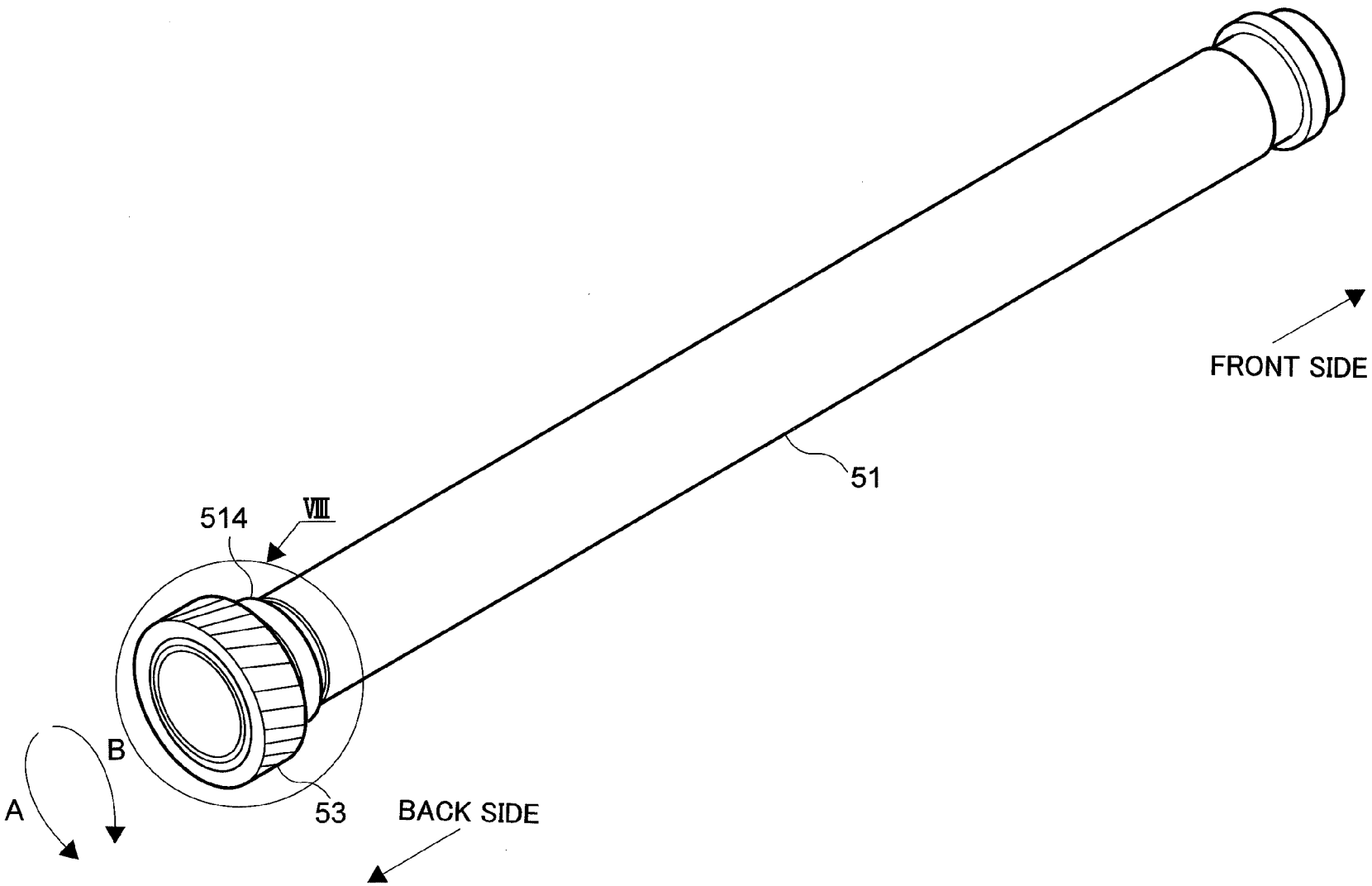
FIG. 7 illustrates a state where the gear unit is attached to the heat roll.
Figure 8:
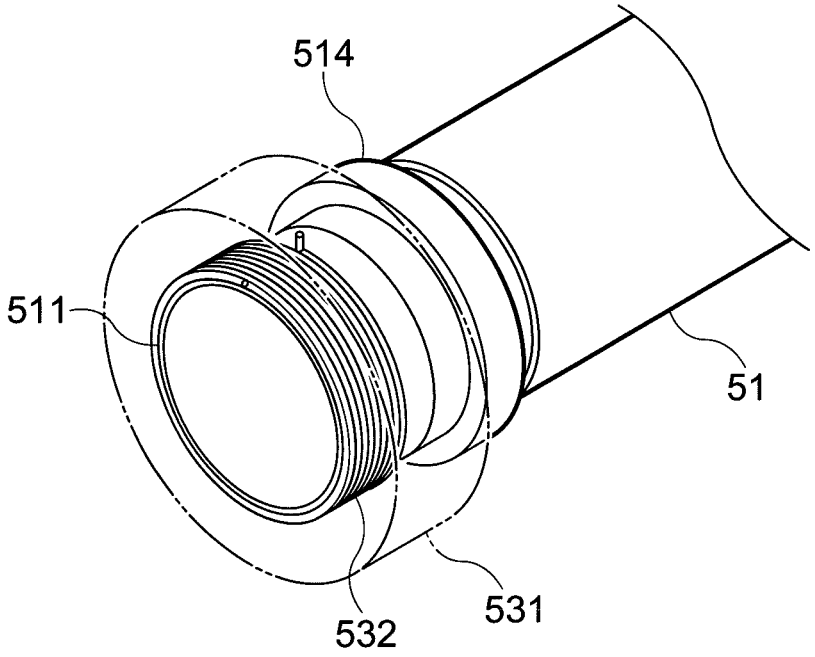
FIG. 8 is an enlarged view of the VIII part in FIG. 7.
Figure 9:
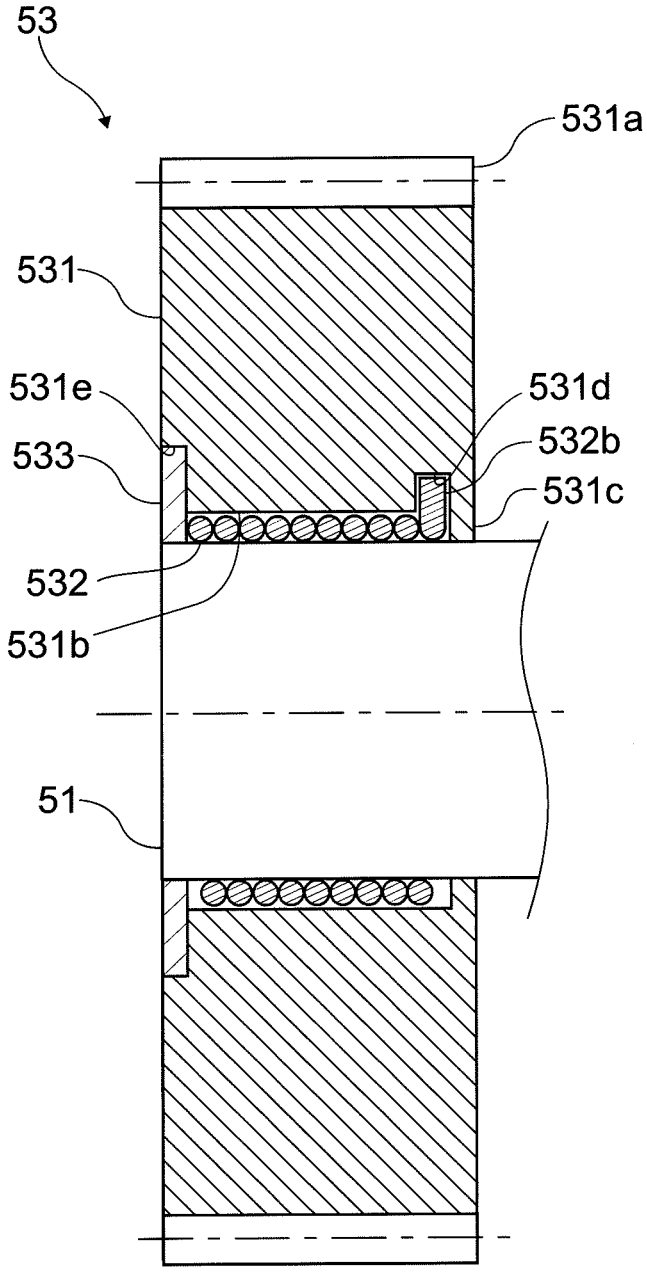
FIG. 9 is a cross-sectional view of the gear unit.

FIG. 5 is a perspective view of the gear unit 53. FIG. 6 illustrates components constituting the gear unit 53. FIG. 7 illustrates a state where the gear unit 53 is mounted to the heat roll 51. FIG. 8 is an enlarged view of the VIII portion in FIG. 7. FIG. 9 is a cross-sectional view of the gear unit 53. It should be noted that, in FIG. 8, a gear 531, which will be described later, is indicated with a chain double-dashed line for making relative positions of a coil spring 532, which will be described later, and the base 511 of the heat roll 51 more understandable.

The gear unit 53 includes: the gear 531 as an example of a rotation member on an outer periphery of which helical teeth 531*a* are formed; the torsion coil spring 532 as an example of an elastic member mounted to the inside of the gear 531; and a cap 533 that suppresses movement of the torsion coil spring 532 in the rotation axis direction thereof. As shown in FIGS. 1 and 2, the rotational driving force from the drive motor 91 is transmitted to the gear unit 53 via the transmission gears 92, 93, 94 and the like, and receives an external force via the helical teeth 531*a* as an example of a projection portion.

The gear 531 is a member formed of a resin having high heat-resistance; for the gear 531 according to the exemplary embodiment, a polyphenylene sulfide (PPS) resin containing the glass fibers is used. The gear 531 includes: a mounting portion 531*b* to the inside of which the torsion coil spring 532 is mounted; and a convex portion 531*c* formed over the entire circumferential direction of a portion outside of one end portion of the mounting portion 531*b* in the rotation axis direction, the convex portion 531*c* projecting toward the inside of the rotation radius from the mounting portion 531*b*. Further, on the other end portion side of the mounting portion 531*b* of the gear 531 in the rotation axis direction, a radius direction concave portion 531*d*, which is recessed toward the outside of the rotation radius, is formed. Moreover, on the other end portion side of the gear 531 in the rotation axis direction, an axis direction concave portion 531*e*, which is recessed toward the rotation axis direction from an end surface in the rotation axis direction, is formed.

The torsion coil spring 532 is formed by a SUS material having a wire diameter of ø0.8. A coil portion 532*a* of the torsion coil spring 532 is made from 9 turns counterclockwise. Further, one end portion of the torsion coil spring 532 is bent to project toward the outside in the rotation radius direction from the coil portion 532*a*, thus forming a projection portion 532*b* that projects from the coil portion 532*a*. When the torsion coil spring 532 is mounted to the gear 531, the projection portion 532*b* is inserted into the radius direction concave portion 531*d* of the gear 531. Consequently, movement of the torsion coil spring 532 with respect to the gear 531 is suppressed. The inner diameter of the coil portion 532*a* of the torsion coil spring 532 is formed smaller than the outer diameter of the base 511 of the heat roll 51. That is to say, in the case where the gear unit 53 is fitted into the heat roll 51, the torsion coil spring 532 and the base 511 of the heat roll 51 are fitted by the interference fit. On the other hand, the outer diameter of the coil portion 532*a* of the torsion coil spring 532 is formed smaller than the inner diameter of the mounting portion 531*b* of the gear 531. That is to say, in the case where the torsion coil spring 532 is mounted to the gear 531, a gap is generated between the outer diameter of the coil portion 532*a* and the inner diameter of the mounting portion 531*b* of the gear 531.

The cap 533 is a member having a disc shape in which an opening 533*a* is formed, and is made of a high heat-resistant resin, for example, polyphenylene sulfide (PPS) resin. The inner diameter of the opening 533*a* is formed substantially the same as the inner diameter of the torsion coil spring 532. The cap 533 is fitted into the rotation axis direction concave portion 531*e* formed in the gear 531 to suppress movement of the torsion coil spring 532 in the rotation axis direction.

When the gear unit 53 thus configured is mounted to the heat roll 51, the bearing members 514 are fitted to the base 511 of the heat roll 51, and thereafter, the gear unit 53 is fitted into the base 511 of the heat roll 51 with one end portion side in the rotation axis direction, namely, the convex portion 531*c* formed in the gear 531 inserted first (refer to FIG. 9). Then the heat roll 51 to which two bearing members 514 and the gear unit 53 are mounted is fitted into the main frame 50*a* in which a U-shaped hole is formed.

On the outside of the heat roll 51, to which the gear unit 53 is mounted, in the rotation axis direction, thrust bearing members 517 (refer to FIG. 2), such as thrust bearings that regulate movement of the gear unit 53 and the heat roll 51 in the rotation axis direction and facilitate smooth rotation operation, are arranged. The thrust bearing members 517 are attached to a sub-frame 50*b* (refer to FIG. 2), which is a frame for a fixing device fastened to a main body frame (not shown) of the image forming apparatus 1.

Next, transmission of the rotational driving force from the gear unit 53 to the heat roll 51 in the case where the gear unit 53 is mounted to the heat roll 51 will be described.

Figure 10A:
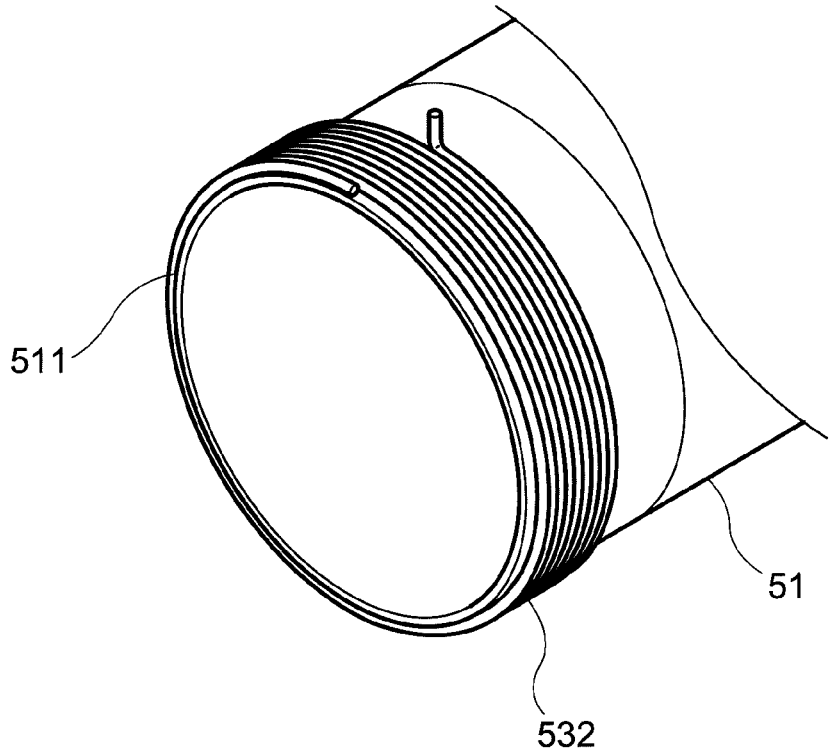
FIG. 10A illustrates a state before a torsion coil spring is deformed.
Figure 10B:
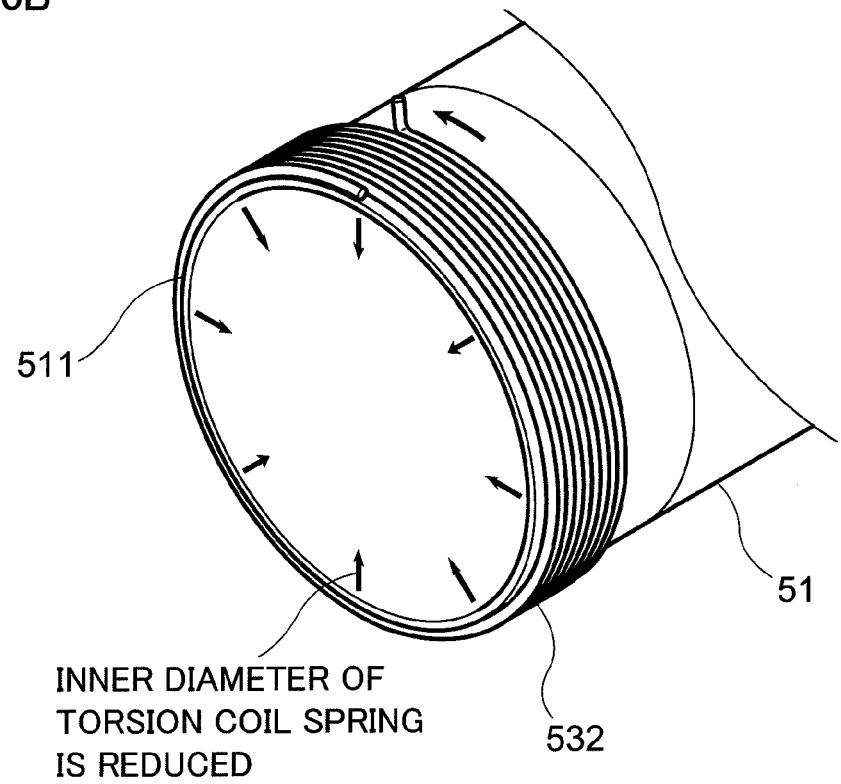
FIG. 10B illustrates a state after the torsion coil spring is deformed.

FIG. 10A illustrates a state before the torsion coil spring 532 is deformed, and FIG. 10B illustrates a state after the torsion coil spring 532 is deformed.

When the rotational driving force is transmitted from the drive motor 91 via the helical teeth 531*a* of the gear 531, the gear 531 is rotated. When the gear 531 is rotated, the rotational force of the gear 531 is transmitted to the projection portion 532*b* of the torsion coil spring 532 via the radius direction concave portion 531*d* of the gear 531. For example, in the case where the gear 531 is rotated in the direction of arrow A (counterclockwise direction) as viewed in FIG. 7, the projection portion 532*b* of the torsion coil spring 532 is similarly rotated in the direction of arrow A. In such a case, as described above, the torsion coil spring 532 is fitted into the base 511 of the heat roll 51 by the interference fit, and a contact force (frictional force) is generated between the torsion coil spring 532 and the base 511 of the heat roll 51; accordingly, one end portion side in the rotation axis direction of the coil portion 532*a* on which the projection portion 532*b* is provided is rotated in the direction of arrow A relative to the other end portion side. That is, since the torsion coil spring 532 is coiled counterclockwise, the torsion coil spring 532 is deformed so that the inner diameter of the coil portion 532*a* is reduced (becomes tight) (refer to FIG. 10B). Further, since a mounted portion in the base 511 of the heat roll 51, to which the gear unit 53 is mounted, is in a position close to the bearing member 514 and is opposed to the nip portion N with respect to the bearing member 514, deformation of the base 511 is small in the mounted portion.

As a result, the frictional force between the torsion coil spring 532 and the base 511 of the heat roll 51 becomes large compared to the frictional force before the gear 531 is rotated.

Here, as described above, the torsion coil spring 532 and the base 511 of the heat roll 51 are fitted by the interference fit, and the inner diameter of the coil portion 532*a* of the torsion coil spring 532 is set as follows with respect to the outer diameter of the base 511 of the heat roll 51. The frictional force generated between the torsion coil spring 532 and the base 511 of the heat roll 51 when the fixing temperature is as described above is set smaller than a frictional force (hereinafter, sometimes referred to as "required frictional force) to rotate the heat roll 51 against the frictional force generated between the heat roll 51 and the endless belt 52. The frictional force, which has been increased by the rotation of the torsion coil spring 532 in the direction of tightening upon receiving a force from the gear 531, is set equal to or larger than the required frictional force.

Consequently, in the case where the gear 531 is rotated in the direction of arrow A as viewed in FIG. 7 upon receiving the rotational driving force from the drive motor 91, the rotational driving force is transmitted from the drive motor 91 via the gear unit 53, and thereby the heat roll 51 is rotated against the frictional force generated between the heat roll 51 and the endless belt 52.

On the other hand, in the case where the gear 531 is rotated in the direction of arrow B (clockwise direction) as viewed in FIG. 7, the projection portion 532*b* of the torsion coil spring 532 is similarly rotated in the direction of arrow B, and one end portion side in the rotation axis direction of the coil portion 532*a* is rotated in the direction of arrow B relative to the other end portion side. That is, the torsion coil spring 532 is deformed so that the inner diameter of the coil portion 532*a* is increased (becomes loose). As a result, the frictional force between the torsion coil spring 532 and the base 511 of the heat roll 51 becomes small compared to the frictional force before the gear 531 is rotated. Consequently, in the case where the gear 531 is rotated in the direction of arrow B as viewed in FIG. 7 upon receiving the rotational driving force from the drive motor 91, the heat roll 51 is not rotated due to the frictional force generated between the heat roll 51 and the endless belt 52, and only the gear unit 53 is rotated.

The fixing device 50 as configured above operates as follows.

In the case where the controller 90 rotates the drive motor 91 in the clockwise direction as viewed in FIG. 1 so as to perform the fixing operation in the fixing device 50, the gear 531 of the gear unit 53 is also rotated in the clockwise direction (in the direction of arrow A in FIG. 7). In such a case, the torsion coil spring 532 of the gear unit 53 receives a force from the gear 531 and is deformed so that the inner diameter of the coil portion 532*a* is reduced, and the heart roll 51 is also rotated in the clockwise direction. The endless belt 52 is also rotated to follow the rotation of the heat roll 51.

When a sheet on which a toner image is transferred passes through the nip portion N in the secondary transfer position of the image forming apparatus 1, the toner image on the sheet is fixed by the pressure applied to the nip portion N and the heat supplied from the heat roll 51. In short, the toner image on the sheet is fixed on the sheet by pressurizing and heating by the heat roll 51 and the endless belt 52. In the fixing device 50 of the exemplary embodiment, since the nip portion N is set wider by the pre-nip member 54*a* having a concave shape that roughly follows the outer circumferential surface of the heat roll 51, fixing is performed more satisfactorily compared to the case where a nip portion is narrower than the nip portion N. In addition, the peeling nip member 54*b* is arranged to protrude toward the outer circumferential surface of the heat roll 51 to make the distortion of the heat roll 51 locally large at the outlet of the nip portion N, and thereby the sheet is peeled off the heat roll 51 with ease.

On the other hand, in the case where the controller 90 rotates the drive motor 91 in the counterclockwise direction as viewed in FIG. 1 so as to reverse the sheet subjected to fixing in the fixing device 50 and transport the sheet toward the secondary transfer position again, the gear 531 of the gear unit 53 is also rotated in the counterclockwise direction (in the direction of arrow B in FIG. 7). In such a case, the torsion coil spring 532 of the gear unit 53 receives a force from the gear 531, and is rotated in the counterclockwise direction with the gear 531. Due to the rotation of the torsion coil spring 532 in the counterclockwise direction (in the direction of arrow B in FIG. 7), the torsion coil spring 532 is deformed so that the inner diameter of the coil portion 532*a* is increased, and thereby the heat roll 51 does not rotate. Accordingly, the endless belt 52 is not rotated, too.

As described above, in the fixing device 50 according to the exemplary embodiment, since the torsion coil spring 532 is deformed so that the inner diameter of the coil portion 532*a* is reduced in the case where the gear 531 is rotated upon receiving the rotational driving force from the drive motor 91, the heat roll 51 is rotated due to the frictional force generated between the torsion coil spring 532 and the base 511 of the heart roll 51. That is to say, it is not that, for example, a convex portion provided on the gear 531 and a cutout formed in the base 511 of the heat roll 51 are fitted with each other and the rotational driving force from the drive motor 91 is transmitted via the cutout formed in the base 511. If the heat roll 51 is to be rotated via the cutout formed in the base 511, the cutout has to receive a sufficient force to rotate the heat roll 51 against the frictional force generated between the heat roll 51 and the endless belt 52; therefore, the base 511 itself requires strength capable of resisting the force. However, in the fixing device 50 according to the exemplary embodiment, the heat roll 51 is rotated by the frictional force generated on the outer circumferential surface of the base 511 of the heat roll 51, and thereby, the strength of the base 511 of the heat roll 51 itself may be low compared to the case of configuration in which the heat roll 51 is rotated only via the cutout formed in the base 511. Consequently, the thickness of the cylindrical base 511 may be small compared to the case of configuration in which the rotational driving force is transmitted only via the cutout formed in the base 511. Accordingly, the rotational driving force is transmitted without breaking the base 511 though the rigidity of the base 511 is of the extent in which the heat roll 51 is elastically deformed when contacting the endless belt 52 or a pressure roll, or the heat roll 51 is restored to the cylindrical shape with its own rigidity in the state without contacting the endless belt 52 or the pressure roll. If the thickness of the base 511 of the heat roll 51 is small, the heat capacity of the heat roll 51 becomes small, thus reaching the above-described fixing temperature early. Further, in the case where the pressure roll is used as an example of the pressure unit, the form of the nip portion N becomes more flat (the curvature is reduced) compared to the case where the above-described endless belt 52 and the pressure pad 54 are used, and therefore curling in the thick paper when the thick paper is transported as a sheet or creases in the envelopes when the envelopes are transported as sheets are reduced.

It may also be considered that support members, which have higher strength than the base 511 and support the base 511, are connected to both end portions of the base 511 in the rotation axis direction to reduce the thickness of the base 511 of the heat roll 51, and the rotational driving force from the drive motor 91 is transmitted via cutouts formed on the support members. However, with such a configuration, a component count is increased and the configuration becomes complicated compared to the configuration of the fixing device 50 according to the exemplary embodiment, in which the heat roll 51 is rotated by a frictional force generated on the outer circumferential surface of the base 511, and besides, since the heat capacity is increased for the support members, the fixing temperature is reached slowly. Moreover, since the heat roll 51 is rotated while being pressurized by the pressure pad 54 via the endless belt 52, that is, since the base 511 is rotated while being deformed in the rotation axis direction, the base 511 and the support members should be connected so as to endure the deformation. On the other hand, if the base 511 and the support members are strongly connected by welding or the like, the deformation of the base 511 is suppressed by the connection, and therefore, it becomes difficult to perform fixing process through the use of the elastic deformation of the base 511 such that the base 511 is dented at the nip portion N and restored by its own rigidity in the state without contacting the endless belt 52. Besides, there is a possibility to start breaking from the connection portion of the base 511 and the support members due to stress concentration on the connection portion. With the configuration according to the exemplary embodiment, the heat roll 51 is rotated against the force applied by the pressure pad 54 via the endless belt 52 without causing such problems.

Further, for example, in the case where the drive motor 91 is rotated in the counterclockwise direction to reverse, through the reverse transport unit 82, the sheet on a single surface of which the image has been fixed by the fixing device 50, the gear unit 53 is rotated, but the heat roll 51 and the endless belt 52 are not rotated as described above. Accordingly, deterioration of the heat roll 51 and the endless belt 52 is suppressed compared to the configuration in which the heat roll 51 and the endless belt 52 are rotated even when the fixing process is not performed. Moreover, compared to a configuration including a one-way clutch which rotates the heat roll 51 only in the clockwise direction as viewed in FIG. 1 but not in the counterclockwise direction, the configuration according to the exemplary embodiment is simpler because the one-way clutch is not required.

Further, in the event of a sheet jam or the like in the fixing device 50, a load to pull the sheet by the user in the sheet transport direction is reduced. That is, in the case where the heat roll 51 is rotated in the sheet transport direction, namely in the clockwise direction as viewed in FIG. 1, the torsion coil spring 532 is deformed so that the inner diameter of the coil portion 532 is increased, and thereby the gear unit 53 is not rotated, but only the heat roll 51 is prone to be rotated. Therefore, when the sheet is pulled in the sheet transport direction, a force for pulling the sheet is reduced since there is no need for rotating the gear unit 53, the transmission gears 92, 93, 94, the drive motor 91 and the like.

It should be noted that, with respect to specifications of the torsion coil spring 532 according to the exemplary embodiment, the SUS material having a wire diameter of ø0.8 and the coil portion 532*a* having 9 turns are provided by way of example, but the torsion coil spring 532 is not particularly limited to such specifications. The specifications of the torsion coil spring 532 may be set so that the frictional force generated between the torsion coil spring 532 and the heat roll 51, in a state where the torsion coil spring 532 is merely mounted to the heat roll 51, is less than the required frictional force as described above, and the frictional force between the torsion coil spring 532 and the heat roll 51 becomes equal to or more than the above-described required frictional force by rotating the torsion coil spring in the tightening direction upon receiving the rotational force from the gear 531. For example, the torsion coil spring may be made of a SUS material having a wire diameter of ø1.0 and including the coil portion 532*a* having 8 turns. Further, the cross-section of the wire material before forming the coil-shape torsion coil spring 532 may be circle or square.

Further, the material of the torsion coil spring 532 is exemplified by the SUS material, and among plural types of the SUS material, the SUS material having either a smaller coefficient of linear expansion or larger coefficient of linear expansion than that of nickel, which is a material of the base 511, may be selected. In the case where a SUS material having a larger coefficient of linear expansion than that of the nickel, which is a material of the base 511, for example, SUS 304 is selected, the inner diameter of the coil portion 532*a* of the torsion coil spring 532 may be set as follows. That is to say, in consideration of a difference between the coefficient of linear expansion of the material of the torsion coil spring 532 and the coefficient of linear expansion of the material of the base 511, the inner diameter of the torsion coil spring may be set so that the frictional force between the torsion coil spring 532 and the base 511, which is generated by deformation of the torsion coil spring 532 upon receiving a force from the gear 531, becomes equal to or more than the required frictional force at a temperature higher than the fixing temperature.

The shape of the other end portion side in the rotation axis direction of the torsion coil spring 532 of the gear unit 53 according to the above-described exemplary embodiment may be modified as follows.

Figure 19B:
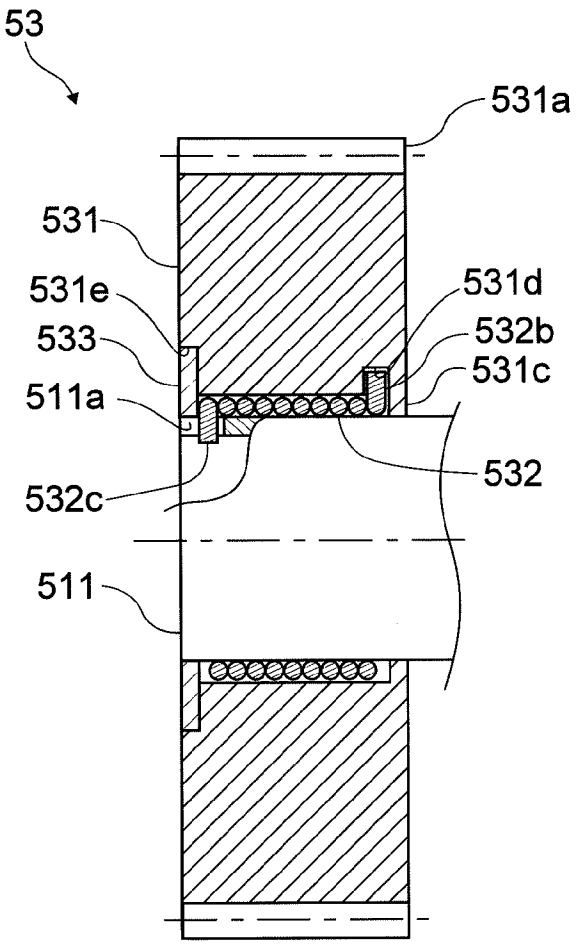
FIG. 19B is a cross-sectional view thereof.
Figure 19A:
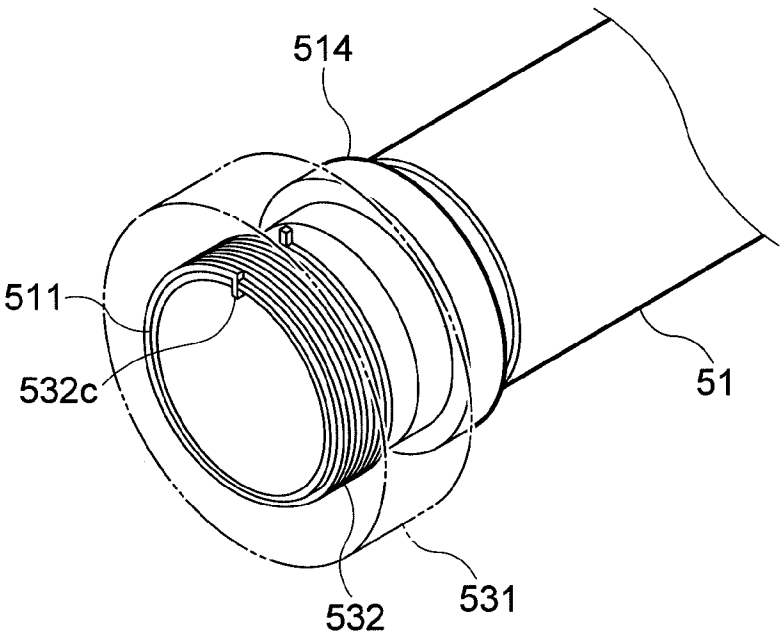
FIG. 19A is a perspective view that illustrates another shape of the torsion coil spring and the heat roll.

FIG. 19A is a perspective view that illustrates other shape of the torsion coil spring 532 and the heat roll 51, and FIG. 19B is a cross-sectional view thereof.

As shown in FIGS. 19 A and 19B, the other end portion of the torsion coil spring 532 is bent to project toward the inside in the rotation radius direction from the coil portion 532*a* (refer to FIG. 6), thus forming an inside projection portion 532*c* that projects from the coil portion 532*a*. Further, on the other end portion of the base 511 of the heat roll 51 in the rotation axis direction, a cutout 511*a* for inserting the inside projection portion 532*c* of the torsion coil spring 532 is formed. When the gear unit 53 is mounted to the heat roll 51, the inside projection portion 532*c* of the torsion coil spring 532 is inserted into the cutout 511*a* of the base 511.

With the above configuration, in the case where the drive motor 91 is rotated in the clockwise direction as viewed in FIG. 1 to fix the toner image on a sheet, the gear unit 53 hardly turns free with respect to the heat roll 51.

It should be noted that, even with this configuration, when the surface temperature of the heat roll 51 is increased up to the above-described fixing temperature for performing the fixing process, the frictional force generated between the torsion coil spring 532 and the base 511 of the heat roll 51 may be set larger than the required frictional force by rotation of the torsion coil spring 532 in the tightening direction upon receiving the force from the gear 531 so that the heat roll 51 is not rotated by the pressure generated between the inside projection portion 532*c* of the torsion coil spring 532 and the cutout 511*a* of the base 511.

When the gear unit 53 according to the exemplary embodiment is mounted to the heat roll 51, the gear unit 53 may be mounted while being rotated in the direction such that the inner diameter of the coil portion 532*a* of the torsion coil spring 532 becomes larger due to the frictional force generated between the torsion coil spring 532 of the gear unit 53 and the outer circumferential surface of the base 511 of the heat roll 51. That is, in FIG. 7, the gear unit 53 may be mounted while being rotated in the direction of arrow B. By thus mounting the gear unit 53, the frictional force generated between the torsion coil spring 532 and the base 511 of the heat roll 51 is reduced compared to the case where the gear unit 53 is mounted while being rotated in the direction of arrow A in FIG. 7, and thereby the gear unit 53 is easily mounted.

In the above-described exemplary embodiment, as an example of the rotation unit that is fitted into the heat roll 51 and is rotated upon receiving an external force, the gear unit 53 including the gear 531 and the torsion coil spring 532 as an example of the elastic member that is deformed with the rotation of the gear 531 is provided by way of example, and the heat roll 51 is rotated by the frictional force generated between the heat roll 51 and the torsion coil spring 532 due to the deformation of the torsion coil spring 532 caused with the rotation of the gear 531. However, any elastic member other than the torsion coil spring 532, for example, rubber, may be used as long as the elastic member is deformed with the rotation of the gear 531 and the required frictional force is generated between the elastic member and the heat roll 51. By using the elastic member, the heat roll 51 may be rotated more accurately compared to a configuration in which no elastic member is used.

EXPERIMENTAL EXAMPLES

Next, experimental examples will be described. Experiments are performed by using a pressure roll as an example of the pressure unit and by simulations using a computer, namely, the so-called computer simulations. In the experiments, different from the exemplary embodiment, the axis direction of the heat roll 51 and the pressure roll is regarded as a Z-axis direction, a direction from a center axis of the pressure roll toward a center axis of the heat roll 51 is regarded as a +Y-axis direction, and a direction intersecting both Z-axis direction and Y-axis direction is regarded as an X-axis direction to hypothesize left-handed XYZ-axes.

In the experiments, as the configuration of the heat roll 51, the length in the axis direction of the base 511 is set to 250 mm, the outer diameter is set to ø25 mm, and the material thereof is iron.

Further, in the experiments, a pressure roll is used in which a rubber layer is formed on an iron shaft having a length in the axis direction of 250 mm and a diameter of ø12 mm. The rubber layer has a length in the axis direction of 200 mm and an outer diameter of ø25 mm, and is modeled as a rubber layer having an elasticity of 1.6 MPa, which corresponds to the Young's modulus of the member of the fixing region portion in the belt-type pressure member currently on the market. It should be noted that the commercially available belt-type fixing device is described in, for example, Japanese Patent Laid Open Publications Nos. 2002-148971, 2002-148972 and the like, and detailed description is omitted because the fixing device has been conventionally and publicly known.

Then, in the case where, as a contact force, which is the so-called nip pressure, a force of 100 N in the +Y direction heading toward the center axis of the heat roll 51 is applied on both end portions of the shaft of the pressure roll, the stress applied to the heat roll 51 or displacement thereof is measured. It should be noted that, as the stress, Mises stress (von Mises stress) used for determining the yield of members is employed.

Example 1

In Example 1, the experiment is performed with the base 511 having the thickness of 0.10 mm.

Comparative Example 1

In Comparative example 1, the experiment is performed with the base 511 having the thickness of 0.16 mm.

The results of the experiments are shown in FIGS. 11A to 18B as follows. It should be noted that the base 511 is referred to as "element tube" in FIGS. 11A to 18B.

Figure 11A:
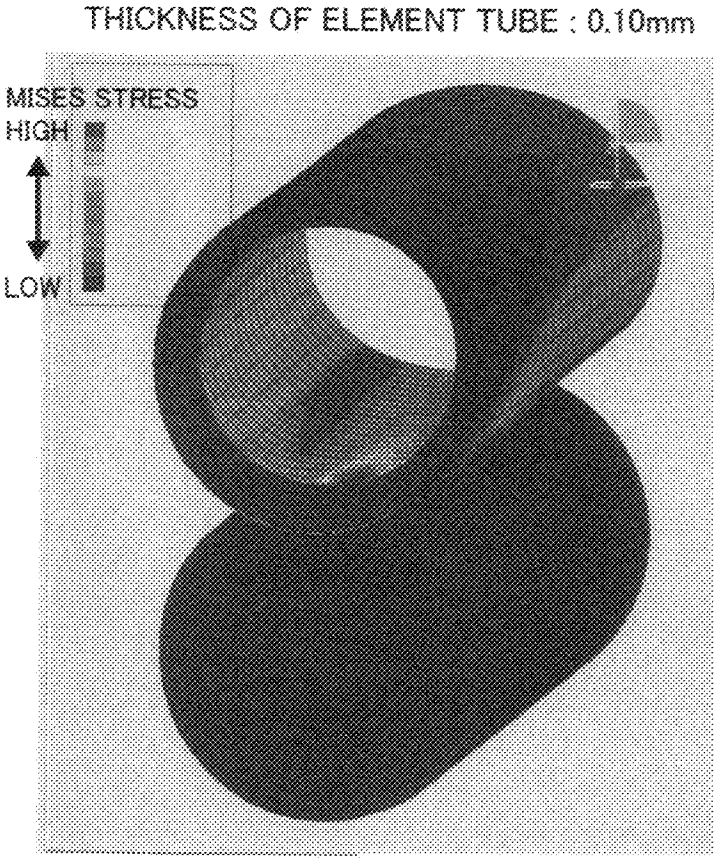
FIGS. 11A and 11B illustrate stress distribution in experimental results.
Figure 11B:
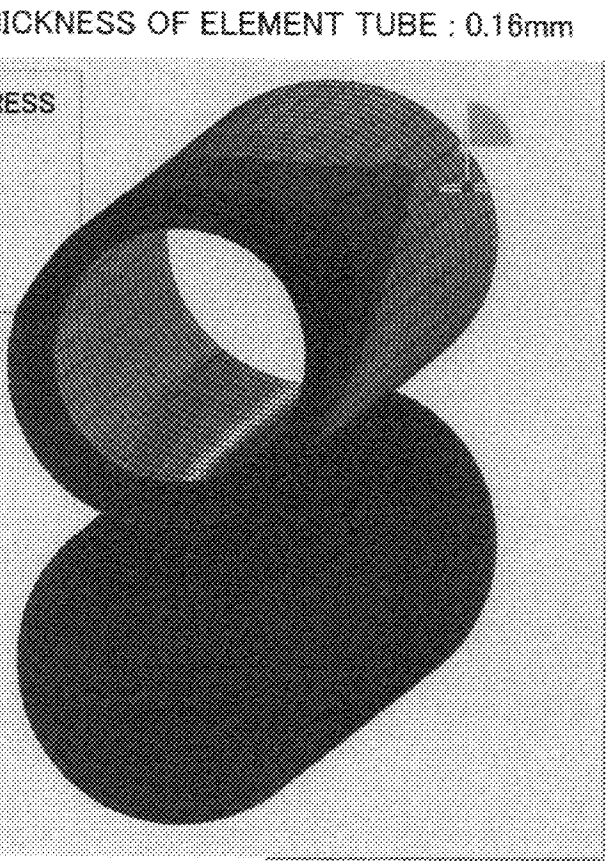

FIGS. 11A and 11B illustrate stress distribution in the experimental results: FIG. 11A illustrates Example 1 and FIG. 11B illustrates Comparative example 1.

Figures 12A, 12B:
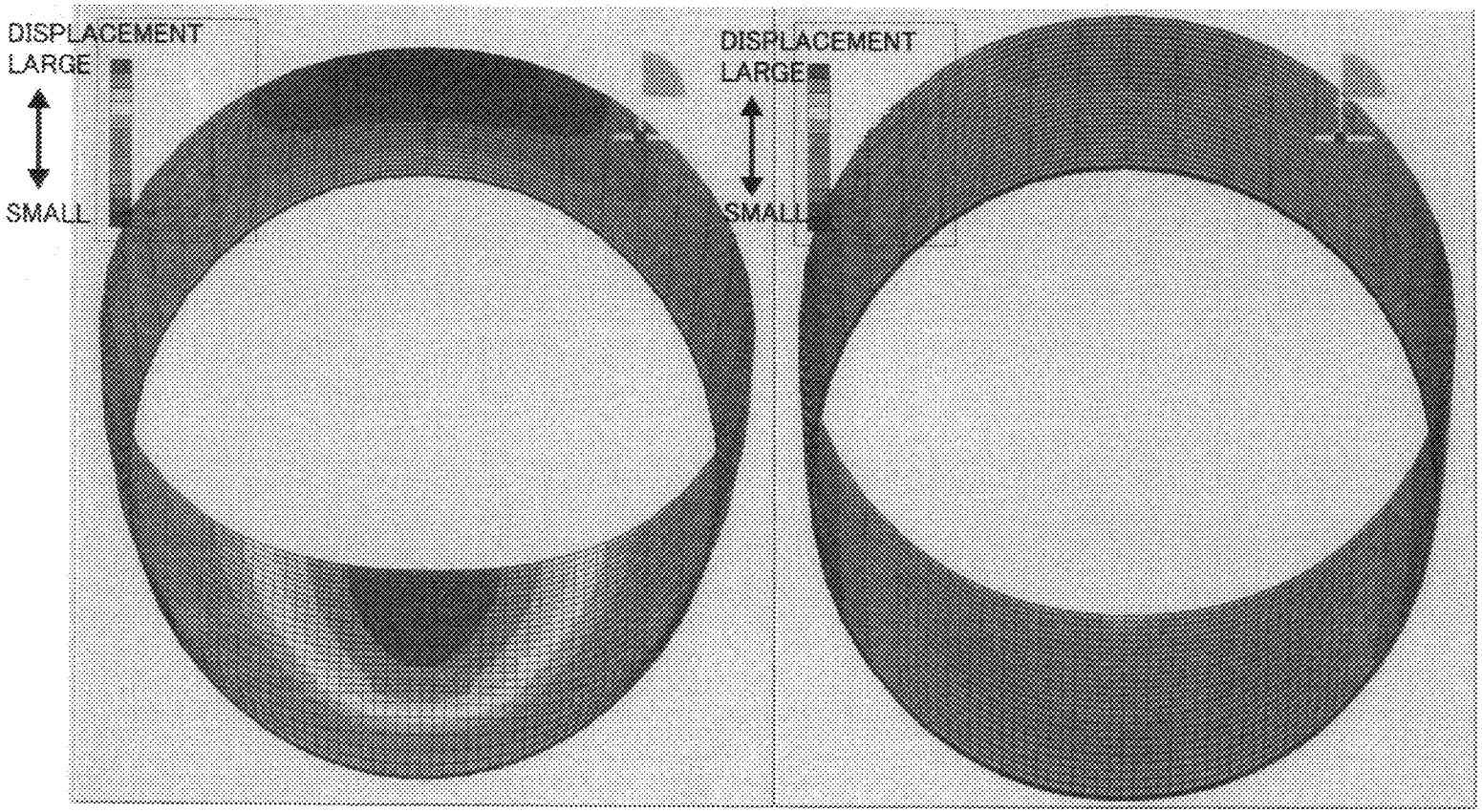
FIGS. 12A and 12B illustrate displacement distribution of a base in the experimental results as viewed from +Z and +Y side.

FIGS. 12A and 12B illustrate displacement distribution of the base 511 in the experimental results as viewed from +Z side and +Y side: FIG. 12A illustrates Example 1 and FIG. 12B illustrates Comparative example 1.

Figures 13A, 13B:
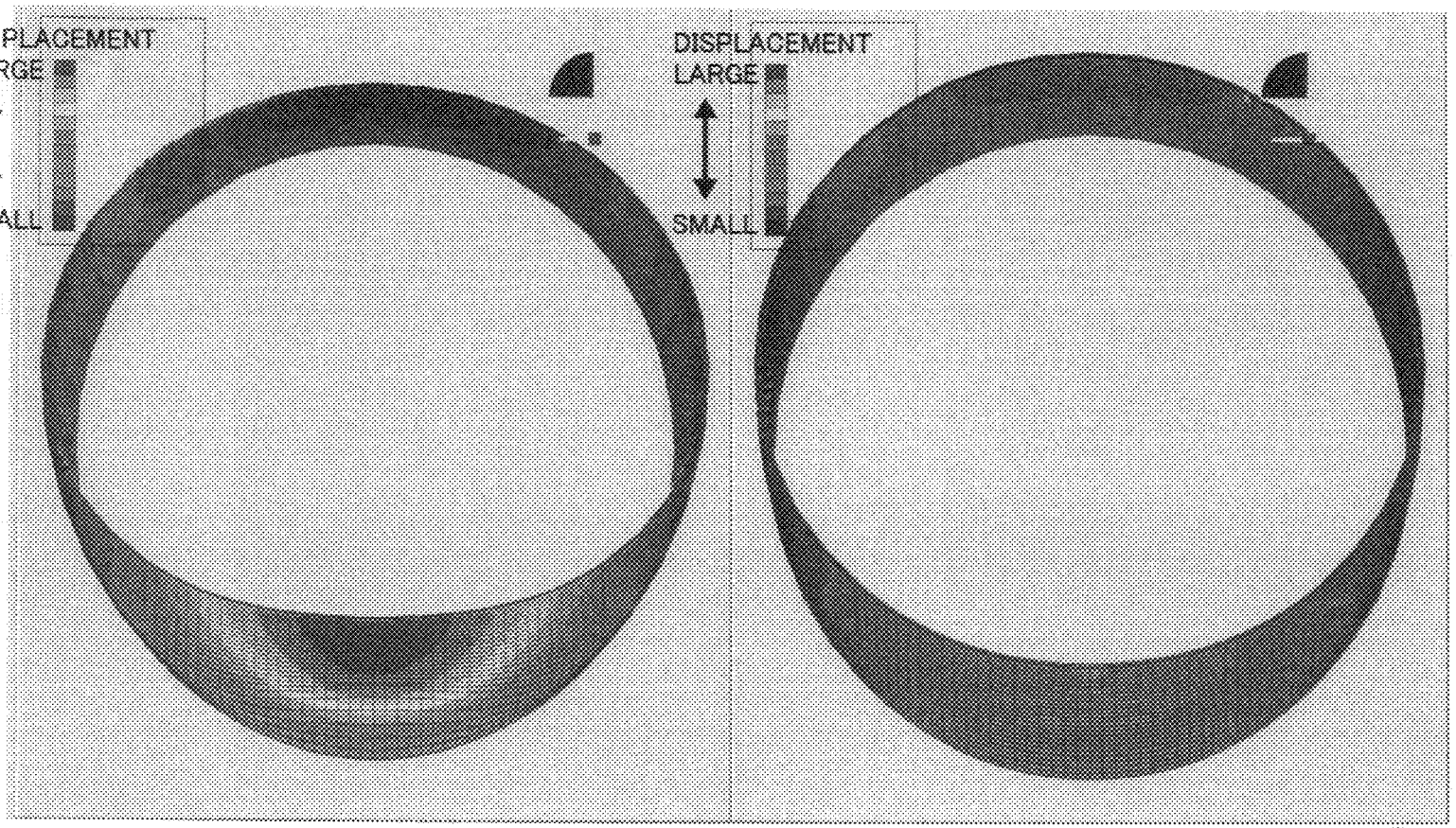
FIGS. 13A and 13B illustrate the displacement distribution of the base in the same experimental results shown in FIGS. 12A and 12B as viewed from −Z and −Y side.

FIGS. 13A and 13B illustrate displacement distribution of the base 511 in the same experimental results shown in FIGS. 12A and 12B as viewed from −Z side and −Y side: FIG. 13A illustrates Example 1 and FIG. 13B illustrates Comparative example 1.

Figures 14A, 14B:
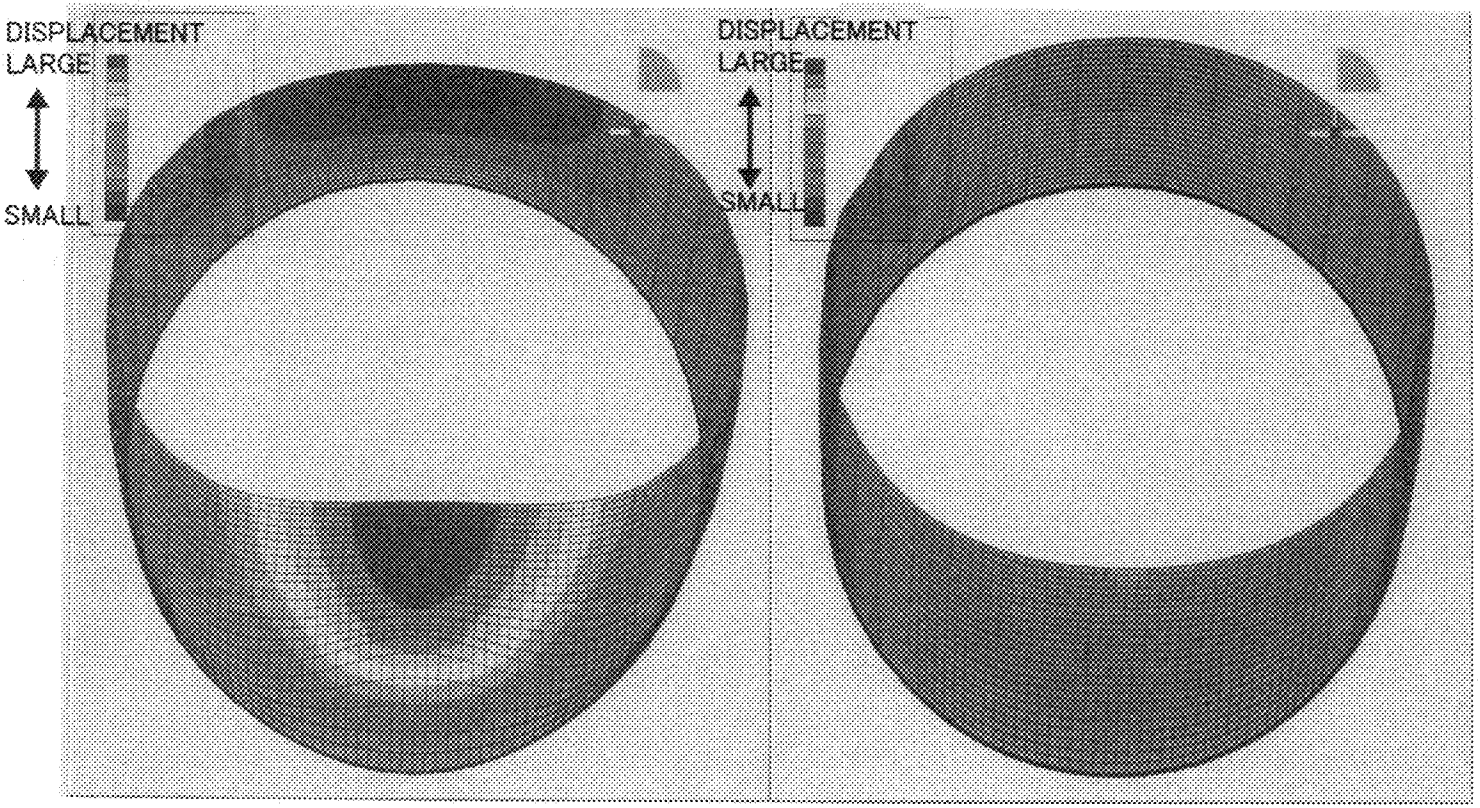
FIGS. 14A and 14B illustrate displacement distribution of the base in the same experimental results shown in FIGS. 12A and 12B, which is doubled in the Y-axis direction for emphasis.

FIGS. 14A and 14B illustrate displacement distribution of the base 511, which is doubled in the Y-axis direction for emphasis, in the same experimental results shown in FIGS. 12A and 12B: FIG. 14A illustrates Example 1 and FIG. 14B illustrates Comparative example 1.

Figures 15A, 15B:
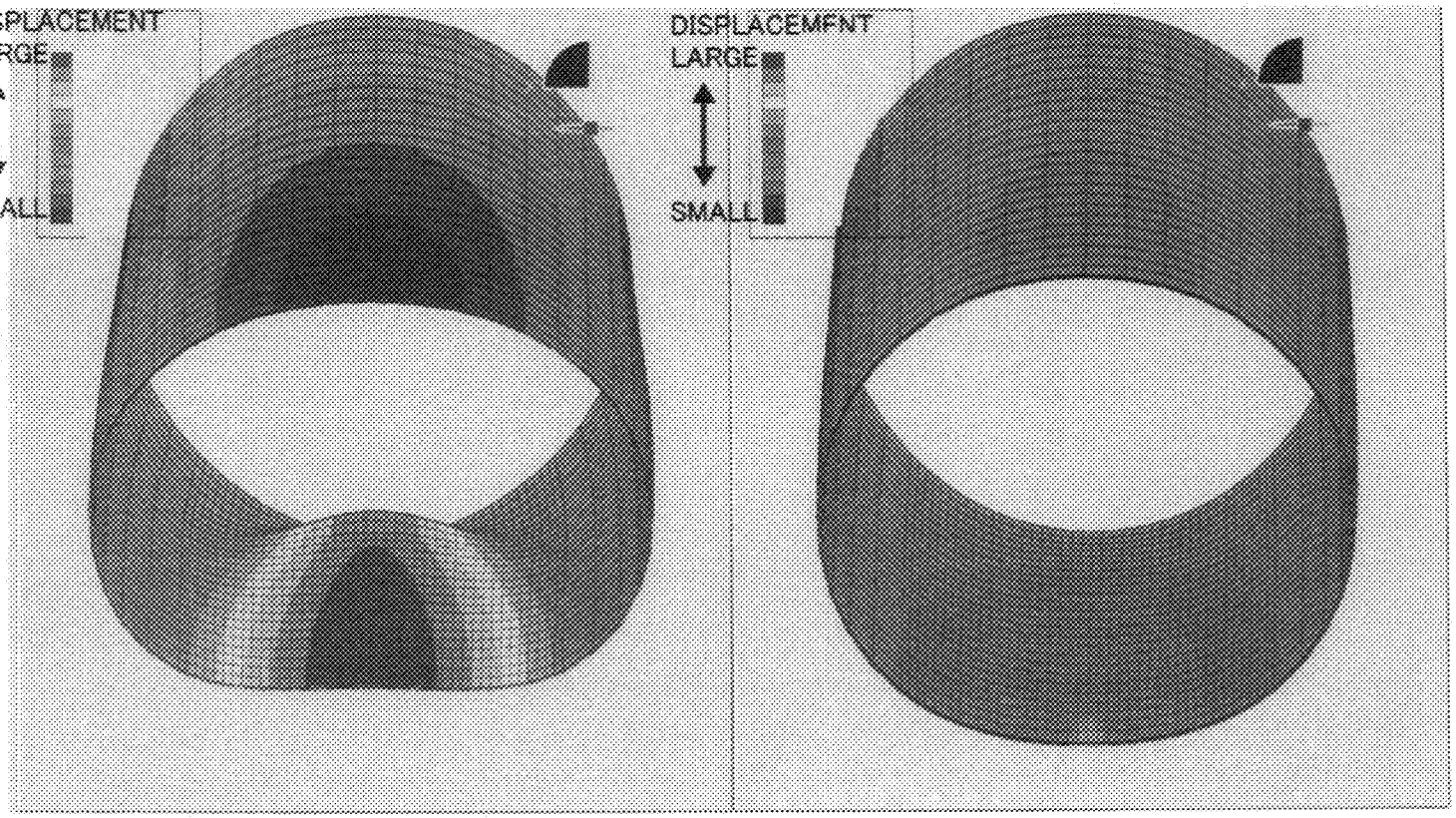
FIGS. 15A and 15B illustrate displacement distribution of the base in the same experimental results shown in FIGS. 13A and 13B, which is doubled in the Y-axis direction for emphasis.

FIGS. 15A and 15B illustrate displacement distribution of the base 511, which is doubled in the Y-axis direction for emphasis, in the same experimental results shown in FIGS. 13A and 13B: FIG. 15A illustrates Example 1 and FIG. 15B illustrates Comparative example 1.

Figure 16A:
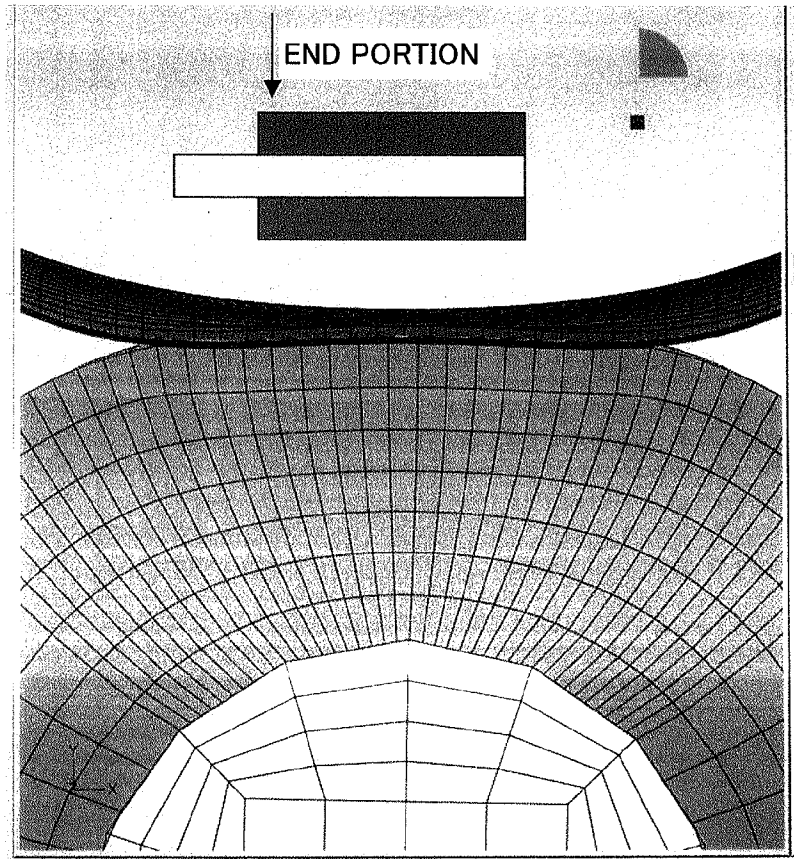
FIGS. 16A and 16B illustrate deformation state in a contact region between a heat roll and a pressure roll in the experimental results.
Figure 16B:
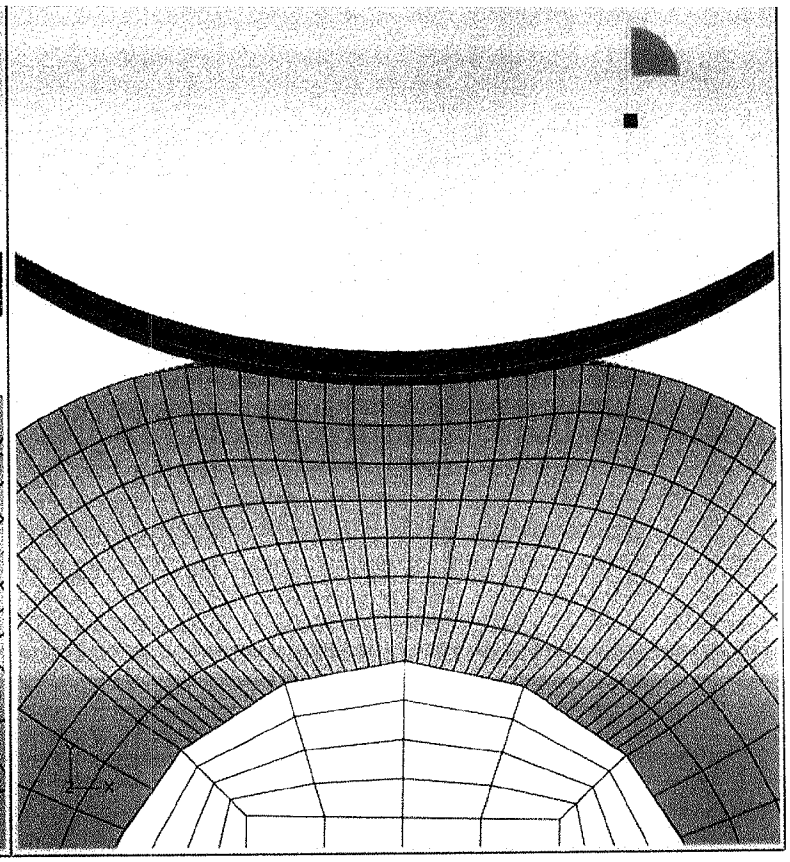

FIGS. 16A and 16B illustrate deformation state in the contact region between the heat roll 51 and the pressure roll, and are cross-sectional views at the end portion in the axis direction of the rubber layer of the pressure roll: FIG. 16A illustrates Example 1 and FIG. 16B illustrates Comparative example 1.

Figure 17A:
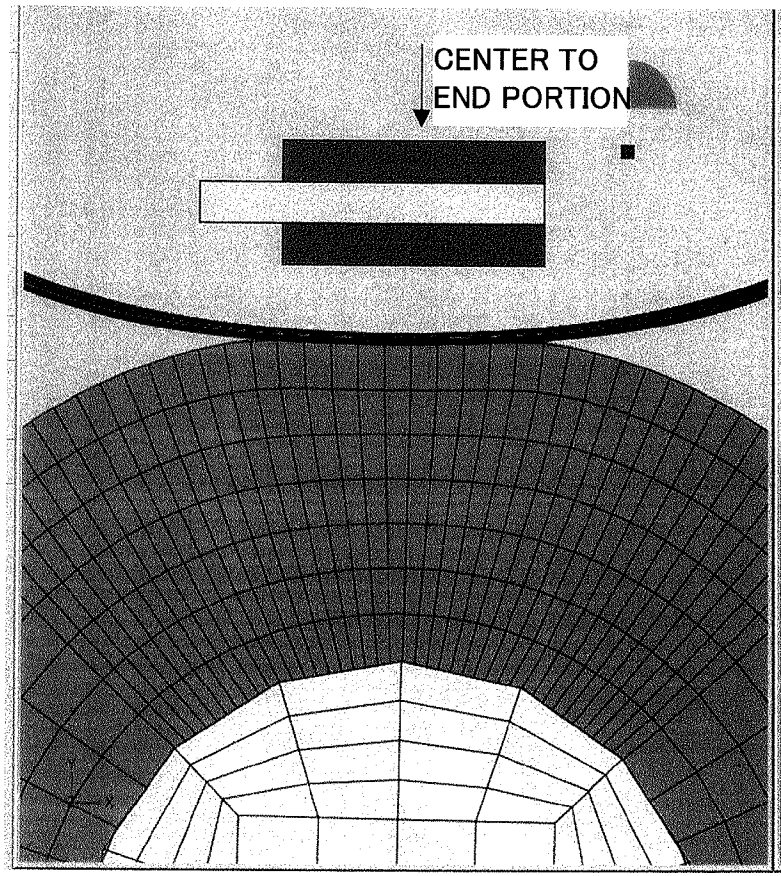
FIGS. 17A and 17B illustrate deformation state in a contact region between the heat roll and the pressure roll in the experimental results.
Figure 17B:
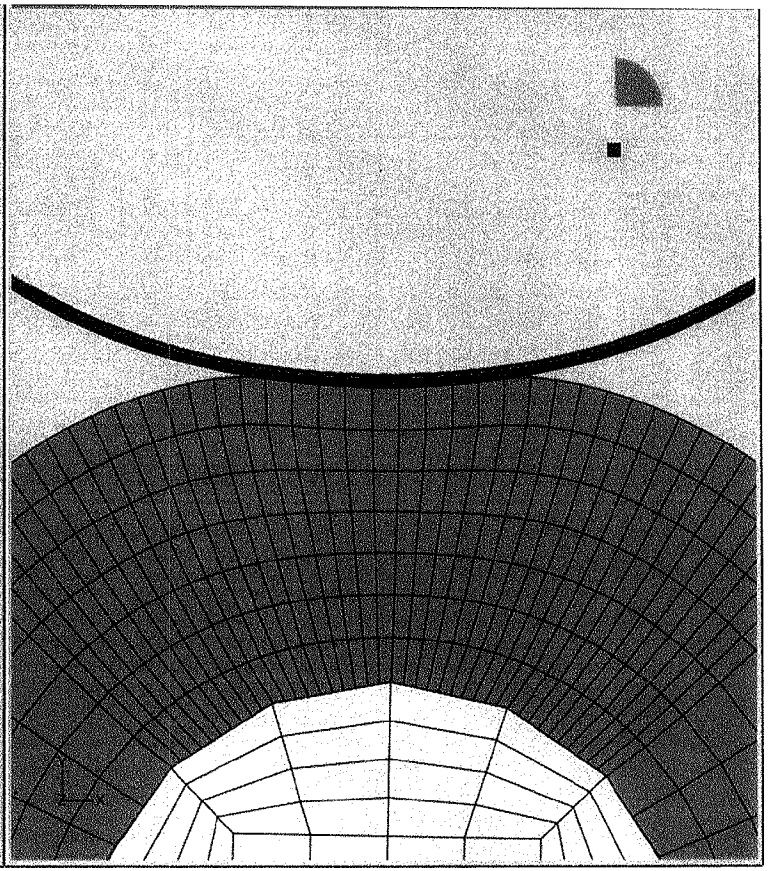

FIGS. 17A and 17B illustrate deformation state in the contact region between the heat roll 51 and the pressure roll, and are cross-sectional views at the center to the end portion in the axis direction of the rubber layer of the pressure roll: FIG. 17A illustrates Example 1 and FIG. 17B illustrates Comparative example 1.

Figure 18A:
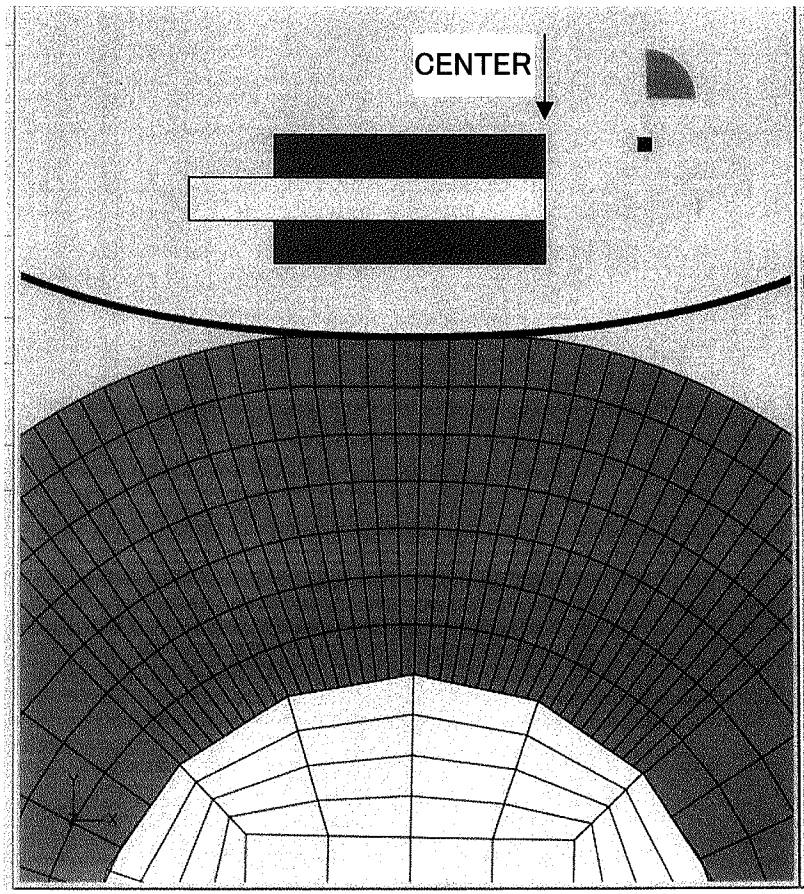
FIGS. 18A and 18B illustrate deformation state in a contact region between the heat roll and the pressure roll.
Figure 18B:
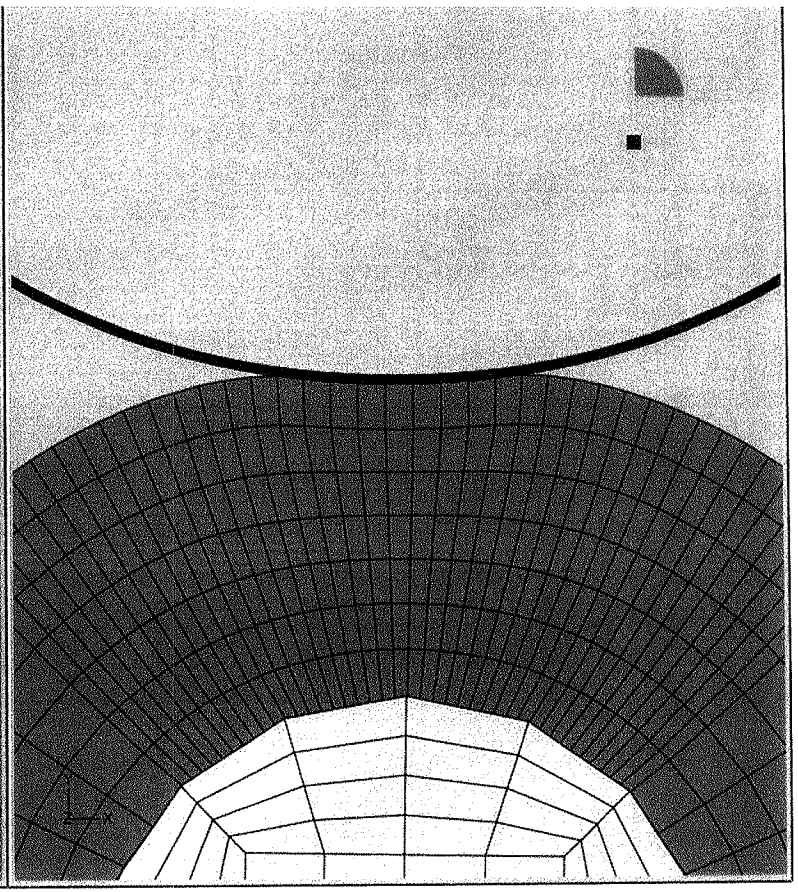

FIGS. 18A and 18B illustrate deformation state in the contact region between the heat roll 51 and the pressure roll, and are cross-sectional views at the center in the axis direction of the rubber layer of the pressure roll: FIG. 18A illustrates Example 1 and FIG. 18B illustrates Comparative example 1.

It should be noted that, in FIGS. 11A to 18B, since the experimental results are symmetric in the axis direction with respect to the center in the axis direction of the heat roll 51 and the pressure roll as a boundary, portions of the experimental results corresponding the half length in the axis direction, namely, the half-size portions of the experimental results from the center in the axis direction to the end portion in the axis direction on the +Z side, are shown in the figures, and the ranges corresponding from the center in the axis direction to the end portion in the axis direction on the −Z side are omitted.

In the present examples, the length in the axis direction of the rubber layer of the pressure roll is 200 mm, the length in the axis direction of the base 511 of the heat roll 51 is 250 mm, and the end portion in the axis direction of the rubber layer is in contact with the base 511 at a position 25 mm away from the end of the base 511. In Example 1 shown in FIG. 11A, the stress is concentrated in the end portion of the base 511 even at a portion inward in the axis direction of the base 511, whereas, in Comparative example 1 shown in FIG. 11B, it is confirmed that the stress is almost uniformly applied along the region with which the rubber layer of the pressure roll is in contact.

Further, in Comparative examples 1 shown in FIGS. 12B to 15B, deformation in the +Y direction and three-dimensional distortion of the base 511 are small, and the base 511 maintains almost cylindrical shape, whereas, in Examples 1 shown in FIGS. 12A to 15A, displacement of the base 511 in the +Y direction is increased on the side thereof that is in contact with the pressure roll upon being pressed by the pressure roll, along with a move toward the center in the axis direction, and according to the displacement, the cross-section of the base 511 is distorted from a circular shape into an elliptical shape elongated in the X-direction.

Consequently, as shown in FIG. 16B, in the conventional heat roll 51 such as shown in Comparative example 1, the base 511 is hardly deformed, thus forming the fixing region mainly by deforming the rubber layer of the pressure roll. Whereas, as shown in FIG. 16A, in Example 1, the fixing region is formed by deforming, not only the rubber layer of the pressure roll, but also the base 511 of the heat roll 51. At this time, as shown in FIGS. 16A and 16B, the fixing region is in a curved shape to be dented toward the pressure roll side in Comparative example 1, whereas in Example 1, the fixing region is substantially flat along the X-axis direction, namely, the medium transport direction.

Similarly, at the position closer to the end from the center in the axis direction as shown in FIGS. 17A and 17B or at the center portion in the axis direction as shown in FIGS. 18A and 18B, the fixing region having the shape in which mainly the rubber layer of the pressure roll is dented is formed in Comparative example 1, whereas, in Example 1, both heat roll 51 and pressure roll deform together to form the fixing region in substantially a flat shape.

Second Exemplary Embodiment

The second exemplary embodiment is characterized in that the gear 531 and the torsion coil spring 532 are not unitized. Hereinafter, description will be given with regard to the difference between the second exemplary embodiment and the first exemplary embodiment. The same components are denoted by the same reference numerals, and the detailed description thereof will be omitted.

Figure 20:
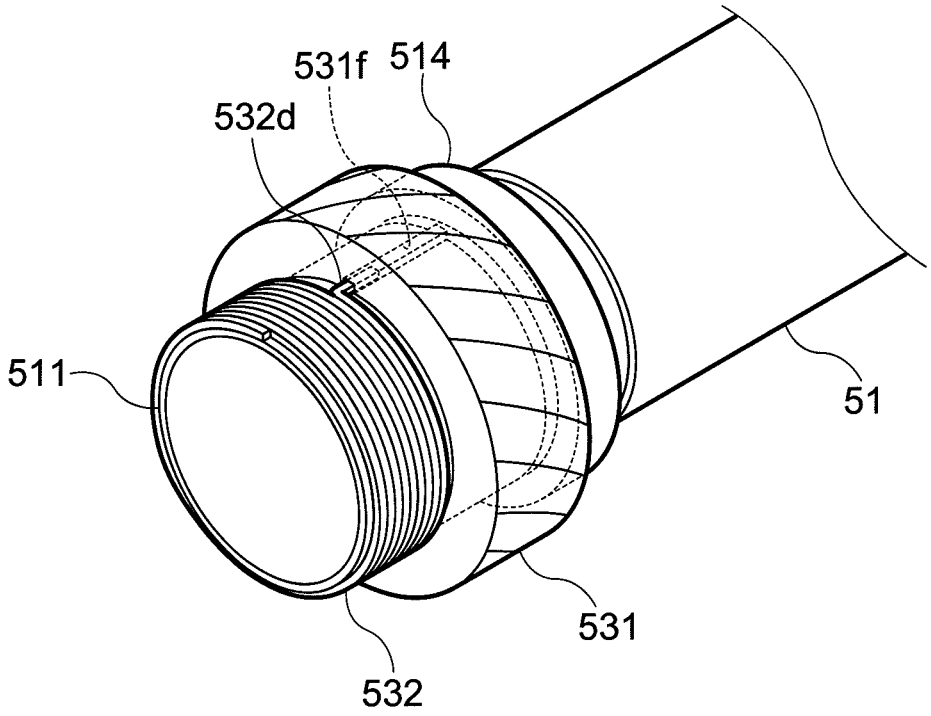
FIG. 20 is a perspective view illustrating a gear and a torsion coil spring according to a second exemplary embodiment.

FIG. 20 is a perspective view that illustrates the gear 531 and the torsion coil spring 532 according to the second exemplary embodiment.

As shown in FIG. 20, the gear 531 according to the second exemplary embodiment is substantially a cylindrical member on a circumferential portion of which the helical teeth 531*a* are formed. On the inner circumferential surface of the gear 531, a radius direction concave portion 531*f*, which is recessed toward the outside in the rotational radius direction from the inner circumferential surface and is slightly larger than the wire diameter of the torsion coil spring 532 in the circumferential direction, is formed over the entire rotation axis direction. Further, the cylindrical gear 531 is formed such that the inner diameter thereof is larger than the outer diameter of the base 511 of the heat roll 51. That is, the gear 531 is fitted into the base 511 of the heat roll 51 with a loose fit.

The torsion coil spring 532 according to the second exemplary embodiment is different from the torsion coil spring 532 according to the first exemplary embodiment in an orientation of the projection portion 532*b* formed on one end portion in the rotation axis direction. In other words, on the one end portion of the torsion coil spring 532 according to the second exemplary embodiment, a projection portion 532*d* that projects outward in the rotation axis direction from the coil portion 532*a* is provided.

When the gear 531 and the torsion coil spring 532 are mounted to the heat roll 51, first, the gear 531 is fitted into the base 511 of the heat roll 51. Thereafter, the torsion coil spring 532 is mounted to the base 511 while being rotated in the clockwise direction as viewed in FIG. 20. At that time, the projection portion 532*d* of the torsion coil spring 532 is inserted into the radius direction concave portion 531*f* of the gear 531. It should be noted that a dimensional relationship between the projection portion 532*d* of the torsion coil spring 532 and the radius direction concave portion 531*f* of the gear 531 may be the dimensional relationship that allows the loose fit or the dimensional relationship that allows the interference fit.

Even though the gear 531 and the torsion coil spring 532 are configured as described above, the gear 531 and the torsion coil spring 532 are mounted to the heat roll 51 and function as the rotation unit that rotates upon receiving the rotational driving force from the drive motor 91. Then, in the case where the controller 90 rotates the drive motor 91 in the clockwise direction as viewed in FIG. 1 for performing the fixing operation in the fixing device 50, the torsion coil spring 532 receives the force from the gear 531 and is deformed so that the inner diameter of the coil portion 532*a* is reduced, and the heat roll 51 is also rotated in the clockwise direction. The endless belt 52 is also rotated to follow the rotation of the heat roll 51. Consequently, when the sheet onto which the toner image is transferred passes though the nip portion N, the toner image on the sheet is fixed by the pressure applied to the nip portion N and the heat supplied from the heat roll 51. On the contrary, in the case where the controller 90 rotates the drive motor 91 in the counterclockwise direction as viewed in FIG. 1 for reversing the sheet subjected to fixing in the fixing device 50 and transporting the sheet toward the secondary transfer position again, the torsion coil spring 532 is deformed so that the inner diameter of the coil portion 532*a* is increased, and thereby the heat roll 51 is not rotated. Accordingly, the endless belt 52 is not rotated, too.

In this manner, also in the fixing device 50 according to this exemplary embodiment, due to the deformation of the gear 531, such that the inner diameter of the coil portion 532*a* of the torsion coil spring 532 is reduced, upon receiving the rotational driving force from the drive motor 91, the heat roll 51 is rotated by the frictional force generated between the torsion coil spring 532 and the base 511 of the heat roll 51, and accordingly, the strength of the heat roll 51 itself may be low. Therefore, the thickness of the base 511 may be thin compared to the configuration in which the rotational driving force is transmitted through the cutout formed in the base 511. If the thickness of the base 511 of the heat roll 51 is thin, the heat capacity of the heat roll 51 is reduced, thus reaching the above-described fixing temperature earlier.

Compared to the configuration in which support members, which have higher strength than the base 511 and support the base 511, are connected to both end portions of the base 511 in the rotation axis direction, and the rotational driving force from the drive motor 91 is transmitted through the cutouts formed in the support members, the fixing device 50 according to this exemplary embodiment has a smaller component count and simplified configuration; besides, since the heat capacity is reduced for the support members, the fixing temperature is reached earlier. Further, when the fixing process is unnecessary, for example, in the case where the drive motor 91 is rotated in the counterclockwise direction to reverse, through the reverse transport unit 82, the sheet on a single surface of which the image has been fixed by the fixing device 50, the heat roll 51 and the endless belt 52 are not rotated. Accordingly, deterioration of the heat roll 51 and the endless belt 52 is suppressed compared to the configuration in which the heat roll 51 and the endless belt 52 are rotated. Moreover, in the event of a sheet jam or the like in the fixing device 50, a load to pull the sheet by the user in the sheet transport direction is reduced.

Third Exemplary Embodiment

In the second exemplary embodiment, the rotational force of the gear 531 is transmitted to the torsion coil spring 532 via the radius direction concave portion 531*f* of the gear 531 and the projection portion 532*d* of the torsion coil spring 532, whereas, the third exemplary embodiment is characterized in that the rotational force of the gear 531 is transmitted to the torsion coil spring 532 by the frictional force generated between the gear 531 and the torsion coil spring 532. Hereinafter, description will be given with regard to the difference between the third exemplary embodiment and the second exemplary embodiment. The same components are denoted by the same reference numerals, and the detailed description thereof will be omitted.

Figure 21B:
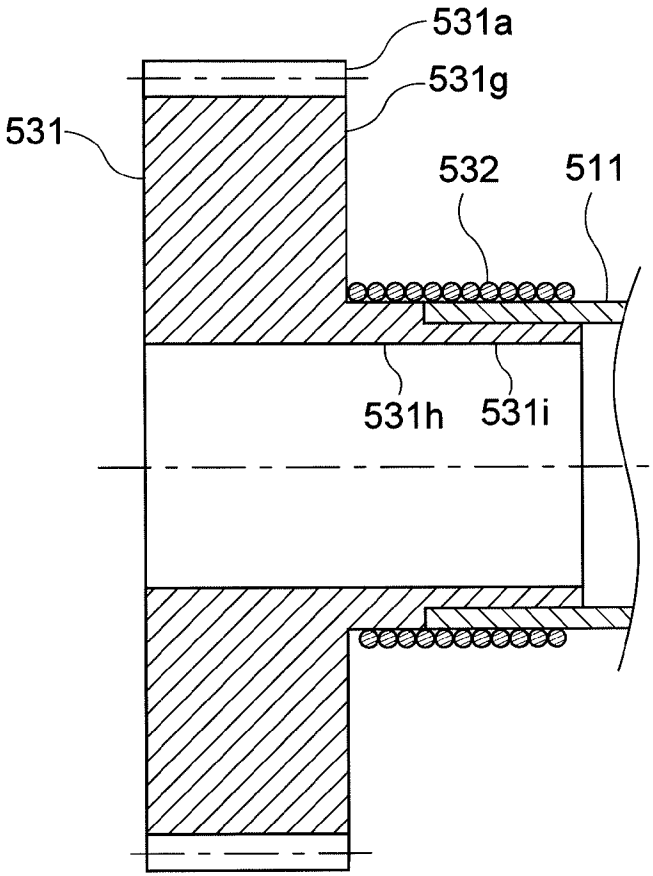
FIG. 21B is a cross-sectional view thereof.
Figure 21A:
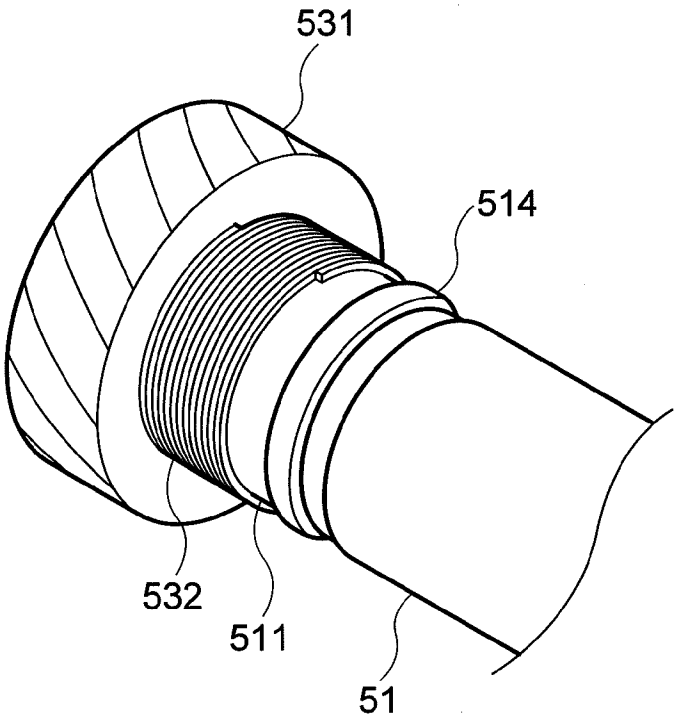
FIG. 21A is a perspective view illustrating a gear and a torsion coil spring according to a third exemplary embodiment.

FIG. 21A is a perspective view illustrating the gear 531 and the torsion coil spring 532 according to the third exemplary embodiment, and FIG. 21B is a cross-sectional view thereof.

As shown in FIGS. 21A and 21B, the gear 531 according to the third exemplary embodiment is fitted into the end portion in the rotation axis direction of the base 511 of the heat roll 51, and the torsion coil spring 532 fitted over both of the base 511 of the heat roll 51 and the outer circumferential surface of the gear 531.

More specifically, the gear 531 according to the third exemplary embodiment is a member made by combining a cylindrical body coaxially in the rotation axis direction with a cylindrical portion on the outer circumferential portion of which the helical teeth 531*a* are formed, the inner diameter of the cylindrical body being substantially the same as that of the cylindrical portion, whereas the outer diameter of the cylindrical body being different from that of the cylindrical portion. That is, the gear 531 includes: a first cylindrical portion 531*g* that is a cylindrical portion on the outer circumferential portion of which the helical teeth 531*a* are formed; a second cylindrical portion 531*h* that is formed continuously to the first cylindrical portion 531*g*, and has an outer diameter formed substantially the same as the inner diameter of the base 511 of the heat roll 51; and a third cylindrical portion 531*i* that is formed continuously to the second cylindrical portion 531*h*, and has an outer diameter formed smaller than the inner diameter of the base 511 of the heat roll 51. The third cylindrical portion 531*i* is fitted inside the base 511 of the heat roll 51 by a loose fit. The gear 531 is rotatable with respect to the heat roll 51 and the heat roll 51 is rotatable with respect to the gear 531.

The torsion coil spring 532 according to the third exemplary embodiment is different from the torsion coil spring 532 according to the first exemplary embodiment in the following points: the projection portion 532*b* on one end portion in the rotation axis direction is not provided; and the coil portion 532*a* is made from more turns than that of the torsion coil spring 532, which is coiled clockwise. That is, movement of the torsion coil spring 532 with respect to the gear 531 is suppressed by the frictional force generated between the inner surface of the torsion coil spring 532 and the outer circumferential surface of the second cylindrical portion 531*h* of the gear 531 according to the third exemplary embodiment. Further, the torsion coil spring 532 is not only fitted over the base 511 of the heat roll 51, but also fitted over the gear 531; and therefore the turns of the torsion coil spring 532 according to the third exemplary embodiment, which is 13, is set larger than that of the torsion coil spring 532 according to the first exemplary embodiment.

Even though the gear 531 and the torsion coil spring 532 according to the third exemplary embodiment are configured as described above, the gear 531 and the torsion coil spring 532 are mounted to the heat roll 51 and function as the rotation unit that rotates upon receiving the rotational driving force from the drive motor 91. Then, in the case where the controller 90 rotates the drive motor 91 in the clockwise direction as viewed in FIG. 1 for performing the fixing operation in the fixing device 50, the torsion coil spring 532 is deformed by the frictional force generated between the torsion coil spring 532 and the outer periphery of the first cylindrical portion 531*g* of the gear 531 so that the inner diameter of the coil portion 532*a* is reduced, and the torsion coil spring 532 is rotated together with the gear 531. The heat roll 51 is also rotated in the clockwise direction by the frictional force generated between the coil portion 532*a* and the base 511 of the heat roll 51. The endless belt 52 is also rotated to follow the rotation of the heat roll 51. Consequently, when the sheet onto which the toner image is transferred passes though the nip portion N, the toner image on the sheet is fixed by the pressure applied to the nip portion N and the heat supplied from the heat roll 51. On the contrary, in the case where the controller 90 rotates the drive motor 91 in the counterclockwise direction as viewed in FIG. 1 for reversing the sheet subjected to fixing in the fixing device 50 and transporting the sheet toward the secondary transfer position again, the torsion coil spring 532 is deformed so that the inner diameter of the coil portion 532*a* is increased, and thereby the heat roll 51 is not rotated. Accordingly, the endless belt 52 is not rotated, too.

In this manner, also in the fixing device 50 according to this exemplary embodiment, due to the deformation of the gear 531, such that the inner diameter of the coil portion 532*a* of the torsion coil spring 532 is reduced, upon receiving the rotational driving force from the drive motor 91, the heat roll 51 is rotated by the frictional force generated between the torsion coil spring 532 and the base 511 of the heat roll 51, and accordingly, the strength of the heat roll 51 itself may be low. Therefore, the thickness of the base 511 may be thin compared to the configuration in which the rotational driving force is transmitted through the cutout formed in the base 511. If the thickness of the base 511 of the heat roll 51 is thin, the heat capacity of the heat roll 51 is reduced, thus reaching the above-described fixing temperature earlier.

Compared to the configuration in which support members, which have higher strength than the base 511 and support the base 511, are connected to both end portions of the base 511 in the rotation axis direction, and the rotational driving force from the drive motor 91 is transmitted through the cutouts formed in the support members, the fixing device 50 according to this exemplary embodiment has a smaller component count and simplified configuration; besides, since the heat capacity is reduced for the support members, the fixing temperature is reached earlier. Further, when the fixing process is unnecessary, for example, in the case where the drive motor 91 is rotated in the counterclockwise direction to reverse, through the reverse transport unit 82, the sheet on a single surface of which the image has been fixed by the fixing device 50, the heat roll 51 and the endless belt 52 are not rotated. Accordingly, deterioration of the heat roll 51 and the endless belt 52 is suppressed compared to the configuration in which the heat roll 51 and the endless belt 52 are rotated. Moreover, in the event of a sheet jam or the like in the fixing device 50, a load to pull the sheet by the user in the sheet transport direction is reduced.

Further, since the torsion coil spring 532 according to the third exemplary embodiment is configured only with the coil portion 532*a*, productivity of the torsion coil spring 532 itself is increased, and since there is no directional property for attaching the torsion coil spring 532, that is, since the torsion coil spring 532 may be mounted from either end portion of the heat roll 51, assembling property is improved.

Fourth Exemplary Embodiment

In the second exemplary embodiment, the gear 531 and the torsion coil spring 532 are arranged side by side in the rotational axis direction, whereas, the fourth exemplary embodiment is characterized in that the torsion coil spring 532 is arranged inside the gear 531 and also inside the base 511 of the heat roll 51. Hereinafter, description will be given with regard to the difference between the fourth exemplary embodiment and the second exemplary embodiment. The same components are denoted by the same reference numerals, and the detailed description thereof will be omitted.

Figure 22B:
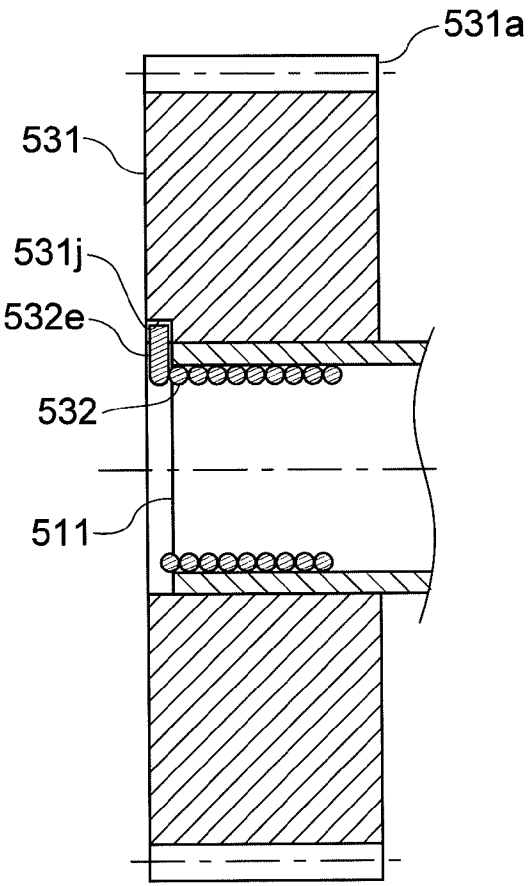
FIG. 22B is a cross-sectional view thereof.
Figure 22A:
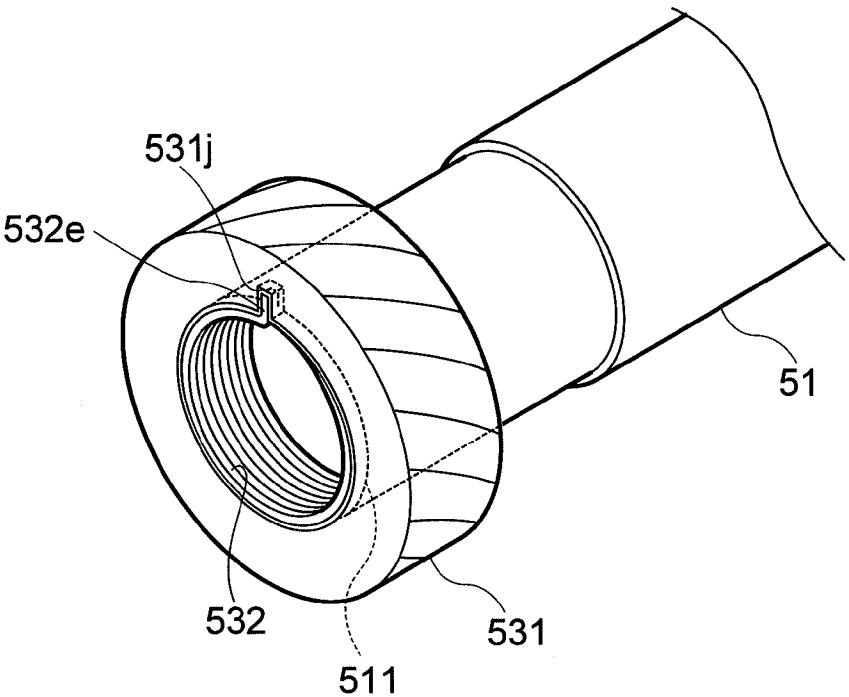
FIG. 22A is a perspective view illustrating a gear and a torsion coil spring according to a fourth exemplary embodiment.

FIG. 22A is a perspective view illustrating the gear 531 and the torsion coil spring 532 according to the fourth exemplary embodiment, and FIG. 22B is a cross-sectional view thereof.

The gear 531 according to the fourth exemplary embodiment is different from the torsion coil spring 532 according to the second exemplary embodiment in the following point: that is, in the gear 531 in the second exemplary embodiment, the radius direction concave portion 531*f*, which is recessed toward the outside in the rotational radius direction from the inner circumferential surface, is formed in the inner circumferential surface of the gear 531 over the entire rotation axis direction, whereas in the gear 531 according to the fourth exemplary embodiment, a radius direction concave portion 531*j*, which is recessed toward the outside in the rotational radius direction from the inner circumferential surface, is formed only in a part of an end portion side in the rotation axis direction.

The torsion coil spring 532 according to the fourth exemplary embodiment is different from the torsion coil spring 532 according to the second exemplary embodiment in the following point: in the torsion coil spring 532 according to the second exemplary embodiment, the projection portion 532*d* is formed on one end portion in the rotation axis direction, whereas, on the other end portion in the rotation axis direction of the torsion coil spring 532 according to the fourth exemplary embodiment, a projection portion 532*e* is formed to project toward outside in the rotation radius direction from the coil portion 532*a*. The projection portion 532*e* is inserted into the radius direction concave portion 531*i* of the gear 531, thereby transmitting the rotational driving force from the gear 531 to the torsion coil spring 532 through the projection portion 532*e* and the radius direction concave portion 531*j*.

Further, the torsion coil spring 532 according to the fourth exemplary embodiment is formed as follows so that the torsion coil spring 532 is fitted into the inside of the base 511 of the heat roll 51, and the heat roll 51 is rotational driven by the frictional force generated between the outer periphery of the torsion coil spring 532 and the inner circumferential surface of the base 511 of the heat roll 51. That is, since the torsion coil spring 532 according to the fourth exemplary embodiment is fitted inside the base 511 of the heat roll 51, the shape of the torsion coil spring 532 is set such that, due to deformation of the torsion coil spring 532 upon receiving the force from the gear 531, the outer diameter of the coil portion 532*a* is increased compared to the outer diameter before the deformation, and the frictional force generated between the torsion coil spring 532 and the inner circumferential surface of the base 511 of the heat roll 51 is increased. More specifically, the outer diameter of the coil portion 532*a* of the torsion coil spring 532 according to the fourth exemplary embodiment is formed larger than the inner diameter of the base 511 of the heat roll 51 so as to be fitted into the base 511 of the heat roll 51 by the interference fit. Further, the shape of the torsion coil spring 532 is set such that, due to deformation of the torsion coil spring 532 upon receiving the force from the gear 531, the frictional force generated between the torsion coil spring 532 and the base 511 of the heat roll 51 becomes larger than the above-described required frictional force. For example, the material of the torsion coil spring 532 may be exemplified by the SUS material having a wire diameter of ø0.9 and the number of coil turns may be exemplified by 9.

Even though the gear 531 and the torsion coil spring 532 according to the fourth exemplary embodiment are configured as described above, the gear 531 and the torsion coil spring 532 are mounted to the heat roll 51 and function as the rotation unit that rotates upon receiving the rotational driving force from the drive motor 91. Then, in the case where the controller 90 rotates the drive motor 91 in the clockwise direction as viewed in FIG. 1 for performing the fixing operation in the fixing device 50, the torsion coil spring 532 is deformed so that the outer diameter of the coil portion 532*a* is increased upon receiving the force from the gear 531, and the heat roll 51 is rotated in the clockwise direction. The endless belt 52 is also rotated to follow the rotation of the heat roll 51. Consequently, when the sheet onto which the toner image is transferred passes though the nip portion N, the toner image on the sheet is fixed by the pressure applied to the nip portion N and the heat supplied from the heat roll 51. On the contrary, in the case where the controller 90 rotates the drive motor 91 in the counterclockwise direction as viewed in FIG. 1 for reversing the sheet subjected to fixing in the fixing device 50 and transporting the sheet toward the secondary transfer position again, the torsion coil spring 532 is deformed so that the outer diameter of the coil portion 532*a* is reduced, and thereby the heat roll 51 is not rotated. Accordingly, the endless belt 52 is not rotated, too.

In this manner, also in the fixing device 50 according to this exemplary embodiment, due to the deformation of the gear 531, such that the outer diameter of the coil portion 532*a* of the torsion coil spring 532 is increased, upon receiving the rotational driving force from the drive motor 91, the heat roll 51 is rotated by the frictional force generated between the torsion coil spring 532 and the base 511 of the heat roll 51, and accordingly, the strength of the heat roll 51 itself may be low. Therefore, the thickness of the base 511 may be thin compared to the configuration in which the rotational driving force is transmitted through the cutout formed in the base 511. If the thickness of the base 511 of the heat roll 51 is thin, the heat capacity of the heat roll 51 is reduced, thus reaching the above-described fixing temperature earlier.

Compared to the configuration in which support members, which have higher strength than the base 511 and support the base 511, are connected to both end portions of the base 511 in the rotation axis direction, and the rotational driving force from the drive motor 91 is transmitted through the cutouts formed in the support members, the fixing device 50 according to this exemplary embodiment has a smaller component count and simplified configuration; besides, since the heat capacity is reduced for the support members, the fixing temperature is reached earlier. Further, when the fixing process is unnecessary, for example, in the case where the drive motor 91 is rotated in the counterclockwise direction to reverse, through the reverse transport unit 82, the sheet on a single surface of which the image has been fixed by the fixing device 50, the heat roll 51 and the endless belt 52 are not rotated. Accordingly, deterioration of the heat roll 51 and the endless belt 52 is suppressed compared to the configuration in which the heat roll 51 and the endless belt 52 are rotated. Moreover, in the event of a sheet jam or the like in the fixing device 50, a load to pull the sheet by the user in the sheet transport direction is reduced.

It should be noted that, in the torsion coil spring 532 according to the above-described fourth exemplary embodiment, the material of the torsion coil spring 532 may be set as a material having a larger coefficient of linear expansion than that of nickel, which is a material of the base 511, for example, SUS 304, and the shape of the torsion coil spring 532 may be set so that the frictional force between the torsion coil spring 532 and the base 511, which is generated by deformation of the torsion coil spring 532 upon receiving the force from the gear 531, becomes larger than the required frictional force at a temperature higher than the fixing temperature for performing the fixing operation.

In other words, in consideration of a difference between the coefficient of linear expansion of the material of the torsion coil spring 532 and the coefficient of linear expansion of the material of the base 511 of the heat roll 51, the shape of the torsion coil spring is set so that the frictional force between the torsion coil spring 532 and the base 511 generated due to deformation of the torsion coil spring 532 upon receiving the force from the gear 531 may be smaller than the required frictional force at a temperature lower than the fixing temperature, or may be equal to or larger than the required frictional force at a temperature equal to or higher than the fixing temperature.

By setting the specifications of the torsion coil spring 532 like this, at a temperature equal to or higher than the fixing temperature for the fixing operation, the heat roll 51 is rotated in response to the rotation of the gear 531, and thereby the fixing is performed. On the other hand, at a temperature lower than the fixing temperature, the heat roll 51 is not rotated even though the gear 531 is rotated.

Here, since the image forming apparatus 1 according to the first to fourth exemplary embodiments includes four image forming units 11Y, 11M, 11C and 11K, an image is once formed on the intermediate transfer belt 31 for adjusting the density of each color in a stage immediately after the power is turned on and the temperature is less than the above-described fixing temperature, and a measurement process is performed for measuring the color density of the image. The measurement process is started simultaneously with or before the start of heating the fixing device 50 for reducing the warm-up time of the image forming apparatus 1, and is performed in parallel with the heating of the fixing device 50. Further, in the image forming apparatus 1 according to the first to fourth exemplary embodiments, a driving source for driving the four image forming units 11Y, 11M, 11C, 11K and the intermediate transfer belt 31 is the drive motor 91, which is the same driving source for rotationally driving the heat roll 51 of the fixing device 50, for space savings. Accordingly, if the drive motor 91 is driven for the measurement process performed in a stage immediately after the power is turned on and the temperature does not reach the above-described fixing temperature, the gear 531 of the fixing device 50 is also rotated.

Against this, by setting the specifications of the torsion coil spring 532 so that the frictional force generated between the torsion coil spring 532 and the base 511 due to the deformation of the torsion coil spring 532 upon receiving the force from the gear 531 is less than the required frictional force at a temperature lower than the fixing temperature, and is equal to or more than the required frictional force at a temperature equal to or more than the fixing temperature, though the drive motor 91 is driven for carrying out the measurement process in the stage in which the temperature does not reach the fixing temperature, the heat roll 51 is not rotated. Accordingly, the endless belt 52 is not rotated, too. Consequently, a lubricant of high viscosity is supplied from the lubricant applying member 58 to the drive motor 91 at a low temperature time immediately after the power is turned on while the temperature is less than the above-described fixing temperature, and therefore driving torque for rotating the endless belt 52 against a frictional force generated between the inner circumferential surface of the endless belt 52 and the low frictional sheet 56, which is larger than the frictional force when the temperature reaches the fixing temperature, is not required. Moreover, deterioration of the heat roll 51, the endless belt 52, the low frictional sheet 56 and the like, which are apt to occur when the heat roll 51 and the endless belt 52 are rotated at a low temperature time in which the temperature does not reach the fixing temperature, is suppressed.

Fifth Exemplary Embodiment

The fifth exemplary embodiment is characterized in that the heat roll is rotated by the frictional force generated between the inner circumferential surface of the cylindrical gear 531, on the circumferential portion of which the helical teeth 531*a* are formed, and the outer circumferential surface of the base 511 of the heat roll 51. Hereinafter, description will be given with regard to the difference between the fifth exemplary embodiment and the first exemplary embodiment. The same components are denoted by the same reference numerals, and the detailed description thereof will be omitted.

Figure 23:
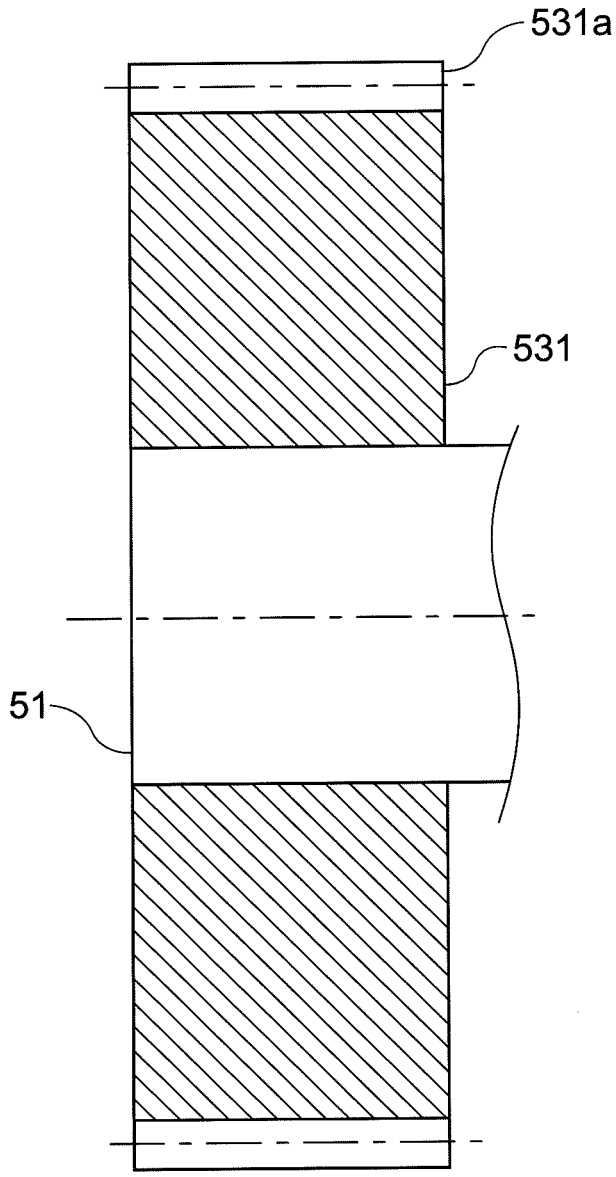
FIG. 23 is a cross-sectional view illustrating a gear and a heat roll according to a fifth exemplary embodiment.

FIG. 23 is a cross-sectional view illustrating the gear 531 and the heat roll 51 according to the fifth exemplary embodiment.

The gear 531 according to the fifth exemplary embodiment is, as shown in FIG. 23, substantially the cylindrical member and the helical teeth 531*a* are formed on the outer circumferential portion thereof. The size of the inner diameter of the inner circumferential surface of the gear 531 is determined as follows. The inner diameter is set so that, due to the elastic deformation of the heat roll 51 caused by the press from the pressure pad 54 via the endless belt 52, the frictional force generated between the gear 531 and the base 511 becomes larger than the above-described required frictional force in the temperature region equal to or higher than the above-described fixing temperature. In other words, the size of the inner diameter of the inner circumferential surface of the gear 531 is set so that the frictional force generated between the inner circumferential surface of the gear 531 and the outer circumferential surface of the of the base 511 of the heat roll 51 is smaller than the required frictional force before the heat roll 51 is pressed by the pressure pad 54 via the endless belt 52, and the frictional force becomes equal to or larger than the required frictional force in the temperature region equal to or higher than the fixing temperature due to the deformation caused by the press from the pressure pad 54. It should be noted that, as long as the frictional force generated between the inner circumferential surface of the gear 531 and the outer circumferential surface of the base 511 becomes equal to or larger than the required frictional force in the temperature region equal to or higher than the fixing temperature due to the deformation of the heat roll 51 caused by the press from the pressure pad 54, for example, before the heat roll 51 is pressed by the pressure pad 54 via the endless belt 52, the inner diameter of the inner circumferential surface of the gear 531 may be larger or smaller than the outer diameter of the outer circumferential surface of the base 511.

Even though the gear 531 and the heat roll 51 according to the fifth exemplary embodiment are configured as described above, the gear 531 is mounted to the heat roll 51 and functions as the rotation unit that rotates upon receiving the rotational driving force from the drive motor 91. Then, in the case where the controller 90 rotates the drive motor 91 in the clockwise direction as viewed in FIG. 1 for performing the fixing operation in the fixing device 50, the heat roll 51 is deformed due to the pressure applied by the pressure pad 54 via the endless belt 52, and thereby the heat roll 51 is also rotated in the clockwise direction by the frictional force generated between the inner circumferential surface of the gear 531 and the outer circumferential surface of the base 511. The endless belt 52 is also rotated to follow the rotation of the heat roll 51. Consequently, when the sheet onto which the toner image is transferred passes though the nip portion N, the toner image on the sheet is fixed by the pressure applied to the nip portion N and the heat supplied from the heat roll 51.

In this manner, in the fixing device 50 according to this exemplary embodiment, due to the deformation of the heat roll 51 caused by the pressure from the pressure pad 54 via the endless belt 52, the heat roll 51 is rotated by the frictional force generated between the inner circumferential surface of the gear 531 and the base 511 of the heat roll 51, and accordingly, the strength of the heat roll 51 itself may be low. Therefore, the thickness of the base 511 may be thin compared to the configuration in which the rotational driving force is transmitted through the cutout formed in the base 511. If the thickness of the base 511 of the heat roll 51 is thin, the heat capacity of the heat roll 51 is reduced, thus reaching the above-described fixing temperature earlier. Further, compared to the configuration in which support members, which have higher strength than the base 511 and support the base 511, are connected to both end portions of the base 511 in the rotation axis direction, and the rotational driving force from the drive motor 91 is transmitted through the cutouts formed in the support members, the fixing device 50 according to this exemplary embodiment has a smaller component count and simplified configuration; besides, since the heat capacity is reduced for the support members, the fixing temperature is reached earlier.

Sixth Exemplary Embodiment

The sixth exemplary embodiment is characterized in that, in the case where the temperature becomes equal to or higher than the fixing temperature, the heat roll 51 is rotated by the frictional force between the inner circumferential surface of the gear 531 and the outer circumferential surface of the base 511 of the heat roll 51, which is generated due to the deformation caused by the difference between a coefficient of linear expansion of the material of the gear 531 and a coefficient of linear expansion of the material of the base 511 of the heat roll 51. Hereinafter, description will be given with regard to the difference between the sixth exemplary embodiment and the fifth exemplary embodiment. The same components are denoted by the same reference numerals, and the detailed description thereof will be omitted.

The gear 531 according to the sixth exemplary embodiment is, as shown in FIG. 23, substantially a cylindrical member on the outer circumferential portion of which the helical teeth 531*a* are formed. The material and the size of the inner diameter of the inner circumferential surface of the gear 531 are determined as follows. The material of the gear 531 is a material having a high heat resistance and a coefficient of linear expansion smaller than that of the nickel, which is the material of the base 511 of the heat roll 51, for example, SUS430. The inner diameter of the inner circumferential surface of the gear 531 is set is set so that the frictional force generated between the gear 531 and the outer circumferential surface of the base 511 is smaller than the above-described required frictional force in the case of the temperature lower than the fixing temperature, and is equal to or larger than the above-described required frictional force in the case of the temperature equal to or higher than the fixing temperature. In other words, the inner diameter of the inner circumferential surface of the gear 531 is set so that, at the temperature lower than the fixing temperature, the frictional force generated between the inner circumferential surface of the gear 531 and the outer circumferential surface of the base 511 is smaller than the required frictional force, and when the temperature reaches the temperature region equal to or higher than the fixing temperature, the amount of thermal expansion in the outer diameter of the outer circumferential surface of the base 511 becomes larger than the amount of thermal expansion in the inner diameter of the inner circumferential surface of the gear 531 due to the difference between the coefficient of linear expansion of the material of the gear 531 and the coefficient of linear expansion of the material of the base 511, thus making the frictional force generated between the inner circumferential surface of the gear 531 and the outer circumferential surface of the base 511 equal to or larger than the required frictional force.

Even though the gear 531 and the heat roll 51 according to the sixth exemplary embodiment are configured as described above, the gear 531 is mounted to the heat roll 51 and functions as the rotation unit that rotates upon receiving the rotational driving force from the drive motor 91. Then, in the case where the controller 90 rotates the drive motor 91 in the clockwise direction as viewed in FIG. 1 for performing the fixing operation in the fixing device 50, the frictional force generated between the inner circumferential surface of the gear 531 and the outer circumferential surface of the base 511 of the heat roll 51 is equal to or larger than the required frictional force due to the deformation caused by the difference between the coefficient of linear expansion of the material of the gear 531 and the coefficient of linear expansion of the material of the base 511 of the heat roll 51, and thereby the heat roll 51 is also rotated in the clockwise direction. The endless belt 52 is also rotated to follow the rotation of the heat roll 51. Consequently, when the sheet onto which the toner image is transferred passes though the nip portion N, the toner image on the sheet is fixed by the pressure applied to the nip portion N and the heat supplied from the heat roll 51.

In this manner, in the fixing device 50 according to this exemplary embodiment, due to the thermal deformation of the heat roll 51 and the gear 531, the heat roll 51 is rotated by the frictional force generated between the inner circumferential surface of the gear 531 and the base 511 of the heat roll 51, and accordingly, the strength of the heat roll 51 itself may be low. Therefore, the thickness of the base 511 may be thin compared to the configuration in which the rotational driving force is transmitted through the cutout formed in the base 511. If the thickness of the base 511 of the heat roll 51 is thin, the heat capacity of the heat roll 51 is reduced, thus reaching the above-described fixing temperature earlier. Further, compared to the configuration in which support members, which have higher strength than the base 511 and support the base 511, are connected to both end portions of the base 511 in the rotation axis direction, and the rotational driving force from the drive motor 91 is transmitted through the cutouts formed in the support members, the fixing device 50 according to this exemplary embodiment has a smaller component count and simplified configuration; besides, since the heat capacity is reduced for the support members, the fixing temperature is reached earlier.

It should be noted that the characteristics of the fifth exemplary embodiment may be further added to the above-described characteristics of the sixth exemplary embodiment. That is, the frictional force generated between the inner circumferential surface of the gear 531 and the outer circumferential surface of the base 511 of the heat roll 51 may be set so that, in the case where the temperature becomes equal to or higher than the fixing temperature for performing fixing operation, both of the deformation of the heat roll 51 and the gear 531 due to the difference between the coefficient of linear expansion of the material of the gear 531 and the coefficient of linear expansion of the material of the base 511 of the heat roll 51 and the deformation of the heat roll 51 due to the press applied to the heat roll 51 by the pressure pad 54 via the endless belt 52 are caused together, and thereby the frictional force becomes equal to or larger than the above-described required frictional force.

Further, the characteristics of the above-described first to sixth exemplary embodiments may be combined. For example, the characteristics of the fifth exemplary embodiment may be added to the above-described characteristics of the first exemplary embodiment. That is, the frictional force generated between the torsion coil spring 532 and the base 511 of the heat roll 51 may be set so that both of the deformation of the torsion coil spring 532 in which the inner diameter of the coil portion 532*a* is reduced upon receiving the force on the torsion coil spring 532 from the gear 531 and the deformation of the heat roll 51 due to the press applied to the heat roll 51 by the pressure pad 54 via the endless belt 52 are caused together, and thereby the frictional force becomes equal to or larger than the above-described required frictional force.

Seventh Exemplary Embodiment

In the first to sixth exemplary embodiments, the mode for regulating movements of the gear unit 53, the gear 531, the torsion coil spring 532 and the heat roll 51 in the rotation axis direction by use of the thrust bearing members 517 is employed; however, in the seventh exemplary embodiment, the mode for regulating movements of these members in the rotation axis direction is different. Hereinafter, description will be given with regard to the difference between the seventh exemplary embodiment and the first exemplary embodiment. The same components are denoted by the same reference numerals, and the detailed description thereof will be omitted.

Figure 24B:
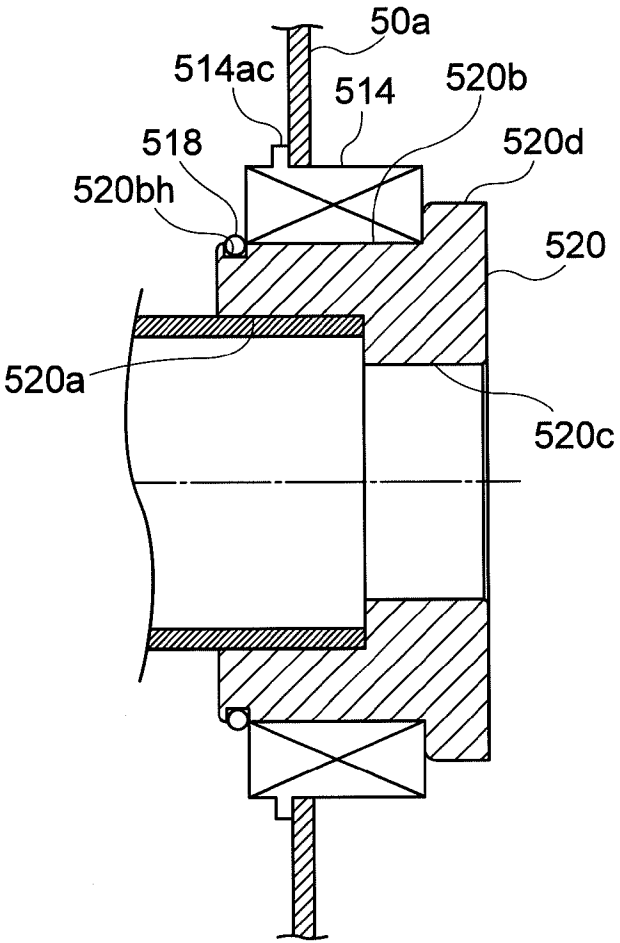
FIG. 24B is a cross-sectional view illustrating a retaining member according to the seventh exemplary embodiment.
Figure 24A:
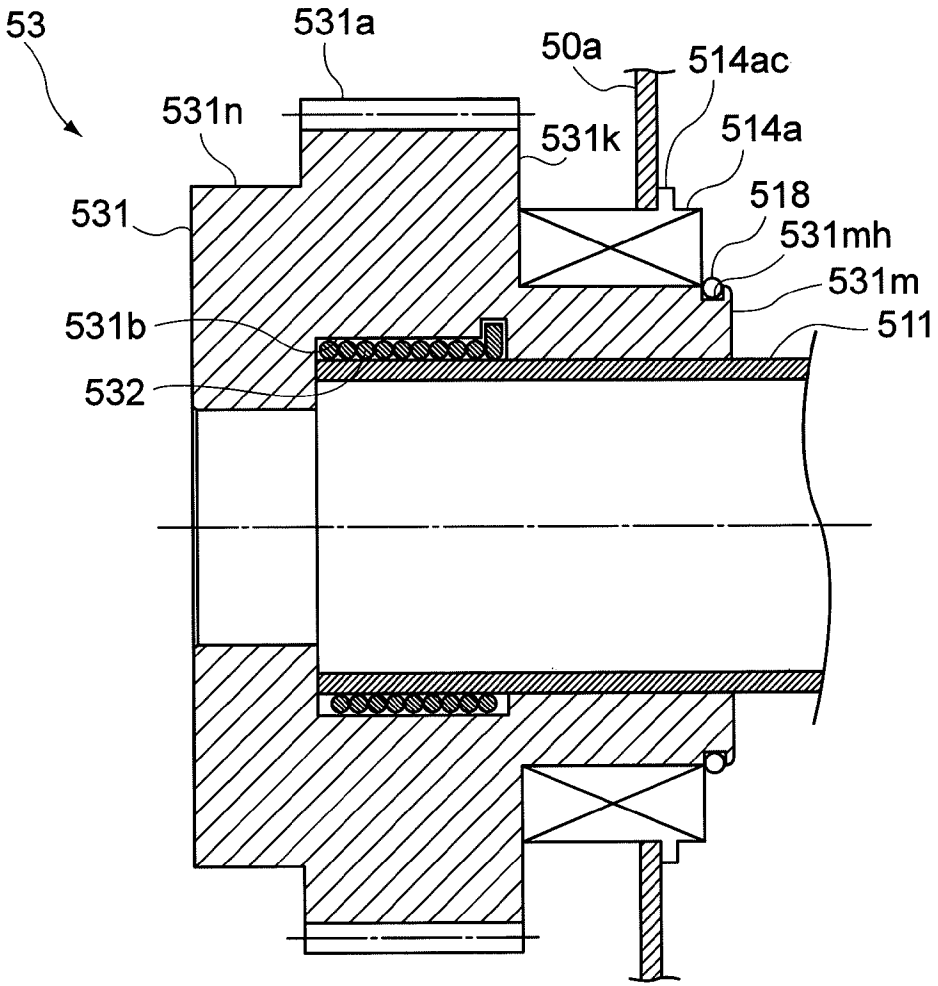
FIG. 24A is a cross-sectional view illustrating a gear and a heat roll according to a seventh exemplary embodiment.

FIG. 24A is a cross-sectional view illustrating the gear 531, the heat roll 51 and the like according to the seventh exemplary embodiment, and FIG. 24B is a cross-sectional view illustrating a retaining member 520 and the like according to the seventh exemplary embodiment.

The gear 531 according to the seventh exemplary embodiment includes: a fourth cylindrical portion 531*k* on the circumferential portion of which the helical teeth 531*a* are formed, and inside of which the mounting portion 531*b* for mounting the torsion coil spring 532 is formed; a fifth cylindrical portion 531*m* formed continuously to the fourth cylindrical portion 531*k* on one end portion side in the rotation axis direction thereof; and a sixth cylindrical portion 531*n* formed continuously to the fourth cylindrical portion 531*k* on the other end portion side in the rotation axis direction thereof. The inner diameter of the fifth cylindrical portion 531*m* is larger than the outer diameter of the base 511 of the heat roll 51, and the base 511 is fitted into the fifth cylindrical portion 531*m* by the loose fit. On the other hand, the outer diameter of the fifth cylindrical portion 531*m* is formed such that a bearing member 514*a*, which rotatably supports the heat roll 51 with respect to the main frame 50*a*, is fitted over the fifth cylindrical portion 531*m*. On the outer circumferential surface of the fifth cylindrical portion 531*m*, a concave portion 531*mh* which is recessed toward the inside of the rotation radius direction from the outer circumferential surface is provided over the entire circumferential direction. The inner diameter of the sixth cylindrical portion 531*n* is smaller than the inner diameter of the base 511 of the heat roll 51, and is larger than the outer diameter of the halogen heater 515 so as to enable the halogen heater 515 to go inside the sixth cylindrical portion 531*n*. Whereas, the outer diameter of the sixth cylindrical portion 531*n* is larger than the inner diameter of the fourth cylindrical portion 531*k* and is smaller than a bottom diameter of the helical teeth 531*a*.

The bearing member 514*a* is, for example, a ball bearing, and the outer circumferential surface thereof is fitted over the main frame 50*a*. On the outer circumferential surface, a projection portion 514*ac* that projects toward the outside in the rotation radius direction from the outer circumferential surface is provided. On the other hand, the inner circumferential surface of the bearing member 514*a* is fitted over the outer circumferential surface of the fifth cylindrical portion 531*m*. After the bearing member 514*a* is fitted over the gear 531, a C-shaped ring 518 is fitted into the concave portion 531*mh* formed on the outer circumferential surface of the fifth cylindrical portion 531*m*, thus regulating movement of the bearing member 514*a* in the rotation axis direction by an end surface of the fourth cylindrical portion 531*k* of the gear 531 and the ring 518.

Description will be given to an assembling method of the gear unit 53, the bearing member 514*a* and the heat roll 51 configured as above. First, the torsion coil spring 532 is mounted to the mounting portion 531*b* of the fourth cylindrical portion 531*k* from the fifth cylindrical portion 531*m* side of the gear 531 while being rotated in the direction such that the outer diameter of the torsion coil spring 532 is reduced, thus assembling the gear unit 53. The bearing member 514*a* is then fitted over the outer circumferential surface of the fifth cylindrical portion 531*m* of the gear 531 and the ring 518 is fitted into the concave portion 531*mh*, thus configuring a gear assembly with the gear unit 53, the bearing member 514*a* and the ring 518. Thereafter, the gear assembly is fitted over the base 511 of the heat roll 51 while being rotated in the direction such that the inner diameter of the torsion coil spring is increased.

As shown in FIG. 24B, on one end portion in the rotation axis direction of the heat roll 51, the retaining member 520 that retains the heat roll 51 is provided. In the retaining member 520, a base fitting surface 520*a* inside of which the base 511 of the heat roll is to be inserted, and a bearing fitting surface 520*b* on the outside of which the bearing member 514*a* is fitted, the bearing member 514*a* being provided with the projection portion 514*ac* on the outer circumferential surface thereof, which projects toward the outside in the rotation radius direction from the outer circumferential surface, are formed. On the bearing fitting surface 520*b*, a concave portion 520*bh* which is recessed toward the inside of the rotation radius direction from the bearing fitting surface 520*b* is provided over the entire circumferential direction. Further, the retaining member 520 includes: an inward projection portion 520*c* which is positioned on one end portion side in the rotation axis direction of the base fitting surface 520*a* and projects toward the inside in the rotation radius direction from the base fitting surface 520*a*; and an outward projection portion 520*d* which is positioned on one end portion side in the rotation axis direction of the bearing fitting surface 520*b* and projects toward the outside in the rotation radius direction from the bearing fitting surface 520*b*. The inner diameter of the inward projection portion 520*c* is smaller than the inner diameter of the base 511 of the heat roll 51, and is larger than the outer diameter of the halogen heater 515 so as to enable the halogen heater 515 to go inside the inward projection portion 520*c*.

Before assembling the retaining member 520 thus configured into the heat roll 51, the bearing member 514*a* is fitted into the retaining member 520 and the C-shaped ring 518 is fitted into the concave portion 520*bh* formed on the outer circumferential surface of the bearing fitting surface 520*b* to generate a state where the movement of the bearing member 514*a* in the rotation axis direction is regulated by the outward projection portion 520*d* and the ring 518. Thereafter, the retaining member 520 into which the bearing member 514*a* has been fitted is fitted over the heat roll 51.

Then, the heat roll 51, on one end portion side in the rotation axis direction of which the retaining member 520 into which the bearing member 514*a* is fitted, and on the other end portion side in the rotation axis direction of which the gear assembly is fitted, is fitted into the main frame 50*a* in which a U-shaped hole is formed. On this occasion, each projection portion 514*ac* provided on the outer circumferential surface of each of two bearing members 514*a* is fitted so as to be positioned inside of the main frame 50*a*. Accordingly, the movements of the heat roll 51 and the gear unit 53 in the rotation axis direction is regulated.

Other modes for regulating movements of the gear unit 53, the gear 531, the torsion coil spring 532 and the heat roll 51 may be configured as follows. The inner diameter of the base 511 of the heat roll 51 is set substantially constant over the entire rotation axis direction, and the outer diameter is set to become gradually larger along the move from the center portion toward both end portions in the rotation axis direction. In other words, the inner diameter of the base 511 is set substantially constant over the entire rotation axis direction, and the thickness of the base 511 is set to become gradually thicker along the move from the center portion toward both end portions in the rotation axis direction. Consequently, since the outer diameter of the base 511 is larger at the outward position of the bearing member 514*a* than at the inward position thereof, the movement of the heat roll 51 in the rotation axis direction is regulated. Further, the outer diameter of the base 511 is larger at the outward position in the gear unit 53, the gear 531 or the torsion coil spring 532 than at the inward position thereof, and thereby outward movement of the gear unit 53, the gear 531 or the torsion coil spring 532 with respect to the base 511 is suppressed.

Eighth Exemplary Embodiment

In the fixing device 50 according to the first to seventh exemplary embodiment, the heat roll 51 is rotated by use of the frictional force, the heat roll 51 including the base 511 which forms the nip portion N by elastically deforming due to the contact with the endless belt 52 and restores to the cylindrical shape by the rigidity of its own in the state where the heat roll 51 is not in contact with the endless belt 52; however, in a fixing device 60 according to the eighth exemplary embodiment, there is a difference in that an item having a rigidity lower than that of the base 511 is rotated by use of the frictional force. Hereinafter, description will be given with regard to the difference between the eighth exemplary embodiment and the first exemplary embodiment. The same components are denoted by the same reference numerals, and the detailed description thereof will be omitted.

Figure 25:
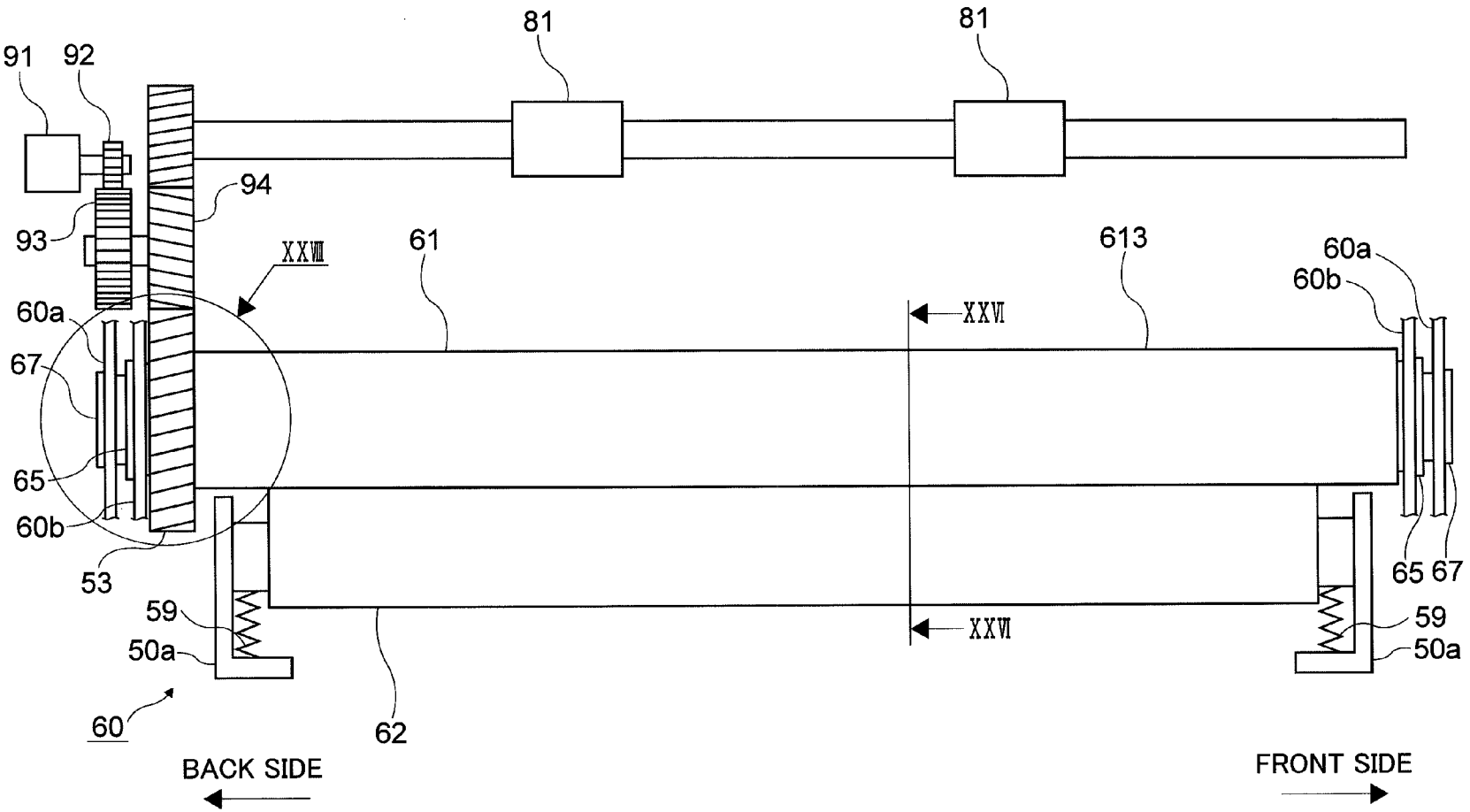
FIG. 25 is a schematic front view showing a configuration of a fixing device according to an eighth exemplary embodiment as viewed in the direction II in FIG. 1 from a downstream side of a sheet transport direction.
Figure 26:
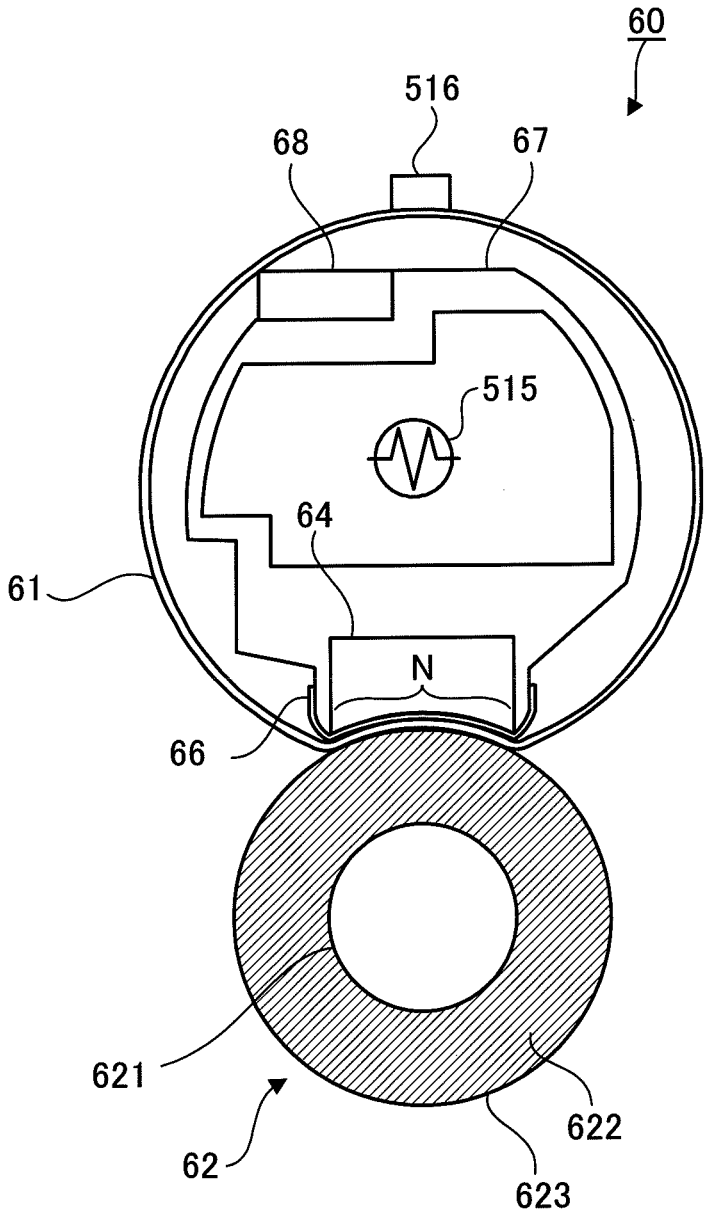
FIG. 26 is a cross-sectional view taken along the XXVI-XXVI part in FIG. 25.
Figure 27:
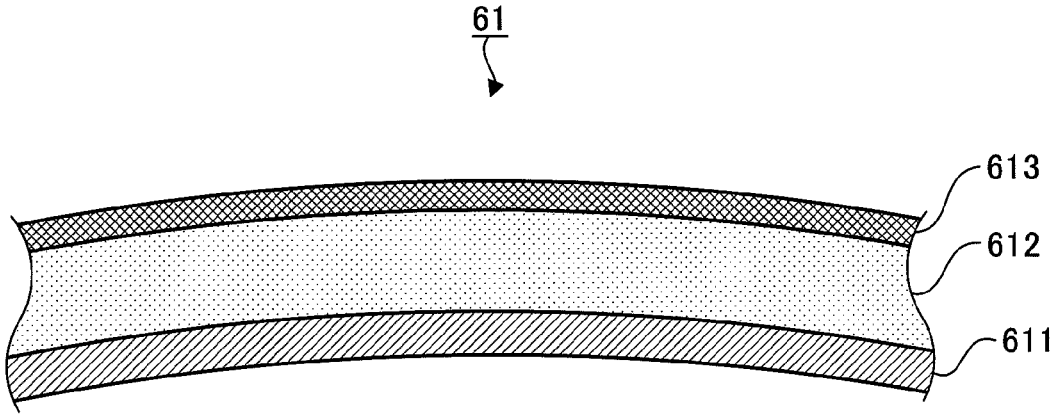
FIG. 27 is an enlarged cross-sectional view of a heating belt.
Figure 28:
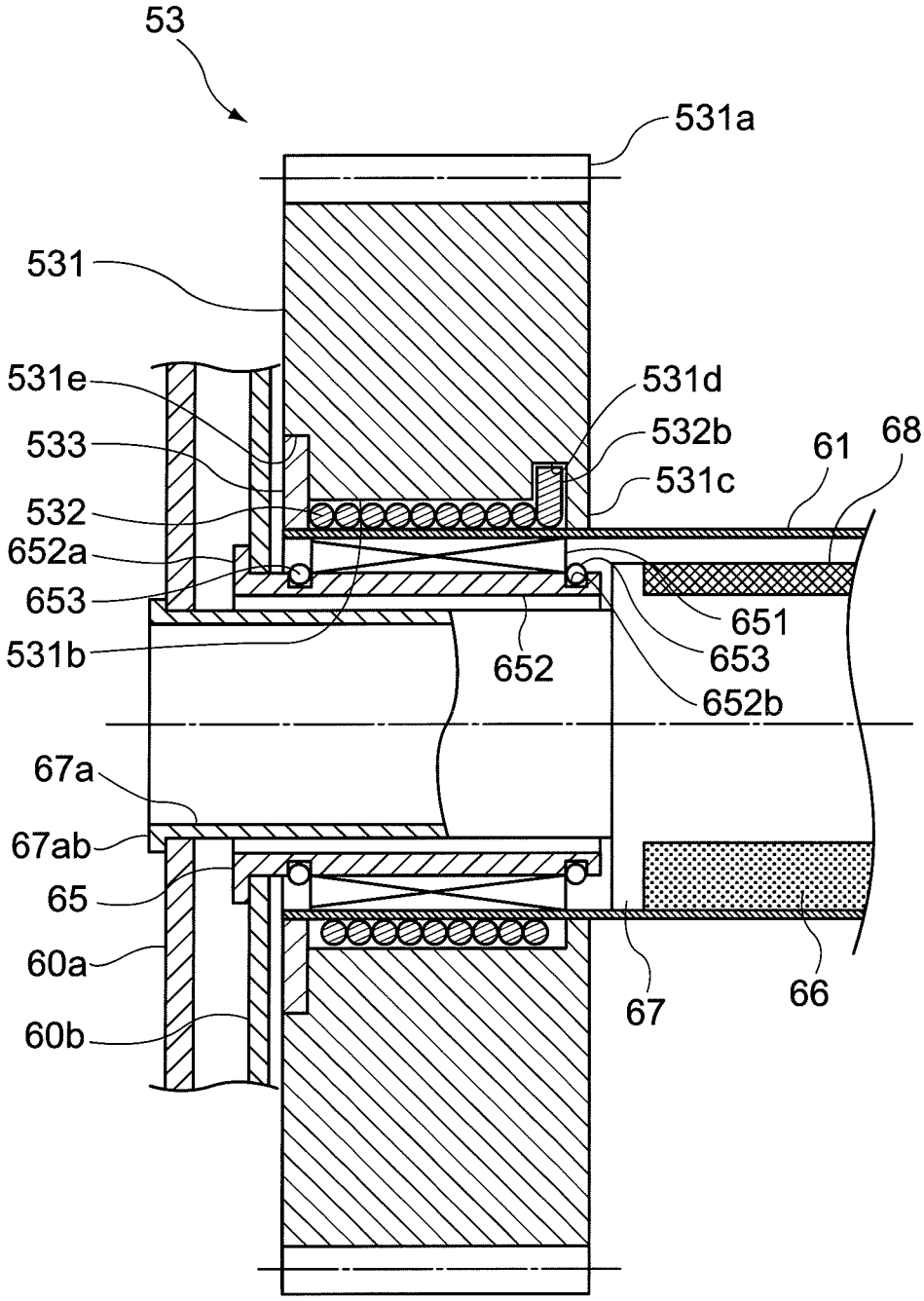
FIG. 28 illustrates a state where the heating belt is supported, which is an enlarged view of the XXVIII part in FIG. 25.

FIG. 25 is a schematic front view showing a configuration of the fixing device 60 according to the eighth exemplary embodiment as viewed in the direction II in FIG. 1 from a downstream side of the sheet transport direction. FIG. 26 is a cross-sectional view taken along the XXVI-XXVI part in FIG. 25. FIG. 27 is an enlarged cross-sectional view of a heating belt 61. FIG. 28 illustrates a state where the heating belt 61 is supported, which is an enlarged view of the XXVIII part in FIG. 25.

The fixing device 60 according to the eighth exemplary embodiment includes: the heating belt 61 as an example of the heating member having an endless circumferential surface; and a pressure roll 62 as an example of the pressure unit, which is arranged to be in contact with the outer circumferential surface of the heating roll 61. A gear unit 53, as an example of the rotation unit that rotates by an external force, is mounted to the heating belt 61.

The heating belt 61 is, as shown in FIG. 27, configured by laminating a base layer 611 made of a sheet-like member having high heat-resistance, an elastic layer 612 and a surface release layer 613 that constitutes an outer circumferential surface from an inner circumferential surface side in this order. In some cases, a primer layer or the like is provided between the above layers for bonding.

As the base layer 611, a material having flexibility, excellent mechanical strength and high heat-resistance, such as fluororesin, polyimide resin, polyamide resin, polyamideimide resin, PEEK resin, PES resin, PPS resin, PFA resin, PTFE resin, FEP resin or the like, is used. The thickness of the layer may be in a range of 10 μm to 150 μm. This is because, in the case where the thickness is less than 10 μm, the enough strength for the heating belt 61 cannot be obtained, whereas, in the case where the thickness is more than 150 μm, flexibility is compromised and the time to reach the fixing temperature becomes longer due to an increased heat capacity. In this exemplary embodiment, a sheet-like member made of polyimide resin having a thickness of 80 μm is used.

As the elastic layer 612, silicone rubber, fluororubber, fluoro-silicone rubber or the like having excellent heat-resistance and thermal conductivity is used. The thickness of the layer may be in a range of 10 μm to 500 μm. The reason is as follows. In the case of printing a color image, especially in the case of printing a photographic image, a solid image is often formed over a large area on a sheet. Accordingly, if the surface (surface release layer 613) of the heating roll 61 cannot follow asperities on the toner image or the sheet, unevenness in heating occurs in the toner image, thus generating gloss variation in the fixed image between a portion in which a large amount of heat has been transferred and a portion in which a small amount of heat has been transferred. In other words, the gloss level is high in the portion of large heat transfer amount and the gloss level is low in the portion of small heat transfer amount. This phenomenon is apt to occur in the case where the thickness of the elastic layer 612 is less than 10 μm. Consequently, the thickness of the elastic layer 612 may be set equal to or more than 10 μm. On the other hand, in the case where the thickness of the elastic layer 612 is more than 500 μm, the heat resistance of the elastic layer 612 is increased, and thereby quick start performance of the fixing device 60 is decreased. Accordingly, the thickness of the elastic layer 612 may be set equal to or less than 500 μm. In this exemplary embodiment, silicone rubber having a rubber hardness of 15° (by JIS-A or JIS-K Type-A tester) and a thickness of 200 μm is used.

Further, for the elastic layer 612, if the rubber hardness is excessively high, the heating belt 61 cannot follow the asperities on the toner image or the sheet, thus readily causing gloss variation in the fixed image. Accordingly, the rubber hardness for the elastic layer 612 may be equal to or less than 50° (by JIS-A or JIS-K Type-A tester).

Moreover, the thermal conductivity • of the elastic layer 612 may be in a range of $•=6\times10^{4}$ to $•=2\times10^{3}$ [cal/cm·sec·deg]. In the case where the thermal conductivity • is less than $6\times10^{-4}$ [cal/cm·sec·deg], the heat resistance becomes high, and thereby temperature rise on the surface (surface release layer 613) of the heating belt 61 slows down. On the other hand, in the case where the thermal conductivity • is more than $2\times10^{-3}$ [cal/cm·sec·deg], the hardness becomes excessively high or permanent compression set becomes worse. Accordingly, the thermal conductivity • may be set in a range of $•=6\times10^{-4}$ to $•=2\times10^{-3}$ [cal/cm·sec·deg].

Since the surface release layer 613 directly contacts the unfixed toner image transferred onto the sheet, it is required to use a material having excellent releasability and heat-resistance. Accordingly, as the material constituting the surface release layer 613, for example, tetrafluoroethylene-perfluoroalkylvinyl ether copolymer (PFA), polytetrafluoroethylene (PTFE), fluororesin, silicone resin, fluoro-silicone resin, fluororubber, silicone rubber or the like is used.

Further, the thickness of the surface release layer 613 may be 5 μm to 50 μm. In the case where the thickness of the surface release layer 613 is less than 5 μm, there is a possibility to cause problems such as a region of poor releasability formed due to unevenness in material coating, insufficient durability, and the like. Whereas, in the case where the surface release layer 613 is over 50 μm in thickness, a problem of deterioration of thermal conductivity occurs, and especially in the surface release layer 613 made of a resin base material, the hardness becomes excessively high, thus deteriorating the functions of the elastic layer 612. In this exemplary embodiment, PFA having a thickness of 30 μm is used.

Here, to improve the toner releasability of the surface release layer 613, an oil application mechanism for applying oil (release agent) to the surface release layer 613 to prevent toner offset may be arranged in contact with the heating belt 61. In particular, the oil application mechanism may be provided in the case of using toner that does not contain a low softening material.

The pressure roll 62 is configured with, as shown in FIG. 26, a cylindrical member 621 made of metal, as a core, an elastic layer 622 on the surface of the cylindrical member 621, which is made of a material having heat-resistance, such as silicone rubber, foamed silicone rubber, fluororubber, fluororesin, and the like, and a surface release layer 623 as an outermost surface. The pressure roll 62 is arranged substantially in parallel with the rotation axis of the heating belt 61, and is supported while both end portions thereof being biased by the tension springs 59 toward the heating belt 61. In this exemplary embodiment, the pressure roll 62 is biased toward the pressure pad 64 with a total load of 50 N to 250 N (5.1 kgf to 25.5 kgf) via the heating belt 61. Further, the pressure roll 62 rotates to follow the rotation of the heating belt 61.

Next, description will be given to a configuration to support the heating belt 61.

The fixing device 60 includes the pressure pad 64 (refer to FIG. 26) and an edge guide 65 (refer to FIG. 28) that rotatably support the heating belt 61, a low friction sheet 66 (refer to FIG. 26) that reduces the sliding resistance between the inner circumferential surface of the heating belt 61 and the pressure pad 64, and a holder 67 (refer to FIG. 26) made of a metal, which holds the pressure pad 64 and the low friction sheet 66.

The pressure pad 64 has a concave curved surface that follows the shape of the outer surface of the pressure roll 62, and is arranged inside the heating belt 61 in a state that the pressure pad 64 is pressed by the pressure roll 62 via the heating belt 61, thus forming the nip portion N between the heating belt 61 and the pressure roll 62. The pressure pad 64 is made of an elastic material such as silicone rubber, fluororubber or the like, or a heat-resistant resin such as polyimide resin, polyphenylene sulfide (PPS), polyether sulfone (PES), liquid crystal polymer (LCP) or the like. The pressure pad 64 is provided, in the rotation axis direction of the heating belt 61, over a region broader than the region where the sheet passes, and is configured so that the pressure roll 62 is pressed over substantially the entire length of the pressure pad 64 in the longitudinal direction.

The low friction sheet 66 is provided on the surface of the pressure pad 64, the surface being in contact with the heating belt 61. To reduce the frictional resistance between the inner circumferential surface of the heating belt 61 and the pressure pad 64, the low friction sheet 66 is made of a material having a small coefficient of friction and excellent abrasion resistance and heat resistance. Further, on the surface of the low friction sheet 66 facing the heating belt 61, minute asperities are formed so that a lubricant applied on the inner circumferential surface of the heating belt 61 may enter the sliding portion of the low friction sheet 66 which slides over the heating belt 61. The roughness Ra (arithmetic average roughness) of the asperities is 5 μm to 30 μm. This is based on the fact that, if the roughness of the asperities is less than Ra=5 μm, it is difficult to cause sufficient lubricant to enter the sliding portion that slides over the heating belt 61, and on the other hand, if the roughness is more than Ra=30 μm, traces of the asperities are conspicuous as gloss variation when fixing is performed on an OHP sheet or coated paper. Moreover, the low friction sheet 66 is formed to have no wetting property (impermeability) against the lubricant so that the lubricant does not permeate and get out from the backside of the low friction sheet 66. Specifically, the low friction sheet 66 may be formed with: a porous resin fiber cloth made of fluororesin as a base layer applied with a PET resin sheet on the surface facing the pressure pad 54; a PTFE resin sheet formed by sintering; a glass fiber sheet impregnated with Teflon (trademark) or the like, by way of example. It should be noted that the low friction sheet 66 may be configured separately from the pressure pad 64, or may be configured integrally with the pressure pad 64.

The holder 67 is a member extending in the rotation axis direction of the heating belt 61, and holds the above-described pressure pad 64 and low friction sheet 66, and a lubricant applying member 68 that extends in the rotation axis direction of the heating belt 61 to apply a lubricant to the inner circumferential surface of the heating belt 61. The holder 67 also includes, on each of both end portions in the rotation axis direction thereof, a fitted portion 67*a* to be fitted into a main frame 60*a*, which is a frame for the fixing device 60 and is fastened to the main body frame (not shown in the figure) of the image forming apparatus 1. The fitted portion 67*a* has, as shown in FIG. 28, substantially a cylindrical shape, and is provided with a brim portion 67*ab* bent outwardly in the rotation radius direction on an outermost portion in the rotation axis direction thereof. The inner diameter of the fitted portion 67*a* is larger than the outer diameter of the halogen heater 515 so as to enable the halogen heater 515 to go inside the fitted portion 67*a*. It should be noted that, in the case where a heating member of an electromagnetic induction system is employed instead of the halogen heater 515, the fixing device 60 is configured to enable a coil for electromagnetic induction to pass inside the heating belt 61.

The lubricant applying member 68 is constituted by heat-resistant felt and is impregnated with a lubricant, for example, amino modifier silicone oil having a viscosity of 300 cs, of the order of 3 g. The lubricant applying member 68 is arranged in contact with the inner circumferential surface of the heating belt 61 and supplies the lubricant of a proper amount to the inner circumferential surface of the heating belt 61 due to osmotic pressure from the heat-resistant felt. It should be noted that the lubricant applying member 68 is configured such that an edge portion of the heat-resistant felt comes into contact with the inner circumferential surface of the heating belt 61 not to supply excessive lubricant from the heat-resistant felt. Accordingly, the lubricant is supplied to the sliding portion between the heating belt 61 and the low friction sheet 66 to further reduce the sliding resistance between the heating belt 61 and the pressure pad 64 via the low friction sheet 66, thus encouraging smooth rotation of the heating belt 61.

The edge guide 65 is provided on each of both end portions in the rotation axis direction of the heating belt 61. The edge guide 65 includes, as shown in FIG. 28, a support member 651 that supports the inner circumferential surface of the heating belt 61, and a retaining portion 652 to be fitted into a sub-frame 60*b*, which is a frame for the fixing device 60 and is fastened to the main body frame (not shown in the figure). The retaining portion 652 has, as shown in FIG. 28, substantially a cylindrical shape, and is provided with a brim portion 652*a* bent outwardly in the rotation radius direction on an outward end portion in the rotation axis direction thereof, and on the outer circumferential surface thereof, two concave portions 652*b*, which are recessed toward the inside of the rotation radius direction from the outer circumferential surface, are provided over the entire circumferential direction. Further, the inner diameter of the retaining portion 652 is larger than the outer diameter of the brim portion 67*ab* of the fitted portion 67*a* of the holder 67 so that the retaining portion 652 is able to be inserted inside the heating belt 61 from the outside of the holder 67. The support member 651 is, for example, a needle bearing, and is arranged to face the torsion coil spring 532 with the heating belt 61 interposed therebetween to suppress the heating belt 61 not to ensure the circular shape due to deformation when the heating belt 61 is tightened by the torsion coil spring 532, as described later. Further, after the support member 651 is fitted over the outer circumferential surface of the retaining portion 652, a C-shaped ring 653 is fitted into each of the two concave portions 652*b*, thus regulating movement of the support member 651 in the rotation axis direction.

The heating belt 61 is rotated while being supported by the support members 651 of the edge guides 65.

Similar to the gear unit 53 according to the first exemplary embodiment, the gear unit 53 according to the eighth exemplary embodiment includes the gear 531, the torsion coil spring 532 and the cap 533. The gear unit 53 according to the eighth exemplary embodiment is different from the gear unit 53 according to the first exemplary embodiment in the point that the specifications of the torsion coil spring 532 satisfy the following points. That is, in the torsion coil spring 532 according to the eighth exemplary embodiment, the inner diameter of the coil portion 532*a* of the torsion coil spring 532 is formed smaller than the outer diameter of the heating belt 61 supported by the support members 651 so that the torsion coil spring 532 is fitted over the heating belt 61 by the interference fit. The torsion coil spring 532 is provided with settings such that, at the above-described fixing temperature, the frictional force generated between the torsion coil spring 532 and the heating belt 61 is smaller than the required frictional force, which is required to rotate the heating belt 61 against the frictional force generated between the heating belt 61 and the pressure roll 62, and the frictional force between the torsion coil spring 532 and the heating belt 61 is increased due to deformation of the torsion coil spring 532 such that the inner diameter thereof is reduced by the force applied from the gear 531, and becomes equal to or larger than the required frictional force.

Further, the fixing device 60 according to the eighth exemplary embodiment is different from the fixing device 50 according to the first exemplary embodiment in the point that, for transmitting the rotational driving force to the heating belt 61 by the gear unit 53 according to the eighth exemplary embodiment, the support member 651 is provided to the position facing the torsion coil spring 532 with the heating belt 61 interposed therebetween, and thereby the heating belt 61 maintains its shape even though the torsion coil spring 532 is deformed by the force applied from the gear 531 so that the inner diameter of the torsion coil spring 532 is reduced.

The fixing device 60 as configured above operates as follows.

In the case where the controller 90 rotates the drive motor 91 in the clockwise direction as viewed in FIG. 1 so as to perform the fixing operation in the fixing device 60, the gear 531 of the gear unit 53 is also rotated in the clockwise direction. In such a case, the torsion coil spring 532 of the gear unit 53 receives a force from the gear 531 and is deformed so that the inner diameter of the coil portion 532*a* is reduced, and the heating belt 61 is also rotated in the clockwise direction. The pressure roll 62 is also rotated to follow the rotation of the heating belt 61.

When a sheet on which a toner image is transferred passes through the nip portion N in the secondary transfer position of the image forming apparatus 1, the toner image on the sheet is fixed by the pressure applied to the nip portion N and the heat supplied from the heating belt 61. In short, the toner image on the sheet is fixed on the sheet by pressurizing and heating by the heating belt 61 and the pressure roll 62. In the fixing device 60 of the exemplary embodiment, since the nip portion N is set wider by the pressure pad 64 having a concave shape that roughly follows the outer circumferential surface of the pressure roll 62, fixing is performed more satisfactorily compared to the case where a nip portion is narrow.

On the other hand, in the case where the controller 90 rotates the drive motor 91 in the counterclockwise direction as viewed in FIG. 1 so as to reverse the sheet subjected to fixing in the fixing device 60 and transport the sheet toward the secondary transfer position again, the gear 531 of the gear unit 53 is also rotated in the counterclockwise direction. In such a case, the torsion coil spring 532 of the gear unit 53 receives a force from the gear 531, and is deformed so that the inner diameter of the coil portion 532*a* is increased, and thereby the heating belt 61 does not rotate. Accordingly, the pressure roll 62 is not rotated, too.

As described above, in the fixing device 60 according to the exemplary embodiment, since the torsion coil spring 532 is deformed so that the inner diameter of the coil portion 532*a* is reduced in the case where the gear 531 is rotated upon receiving the rotational driving force from the drive motor 91, the heating belt 61 is rotated due to the frictional force generated between the torsion coil spring 532 and the heating belt 61. That is to say, it is not that, for example, the gear 531 and the heating belt 61 are bonded by an adhesive to rotate the gear 531 and the heating belt 61 as one unit. If the gear 531 and the heating belt 61 are bonded by an adhesive, it is necessary to use an adhesive having an adhesive force strong enough to endure the rotational force of the heating belt 61 against the frictional force generated between the heating belt 61 and the pressure roll 62. However, in the fixing device 60 according to the exemplary embodiment, since the heating belt 61 is rotated by the frictional force generated on the outer circumferential surface of the heating belt 61, there is no need for using an adhesive, and therefore it is possible to cut costs compared to the configuration using an adhesive. Further, there is no possibility that the heating belt 61 is peeled from the gear 531 at the bonded portion, thus resulting in increased reliability and durability of the products compared to the configuration using an adhesive.

Further, in the case where the fixing process is not required, for example, when the drive motor 91 is rotated in the counterclockwise direction to reverse, through the reverse transport unit 82, the sheet on a single surface of which the image has been fixed by the fixing device 60, the heating belt 61 and the pressure roll 62 are not rotated. Accordingly, deterioration of the heating belt 61 and the pressure roll 62 is suppressed compared to the configuration in which the heating belt 61 and the pressure roll 62 are rotated. Further, a load to pull the sheet by the user in the sheet transport direction for clearance of a sheet jam occurred in the fixing device 60 is reduced.

It should be noted that, in the above-described eighth exemplary embodiment, both end portions of the heating belt 61 in the rotation axis direction are supported by the support members 651 of the edge guides 65; however, there is no need to be supported by the support members 651 as long as the heating belt 61 has enough rigidity to endure tightening force by the torsion coil spring 532. In such a case, the edge guides 65 may be omitted from the exemplary embodiment.

It should be noted that the characteristics of the first to third exemplary embodiments and the characteristics of the seventh exemplary embodiment may be applied to the fixing device 60 according to the eighth exemplary embodiment.

Further, in the above-described first to eighth exemplary embodiments, the case where the characteristics of rotating the heat roll 51 or the heating belt 61 by use of the frictional force generated in the heat roll 51 or the heating belt 61 for heating the sheet are applied to the fixing device 50 or the fixing device 60 for fixing the toner image on the sheet having been transferred by pressure and heat is exemplified. However, the characteristics may be applied to other device that comes in contact with a recording medium and transmits heat thereto. For example, the characteristics may be applied to a device which is used in an image forming apparatus of an ink jet system and provided upstream in the recording medium transport direction of an ink jet head for jetting ink to apply heat to the recording medium, or a device which is provided downstream of an ink jet head to dry ink applied on the recording medium or to prevent wrinkle in the recording medium.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The exemplary embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A heating device comprising:

a heating member that heats a recording medium;

a pressure unit that applies pressure to the heating member;

a rotation member that is mounted to the heating member and is rotated upon receiving an external force, and an elastic member that is deformed along with a rotation of the rotation member, wherein the heating member is rotated along with the rotation of the rotation member by a frictional force between the heating member and the elastic member generated due to deformation of a member being a part of at least one of elastic member and the heating member, and wherein the elastic member includes a projection portion extending such that a component of the elastic member is disposed at least in a radial direction of the heating member.

2. The heating device according to claim 1, wherein the heating member is rotated by a frictional force between the elastic member and the heating member generated due to a deformation of the elastic member along with the rotation of the rotation member.

3. The heating device according to claim 2, wherein the elastic member is a torsion coil spring, a coil portion of which is arranged outside the heating member, and the torsion coil spring is deformed as an inner diameter of the coil portion is reduced due to the rotation of the rotation member so that a frictional force generated between the torsion coil spring and the heating member becomes large compared to the frictional force before receiving a force from the rotation member.

4. The heating device according to claim 2, wherein the heating member has a cylindrical shape, the elastic member is a torsion coil spring, a coil portion of which is arranged inside the heating member, and the torsion coil spring is deformed as an outer diameter of the coil portion is increased upon receiving a force from the rotation member so that a frictional force generated between the torsion coil spring and the heating member becomes large compared to the frictional force before receiving the force from the rotation member.

5. The heating device according to claim 1, wherein the rotation member is arranged outside the heating member, on an outer circumferential portion of which teeth for receiving the external force are formed, and the heating member is rotated by a frictional force between the heating member and the rotation member generated due to deformation of the heating member caused by the pressure applied from the pressure unit.

6. The heating device according to claim 1, wherein the rotation member is arranged outside the heating member, on an outer circumferential portion of which teeth for receiving the external force are formed, and the heating member is rotated by a frictional force between the heating member and a member constituting the rotation member generated due to a difference in a coefficient of linear expansion between a material of the heating member and a material of the member being a part of the rotation member.

7. An image forming apparatus comprising:

an image forming unit that forms an image;

a transfer unit that transfers the image formed by the image forming unit onto a recording medium; and a heating unit that heats the recording medium onto which the image has been transferred, wherein the heating unit comprises:

a heating member that heats the recording medium;

a pressure unit that applies pressure to the heating member;

a rotation member that is mounted to the heating member and is rotated upon receiving an external force, and an elastic member that is deformed along with a rotation of the rotation member, wherein the heating member is rotated along with the rotation of the rotation member by a frictional force between the heating member and the elastic member generated due to deformation of a member being a part of at least one of the elastic member and the heating member, wherein the elastic member includes a projection portion extending such that a component of the elastic member is disposed at least in a radial direction of the heating member.

8. The image forming apparatus according to claim 7, wherein the heating member is rotated by a frictional force between the elastic member and the heating member generated due to a deformation of the elastic member along with the rotation of the rotation member.

9. The image forming apparatus according to claim 8, wherein the elastic member is a torsion coil spring, a coil portion of which is arranged outside the heating member, and the torsion coil spring is deformed as an inner diameter of the coil portion is reduced due to the rotation of the rotation member so that a frictional force generated between the torsion coil spring and the heating member becomes large compared to the frictional force before receiving a force from the rotation member.

10. The image forming apparatus according to claim 8, wherein the heating member has a cylindrical shape, the elastic member is a torsion coil spring, a coil portion of which is arranged inside the heating member, and the torsion coil spring is deformed as an outer diameter of the coil portion is increased upon receiving a force from the rotation member so that a frictional force generated between the torsion coil spring and the heating member becomes large compared to the frictional force before receiving the force from the rotation member.

11. The heating device according to claim 1, wherein both ends of the elastic member is covered with a member having an inner diameter smaller than an outer diameter of the elastic member, respectively.

12. A heating device comprising:

a heating member that heats a recording medium;

a pressure unit that applies pressure to the heating member;

a rotation member that is mounted to the heating member and is rotated upon receiving an external force; and an elastic member that is deformed along with a rotation of the rotation member, wherein the heating member is rotated by a frictional force between the elastic member and the heating member generated due to a deformation of the elastic member along with the rotation of the rotation member, and wherein the elastic member is in contact with an outer circumferential surface of the heating member and an outer circumferential surface of the rotation member.

* * * * *